US009381125B2

(12) United States Patent
Herbst et al.

(10) Patent No.: US 9,381,125 B2
(45) Date of Patent: Jul. 5, 2016

(54) PATIENT SUPPORT

(71) Applicant: Stryker Corporation, Kalamazoo, MI (US)

(72) Inventors: Cory P. Herbst, Shelbyville, MI (US); Martin W. Stryker, Kalamazoo, MI (US); James T. Thwaites, Delton, MI (US); Richard A. Derenne, Portage, MI (US); Christopher S. Hough, Kalamazoo, MI (US); Eugene Keller, Portage, MI (US)

(73) Assignee: Stryker Corporation, Kalamazoo, MI (US)

( * ) Notice: Subject to any disclaimer, the term of this patent is extended or adjusted under 35 U.S.C. 154(b) by 302 days.

(21) Appl. No.: 13/783,699

(22) Filed: Mar. 4, 2013

(65) Prior Publication Data

US 2013/0227787 A1 Sep. 5, 2013

Related U.S. Application Data

(60) Provisional application No. 61/606,147, filed on Mar. 2, 2012.

(51) Int. Cl.
*A61G 7/012* (2006.01)
*A61G 7/05* (2006.01)
(Continued)

(52) U.S. Cl.
CPC *A61G 7/012* (2013.01); *A61G 7/00* (2013.01); *A61G 7/015* (2013.01); *A61G 7/0507* (2013.01);
(Continued)

(58) Field of Classification Search
CPC ..... A61G 1/0237; A61G 7/012; A61G 7/015; A61G 7/0507; A61G 2007/0508; A61G 2007/0509; A61G 2007/0513; A61G 13/06; A61G 13/08; A61G 13/104; A61G 13/129; A61G 15/02; A61G 2200/16; A61G 2200/18; A61G 7/1067; A61G 7/08; A61G 7/00; A61G 2007/0528; A61G 2203/12; A61G 2203/30
USPC ..... 5/425, 430, 620, 86.1
See application file for complete search history.

(56) References Cited

U.S. PATENT DOCUMENTS 3,266,815 A * 8/1966 Bishop ..... 280/104
3,284,126 A * 11/1966 Piazza ..... 296/20
(Continued)

FOREIGN PATENT DOCUMENTS

EP 0499007 B1 6/1995
FR 2919479 A1 2/2009

OTHER PUBLICATIONS

PCT International Search Report regarding Application No. PCT/US2013/028820 filed Mar. 4, 2013.
(Continued)

*Primary Examiner* — Nicholas Polito
(74) *Attorney, Agent, or Firm* — Warner Norcross & Judd LLP

(57) ABSTRACT

The present invention provides a patient support that can be configured in an expanded configuration, for example to accommodate larger patients, and then reconfigured to a more compact configuration to ease maneuverability of the patient support through constricted passageways in a facility and/or to provide a low height patient support. Further, the present invention provides a barrier around the patient support surface which includes a panel that allows a patient to see through the barrier and which is optionally adaptable to change its transparency and/or color.

14 Claims, 45 Drawing Sheets

(51) Int. Cl.

| | |
|---|---|
| ***A61G 7/015*** | (2006.01) |
| ***A61G 7/00*** | (2006.01) |
| ***A61G 7/08*** | (2006.01) |
| ***A61G 7/10*** | (2006.01) |

(52) U.S. Cl.

CPC ..... *A61G 7/08* (2013.01); *A61G 7/1067* (2013.01); *A61G 2007/0509* (2013.01); *A61G 2007/0513* (2013.01); *A61G 2007/0528* (2013.01); *A61G 2200/16* (2013.01); *A61G 2203/12* (2013.01); *A61G 2203/30* (2013.01)

(56) References Cited

U.S. PATENT DOCUMENTS

| | | | | |
|---|---|---|---|---|
| 3,905,591 | A * | 9/1975 | Schorr et al. | 5/601 |
| 4,669,136 | A | 6/1987 | Waters et al. | |
| 4,985,946 | A | 1/1991 | Foster et al. | |
| 5,023,967 | A | 6/1991 | Ferrand | |
| 5,077,843 | A | 1/1992 | Foster L. Dale et al. | |
| 5,083,332 | A * | 1/1992 | Foster et al. | 5/185 |
| 5,179,744 | A | 1/1993 | Foster et al. | |
| 5,377,370 | A | 1/1995 | Foster et al. | |
| 5,454,126 | A * | 10/1995 | Foster | A61G 7/0506 5/600 |
| 5,715,548 | A | 2/1998 | Weismiller et al. | |
| 6,212,714 | B1 | 4/2001 | Allen et al. | |
| 6,295,675 | B1 | 10/2001 | Ellis et al. | |
| 6,357,065 | B1 * | 3/2002 | Adams | 5/618 |
| 6,363,552 | B1 * | 4/2002 | Hornbach | A61G 7/015 5/425 |
| 6,611,979 | B2 * | 9/2003 | Welling et al. | 5/624 |
| 6,684,427 | B2 | 2/2004 | Allen et al. | |
| 6,789,280 | B1 * | 9/2004 | Paul | 5/617 |
| 6,880,189 | B2 | 4/2005 | Welling et al. | |
| 6,910,236 | B2 | 6/2005 | Rene | |
| 7,000,272 | B2 | 2/2006 | Allen et al. | |
| 7,111,348 | B2 | 9/2006 | Ellis et al. | |
| 7,213,279 | B2 * | 5/2007 | Weismiller et al. | 5/624 |
| 7,260,860 | B2 | 8/2007 | Chambers et al. | |
| 7,353,556 | B2 | 4/2008 | Ellis et al. | |
| 7,363,663 | B2 | 4/2008 | Chambers et al. | |
| 7,398,573 | B2 | 7/2008 | Ellis et al. | |
| 7,406,729 | B2 * | 8/2008 | Hornbach et al. | 5/613 |
| 7,454,805 | B2 | 11/2008 | Osborne et al. | |
| 7,464,425 | B2 | 12/2008 | Chambers et al. | |
| 7,523,515 | B2 | 4/2009 | Allen et al. | |
| 7,559,102 | B1 | 7/2009 | Benzo et al. | |
| 7,565,710 | B2 | 7/2009 | Chambers et al. | |
| 7,698,765 | B2 | 4/2010 | Bobey et al. | |
| 7,743,441 | B2 * | 6/2010 | Poulos et al. | 5/618 |
| 7,757,318 | B2 | 7/2010 | Poulos et al. | |
| 7,805,782 | B2 | 10/2010 | Hakamiun et al. | |
| 7,832,039 | B2 | 11/2010 | Chambers et al. | |
| 7,845,032 | B2 | 12/2010 | Chambers et al. | |
| RE43,193 | E | 2/2012 | Osborne et al. | |
| 8,122,546 | B2 | 2/2012 | Chambers et al. | |
| 8,413,274 | B2 | 4/2013 | Weismiller et al. | |
| 8,776,286 | B1 * | 7/2014 | Edgerton | A61G 7/0507 5/424 |
| 2003/0093860 | A1 | 5/2003 | Kramer et al. | |
| 2003/0167568 | A1 | 9/2003 | Brooke | |
| 2005/0144720 | A1 * | 7/2005 | Poulin et al. | 5/425 |
| 2006/0026767 | A1 * | 2/2006 | Chambers et al. | 5/713 |
| 2009/0188042 | A1 | 7/2009 | Derenne et al. | |
| 2011/0277242 | A1 | 11/2011 | Dionne et al. | |
| 2012/0047653 | A1 | 3/2012 | Metz et al. | |
| 2012/0096644 | A1 * | 4/2012 | Heimbrock | 5/600 |
| 2014/0026325 | A1 | 1/2014 | Guthrie | |

OTHER PUBLICATIONS

PCT International Written Opinion regarding Application No. PCT/US2013/028820 filed Mar. 4, 2013.

European Search Report, dated Sep. 21, 21015, for European patent application EP 13755534, corresponding U.S. Appl. No. 13/783,699.

* cited by examiner

PATIENT SUPPORT

This application claims the benefit of U.S. provisional patent application Ser. No. 61/606,147, filed on Mar. 2, 2012, entitled PATIENT SUPPORT, which is hereby incorporated by reference in its entirety.

TECHNICAL FIELD AND BACKGROUND OF THE INVENTION

The present invention relates to a patient support, such as a bed, stretcher, cot, or the like, that is suitable for supporting a patient in several different environments, including a hospital, an outpatient clinic, an urgent care facility, a nursing care facility, or a long term acute care facility.

When designing patient supports, there are several competing goals. With the ever increasing number of bariatric patients, hospital beds, stretchers and cots have necessarily increased in size and weight. The size and/or weight of patient supports are not only impacted by the need to accommodate bariatric patients, but also by the desire to provide increased functionality to improve patient care and treatment. However, the use of larger and/or heavier supports may be precluded in some facilities due to the size and/or age of the facility. For example, in older hospitals, the hallways, elevators and doors may not have been designed to accommodate the size and/or weight of current patient supports.

Additionally, it is known that lowering a patient close to the floor can reduce patient falls. However, current bed side rail designs and lifting mechanisms often limit how low the patient can be lowered in order to maintain full functionality. Further, to improve pressure redistribution and thereby reduce the risk of pressure sores, the depth of patient lying surfaces have increased to provide greater immersion. As a result, the height of current mattress designs have also increased the lowered bed height.

SUMMARY OF THE INVENTION

Accordingly, the present invention provides a patient support that can be configured in an expanded configuration, for example to accommodate larger patients, and then reconfigured to a more compact configuration to ease maneuverability of the patient support through constricted passageways in a facility or to provide a low height patient support. Further, the present invention provides a patient support that is configured to reduce the complexity of some more recent bed designs to reduce size, weight, and cost.

In one embodiment of the invention, a patient support includes a frame having a head-end and a foot-end, an articulatable deck supported by the frame having a head section and a seat section, with the head section of the deck being movable between a generally horizontal orientation and a raised position. The support also includes a head-end side rail mounted to the frame adjacent but independent from the deck, which is configured for linear movement along the frame from a first position adjacent the head-end of the frame when the movable head section of the deck is in the generally horizontal orientation to form a barrier adjacent the head section of the deck to a second position away from the head-end when the head section is moved to its raised position to form a barrier adjacent the seat section.

In another embodiment of the invention, a patient support includes a patient support surface and a support frame supporting the patient support surface, which frame is adapted to increase in width to accommodate larger patients and wherein the patient support surface increases in width as the frame increases in width. For example, the patient support surface may automatically increase in size in response to the frame increasing in width.

In yet another form of the invention, a patient support includes a patient support surface, a support frame supporting the patient support surface and a base for supporting the support frame. The support frame is adapted to increase in dimension to accommodate a larger patient, and wherein the base is configured so that it also can increase in one or more directions to provide a larger footprint for the support.

According to yet another form of the invention, a patient support includes a frame and a lift mechanism for raising or lowering the frame relative to a floor. The lift mechanism is configured to lower the frame to a lowermost position wherein the frame is a low as 12 inches above the floor. In addition, a side rail is mounted to the frame, which is mounted for movement between raised and lowered positions by a mounting mechanism, which maintains the side rail in a generally vertical orientation when the side rail is moved between the raised and lowered positions even when the lift mechanism lowers the frame to its lowermost position.

In a further aspect, the mounting mechanism is adapted to allow the side rail to raise up if it makes contact with the floor when the frame is moved to its lowermost position.

In another form of the invention, a patient support includes a frame and a pair of side rails mounted to a side of the frame. Each side rail has a side rail body and is mounted for movement between raised and lowered positions by a mounting mechanism. The mounting mechanisms each include a carriage and a pair of arms rotatably mounted at one end to the side rail body and rotatably mounted at an opposed end to the carriage, with the carriages mounted for linear movement along the side of the frame.

For example, the arms of one of the side rails are configured to rotate in a counterclockwise direction when raising its respective side rail body. The arms of the other side rails (on the same side of the frame) are configured to rotate in a clockwise direction when raising the side rail body of its respective side rail.

According to yet another form of the invention, a patient support includes a frame and a side rail mounted to the frame. The side rail has a side rail body and is mounted for movement between raised and lowered positions by a mounting mechanism. The mounting mechanism includes a carriage and a pair of arms rotatably mounted to the side rail body at one end and rotatably mounted to the carriage at their opposed end. Further, the carriage provides lateral support to at least one of the arms over at least a portion of the range of motion of the arms.

In a further aspect, the at least one arm engages the carriage over at least a portion of the range of motion. For example, the carriage may include a channel, and the at least one arm includes a projecting member that extends into the channel to thereby provide lateral support to at least one arm.

In another embodiment, a patient support includes a frame and a side rail mounted to the frame. The side rail has a transparent panel wherein a patient laying down on the patient support can see through the side rail by way of the transparent panel. For example, the transparent panel may include an optical filter.

In yet another embodiment, a patient support includes a frame and a side rail mounted to the frame. The side rail includes a panel that is formed from a material that exhibits total internal reflection when light is directed into the panel from an edge of the panel. The patient support further includes a UV source for directing UV light into the edge of the panel to clean the panel.

According to another embodiment, a patient support includes a deck and a mattress. The deck has a deck frame and a deck skin, with the deck skin being resilient and being radiolucent wherein the resiliency of the patient support is provided by the mattress and the deck skin.

In another embodiment, a patient support includes a frame for supporting a patient support surface and a base for supporting the support frame. The base includes a base frame and a plurality of casters spring mounted to the base frame to provide suspension at each caster location of the base frame.

For example, each caster may be mounted to the base frame by a torsional shaft, with the torsional shaft forming a spring for each caster mounted to the shaft to thereby provide the suspension.

In any of the above patient supports, the width, length and/or height of its patient support surface may be adjusted to accommodate a larger patient and/or provide a low height support, for example, a patient support surface that is less than 18 inches off the ground, including as low as 12 inches off the supporting floor. Further, any one or more features of one embodiment may be combined with any feature or features of another embodiment.

Further any feature of one embodiment may be combined with one or more features of another embodiment. For example, in any of the above supports, the frame may be adapted to increase in size to accommodate larger patients and optional with the patient support surface increasing in size as the frame increases in size. For example, the patient support surface may automatically increase in size in response to the frame increasing in size. The width and/or length of the frame may be adjusted for example by one or more mechanical devices, including one or more linkage assembly, one or more electric devices, and/or one or more pneumatic devices.

For example, the frame may include inner rails and outer rails, which are moveably mounted to the inner rails so that they can be spaced further away from the inner rails or moved closer to the inner rails. Optionally, the outer rails may be mounted on guides to allow the outer rails to move and thereby expand or contract the size of the frame. The outer rails may be moved along the guides by the linkage assembly or assemblies. Optionally, the casters on the base may be adjusted to increase their footprint to accommodate the increase in size of the frame.

In any of the above supports, the support may include a lift mechanism which is configured to lower the frame to a lowermost position wherein the frame is as low as 12 inches above the floor.

In any of the above patient supports, one or more of the side rails may include a mounting mechanism that is adapted to allow the side rails to raise up if it makes contact with the floor when the frame is lowered.

In any of the above patient supports, the side rails may incorporate a transparent panel.

In any of the above patient supports, the patient support may include a light source, such as a UV source, for directing light for example into the side rails, such as into the edge of a panel of the side rail, to change the color of the side rails, to change the opacity of the side rails, and/or clean the side rails.

In any of the above patient supports, the patient support base may include a plurality of casters which are spring mounted to the base frame to provide suspension in each caster location.

These and other objects, advantages, purposes, and features of the invention will become more apparent from the study of the following description taken in conjunction with the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE PREFERRED EMBODIMENTS

Figure 1:
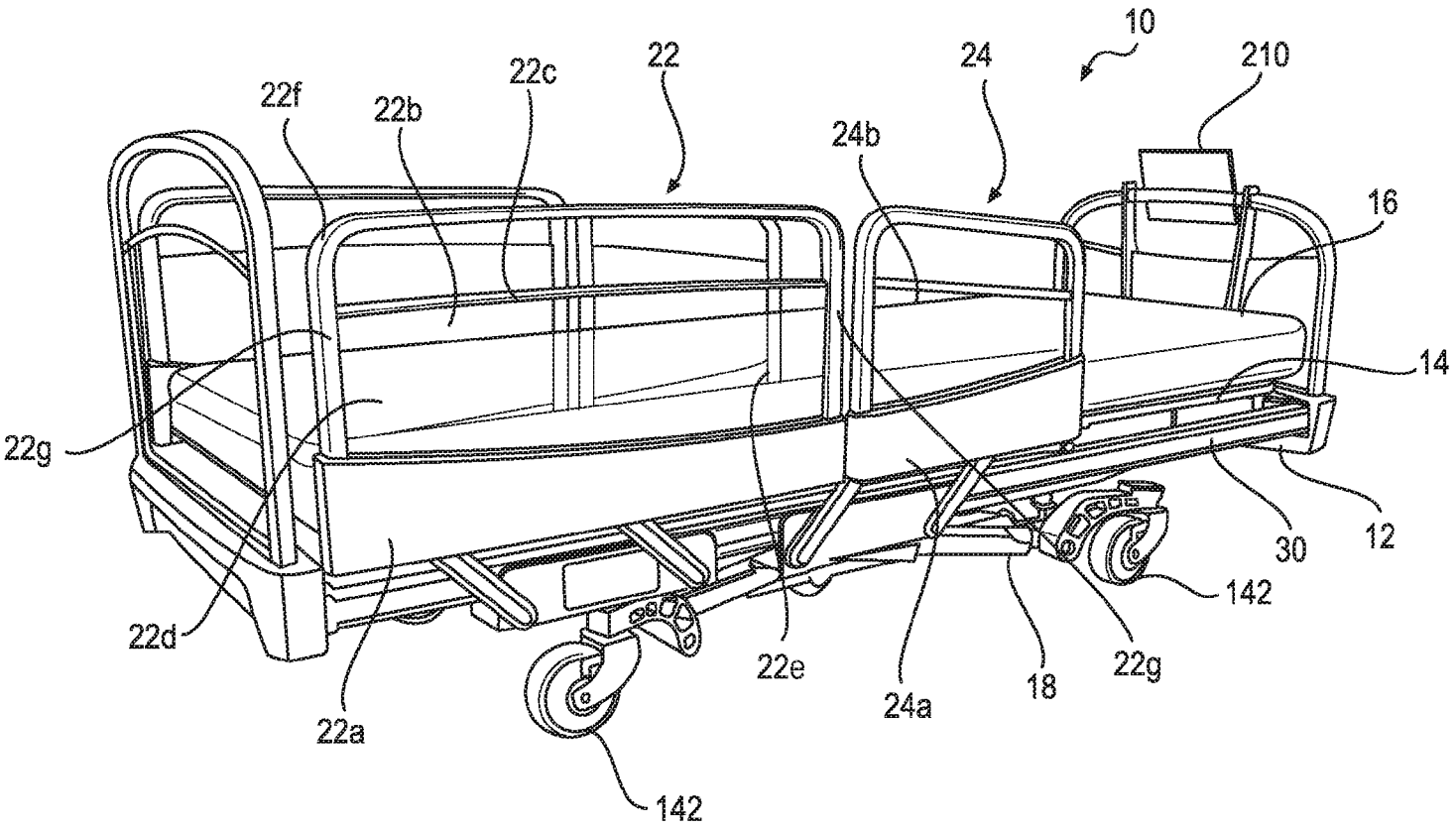
FIG. 1 is a perspective view of a patient support of the present invention shown in a lowered position.

Referring to FIG. 1, the numeral 10 generally designates one embodiment of a patient support of the present invention. While patient support 10 is illustrated as a hospital bed, such as a med/surge bed or an ICU bed, it should be understood that patient support 10 may be configured as a stretcher, cot, or the like and may be suitable for use not only in a hospital facility but also in an outpatient clinic, an urgent care facility, a nursing home, or a long term acute care facility or the like. As will be more fully described below, patient support 10 may be adapted to change its size (e.g. widen and/or lengthen) to accommodate larger patients, such as bariatric patients, but then able to be reconfigured to have a more compact configuration when needed so that it can be moved through a constriction or narrow space in a facility. For example, the change in size can be achieved either mechanically, electrically, and/or pneumatically.

Patient support 10 may be configured so that its patient support surface can be lowered to a low bed configuration, for example where the patient support surface is less than 18 inches off the floor and as low as 12 inches off the floor but without being hindered by the side rails even when the side rails are in their lowered position.

Additionally, the side rails of the patient support may optionally be configured so that they provide an unobstructed view of the patient even when the side rails are fully raised and the patient is lying in a supine position, which conversely allows the patient to have an unobstructed view outside the patient support even when lying in the supine position.

In another embodiment, the side rails may be configured to act as a signaling device.

The patient support 10 can include side rails, which can be independently mounted from the deck and optionally in manner so that the head end side rail automatically follows the patient when the head-end of the deck (and mattress) are raised. These and other optional features will be more fully described below.

Figure 2:
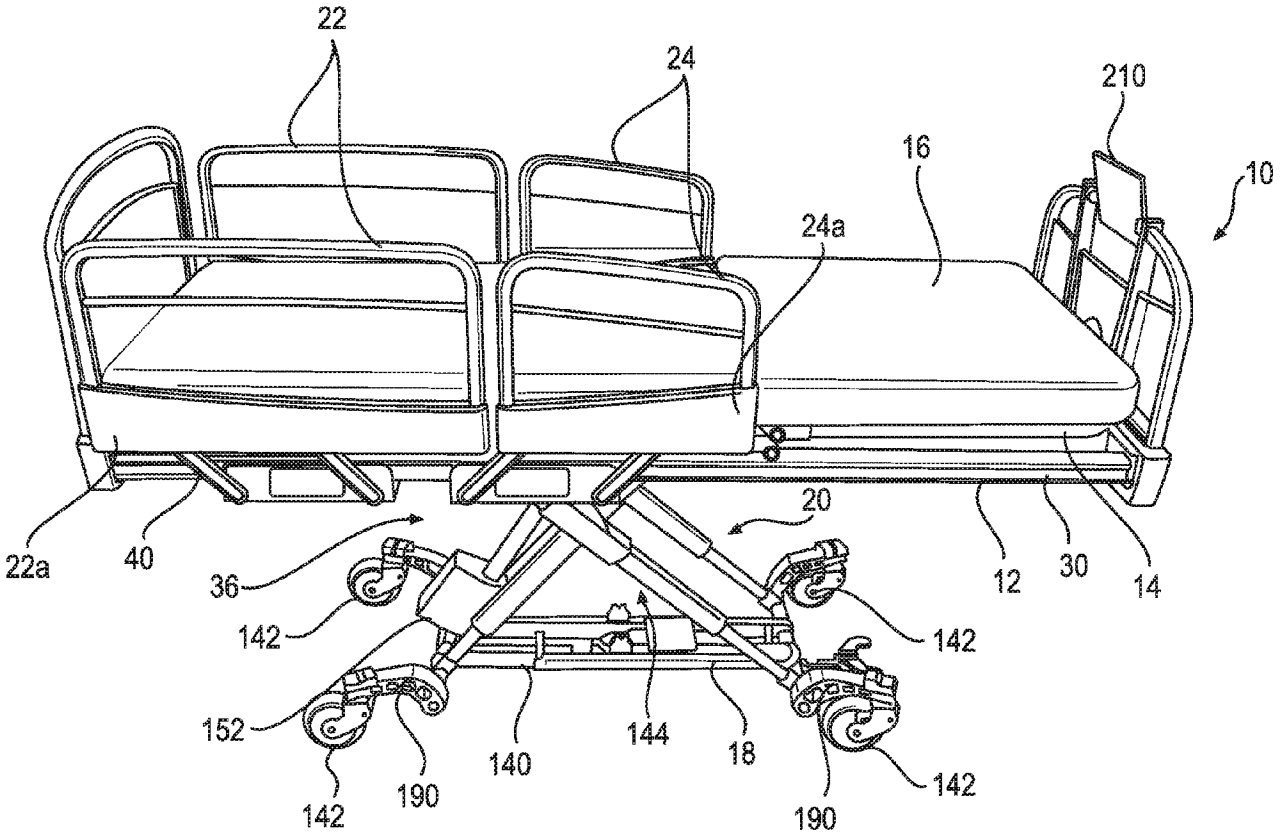
FIG. 2 is a similar view to FIG. 1 with the frame and litter deck shown in a raised position.

Referring again to FIG. 1, support 10 includes a frame 12, a deck 14, which supports a mattress 16, and a base 18, which supports frame 12. As best seen in FIG. 2, frame 12 is supported on base 18 by a lift mechanism 20, which is configured to raise or lower frame 12 relative to base 18, for example, between a fully raised position and a fully lowered position (see FIG. 1). In the illustrated embodiment, lift mechanism 20 is adapted to lower deck 14 such that it is spaced at a short distance above the floor including, for example at a distance less than 18 inches and as low as 12 inches above the floor so as to make support 10 ADA compliant. Further details of the lift mechanism are provided below in reference to FIGS. 23 and 24.

The side rails include head-end side rails 22 and foot-end side rails 24, which are optionally mounted to frame 12 rather than to deck 14. Further, each side rail 22 and 24 is optionally independently movably mounted to frame 12 and further linearly movable with respect to frame 12. It should be noted that the reference to "foot-end" is used simply as relative term to indicate that, for example, side rails 24 are closer to the foot-end of frame 12 than the head-end side rails 22, even though they may be spaced from the foot-end and moved to the middle or seat section of frame 12. Similarly, the use of "head-end" is used to designate that something is closer to or toward of faces the head-to-end.

Figure 3:
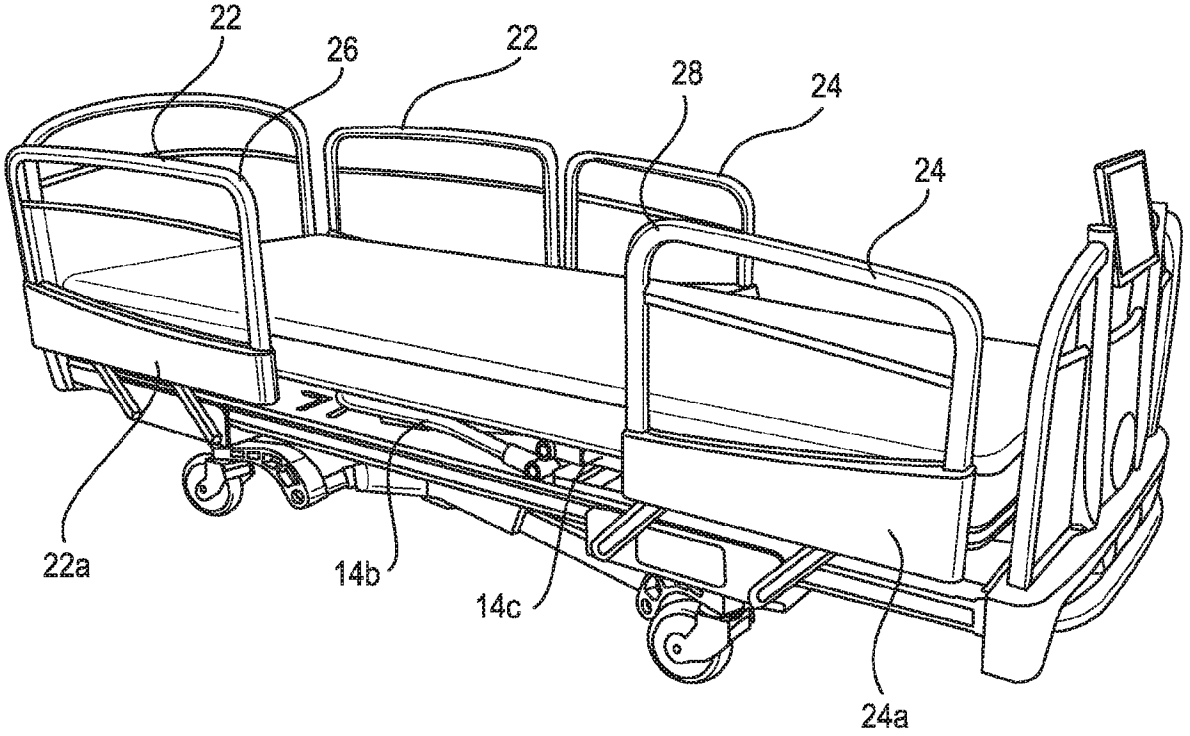
FIG. 3 is a similar view to FIG. 1 illustrating the side rails in an egress or ingress position.

Referring to FIG. 3, side rails 22 and 24 may be configured to move to an egress/ingress configuration, where at least one of head-end side rails 22 is moved closer to the head-end, and at least one of the foot-end side rails 24 is moved closer to or adjacent the foot-end of frame 12 or deck 14 so that they define an egress or ingress space there between to facilitate a patient entering or leaving patient support 10.

Figure 4:
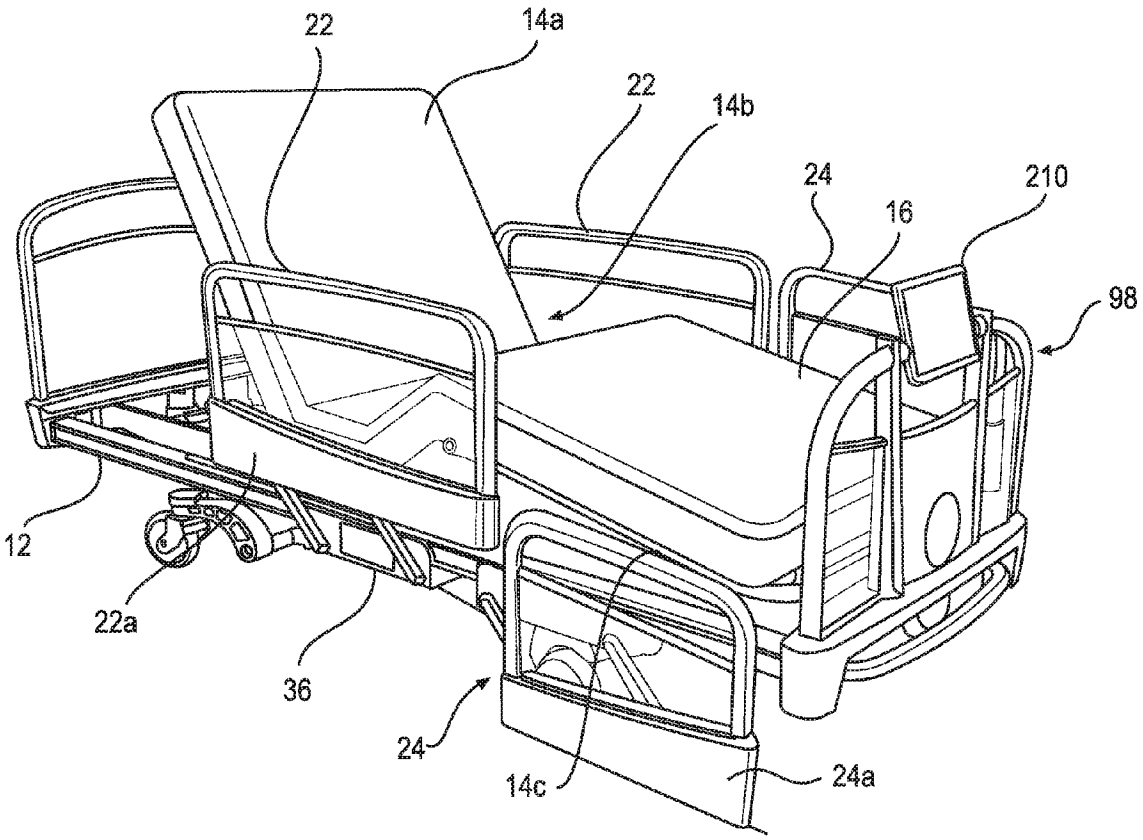
FIG. 4 is a perspective view of the patient support of FIG. 1 illustrating the fowler section of the deck and mattress in a raised position and the foot-end side rail in lowered position.

In addition, as best understood from FIG. 4, head-end side rails 22 are optionally configured so that when the head section 14*a* of deck 14 is raised, head-end side rails 22 may be moved manually, or optionally automatically, moved toward the foot-end of frame 12 so that they generally align with the seat section 14*b* of deck 14 so as to provide a barrier that better aligns with the center of gravity of a patient supported on mattress 16. For example, a link may be provided between the head-end deck section and each side rail 22 to impart the automatic movement of the side rail. Further, the head-end side rails move linearly or may rotate when moved adjacent the seat section. For example, the side rail 22 may move linearly with respect to the frame along with its mounting mechanism (described below), or the side rail body (22*a*) may rotate about its carriage (described below) to align with the seat section. In this latter case, the link that drives the side rail body movement may be between the side rail body and the head end deck section (14*a*).

Referring to FIGS. 6-10, frame 12 optionally includes a pair of deck support members 28, formed by a pair of inner rails, and a pair of longitudinal extending support rails 30, formed by a pair of outer rails, that extend generally parallel to and spaced from deck support members 28. Further, support rails 30 are optionally laterally moveable relative to deck support member 28 to widen or narrow patient support 10, as will be more fully described below in reference to FIGS. 6A-6H. As best understood from FIGS. 1-4, support rails 30 provide a mounting surface for side rails 22 and 24. Thus, side rails 22 and 24 are decoupled from deck 14. In addition, side rails 22 and 24 may be movably mounted to frame 12 by mounting mechanisms 36 that move linearly along frame 12, and about which the side rails' bodies optionally move when being raised or lowered, as described below.

Figure 11:
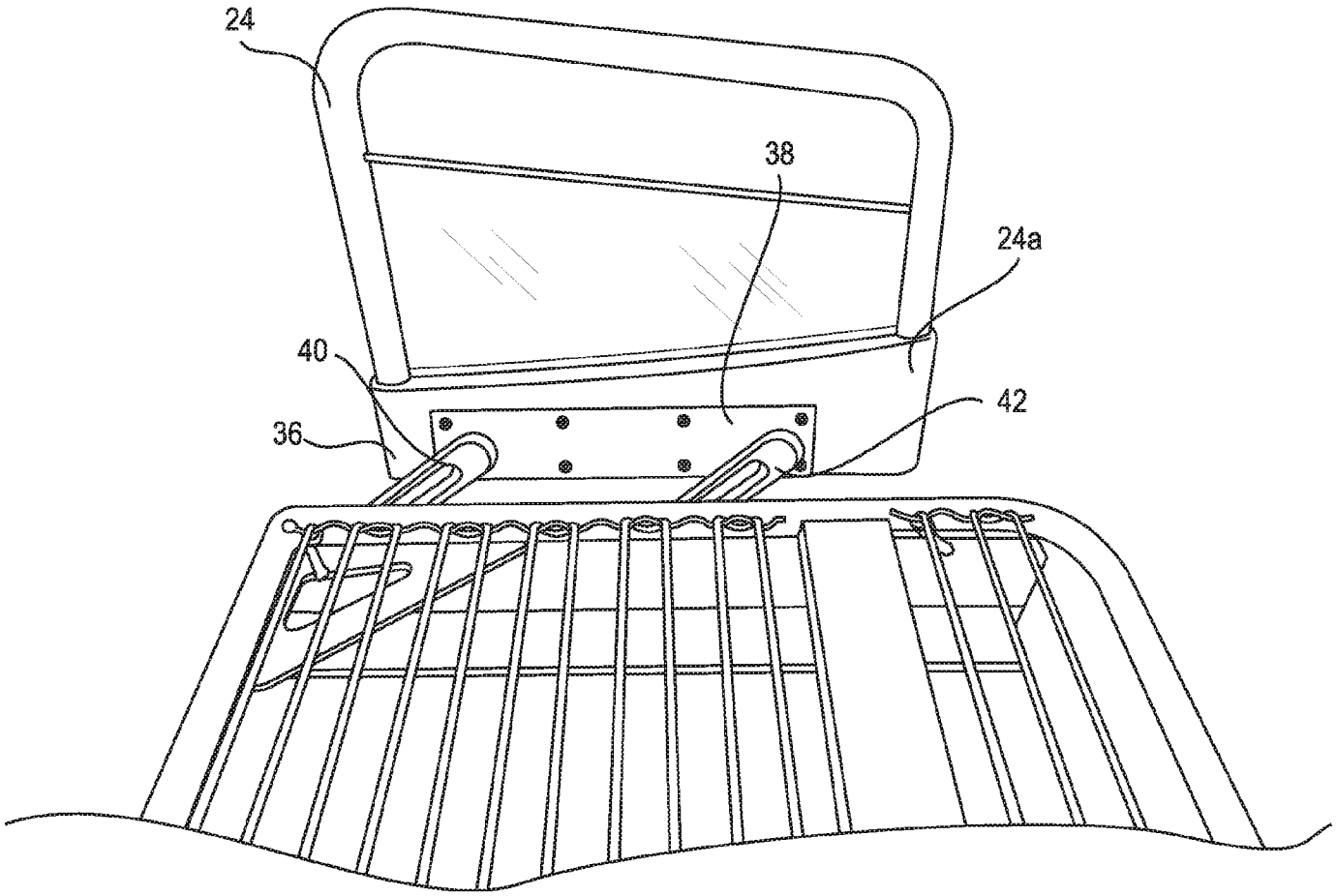
FIG. 11 is a partial inside elevation view of a foot-end side rail and foot end deck section.
Figure 11B:
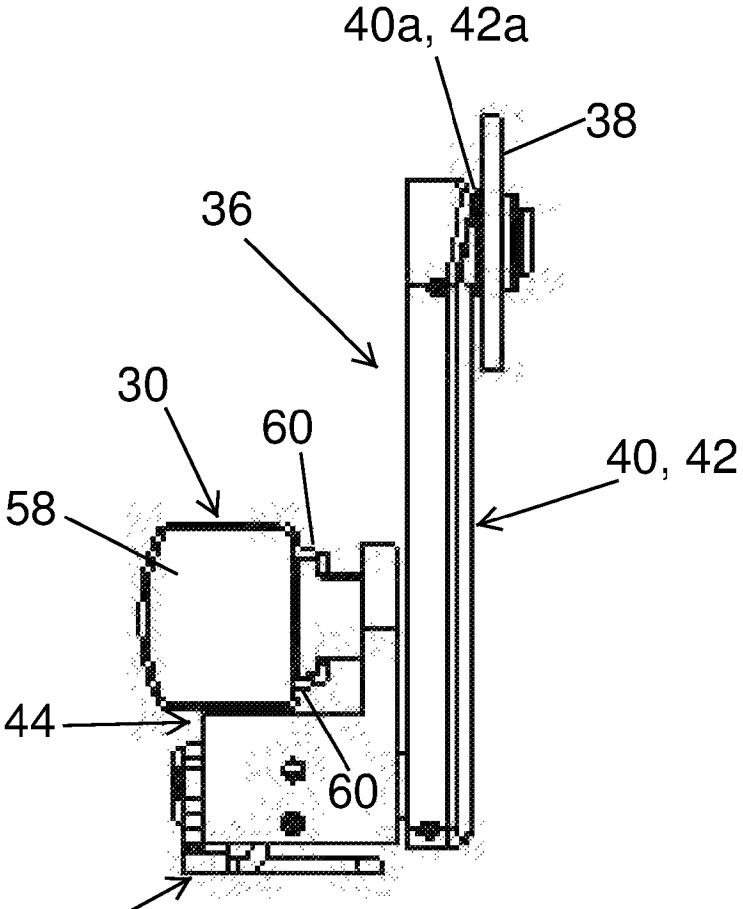
FIG. 11B is a similar view to FIG. 11A of the mounting arrangement of the right-hand side rail.
Figure 11A:
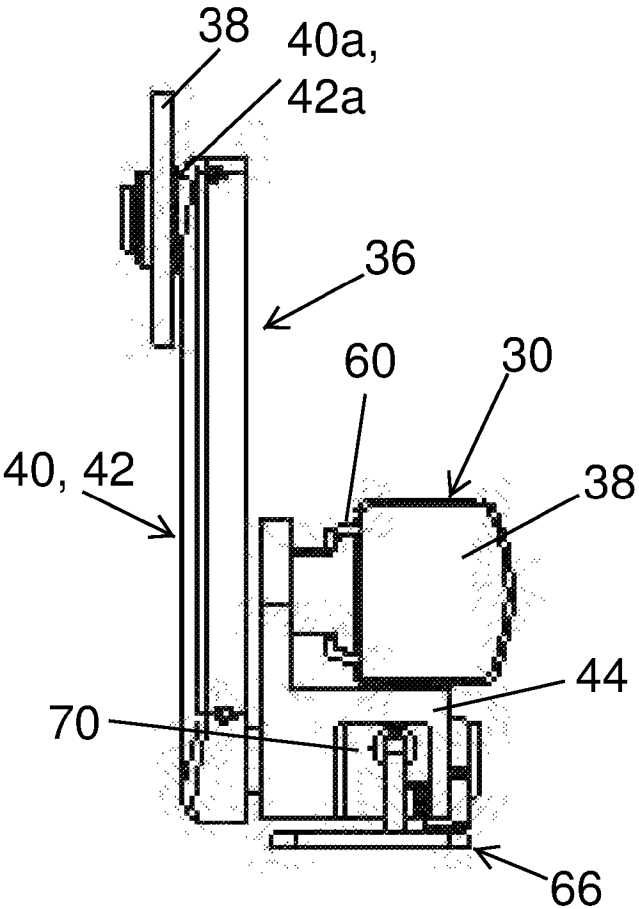
FIG. 11A is a fragmentary view of the mounting arrangement of the left-hand side rail of the patient support of FIG. 1.
Figure 12:
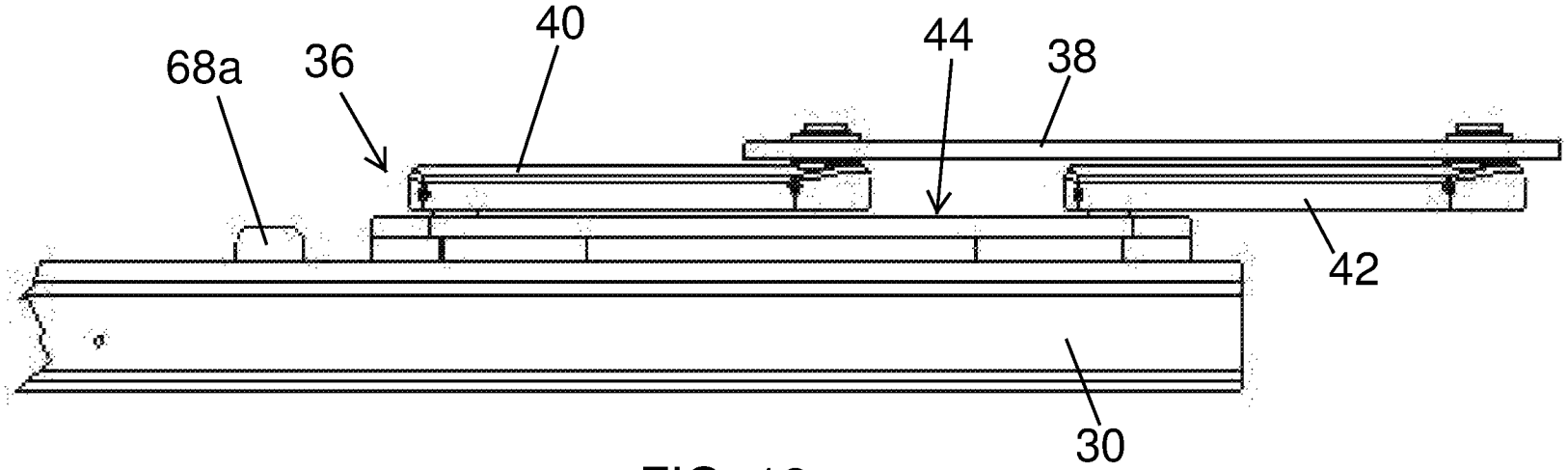
FIG. 12 is an enlarged plan view of a side rail mounting arrangement.
Figure 13:
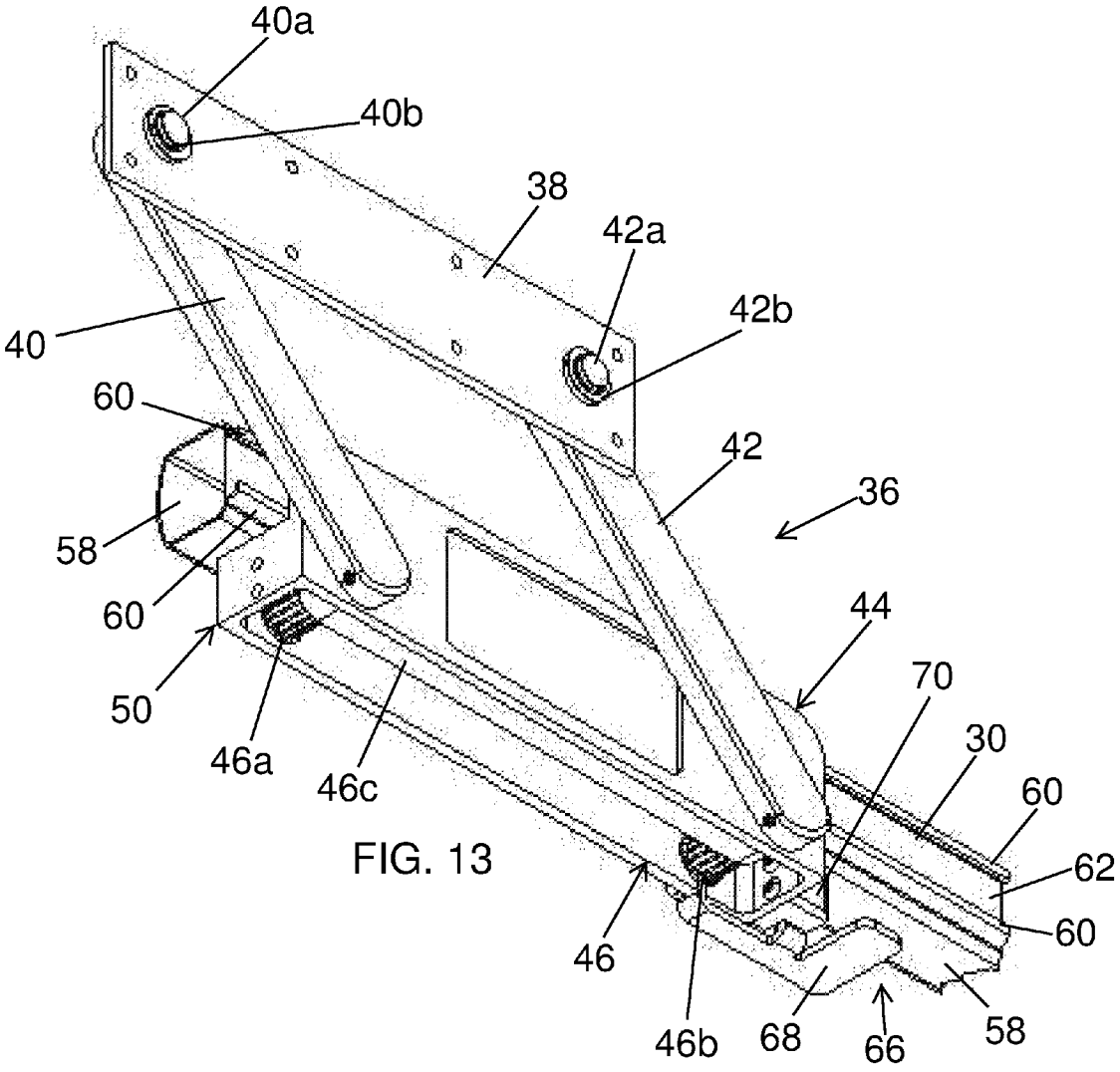
FIG. 13 is an enlarged perspective view of the side rail mounting arrangement with the side rail body removed for clarity.
Figure 14:
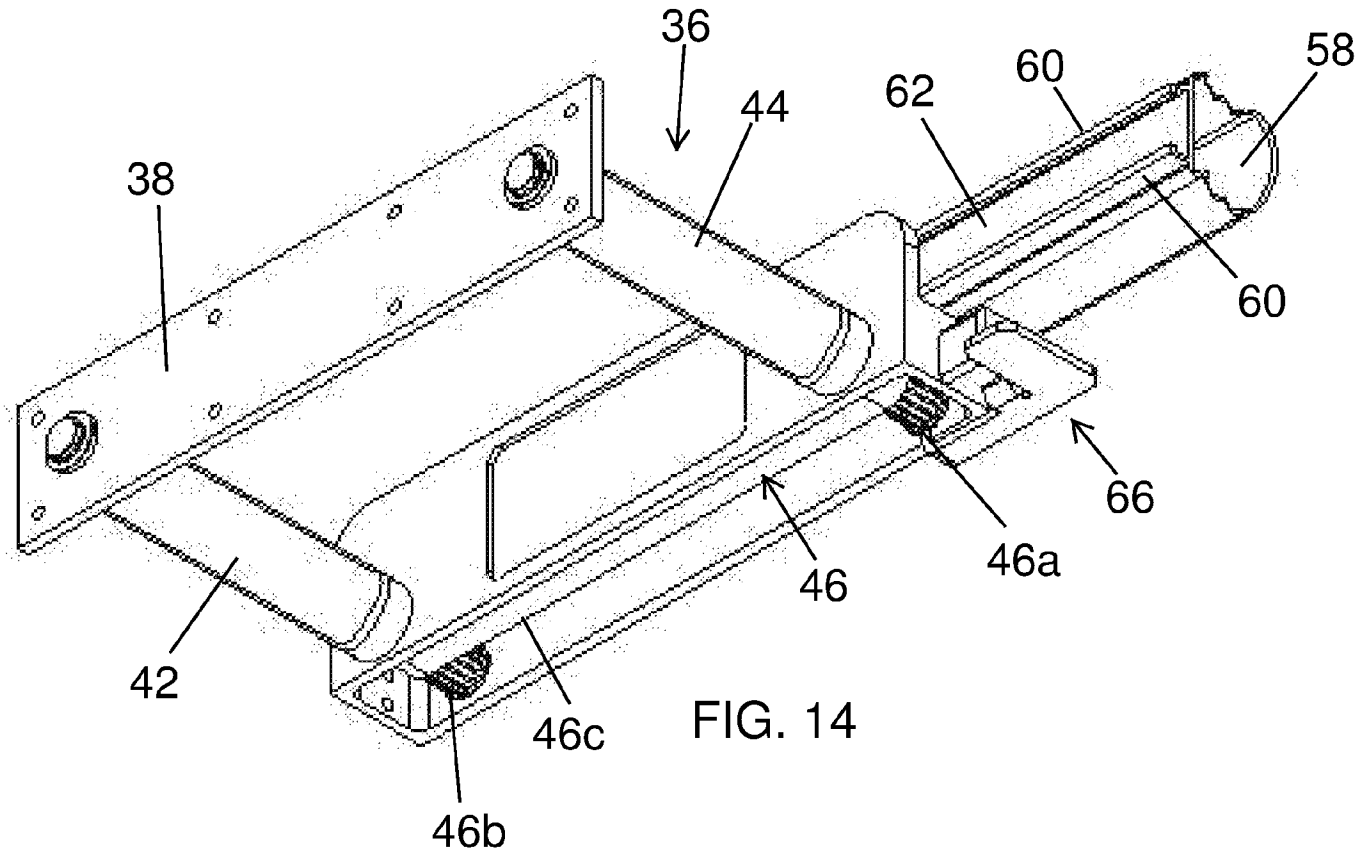
FIG. 14 is a similar view to FIG. 13 with the side rail mounting arms rotated.
Figure 15:
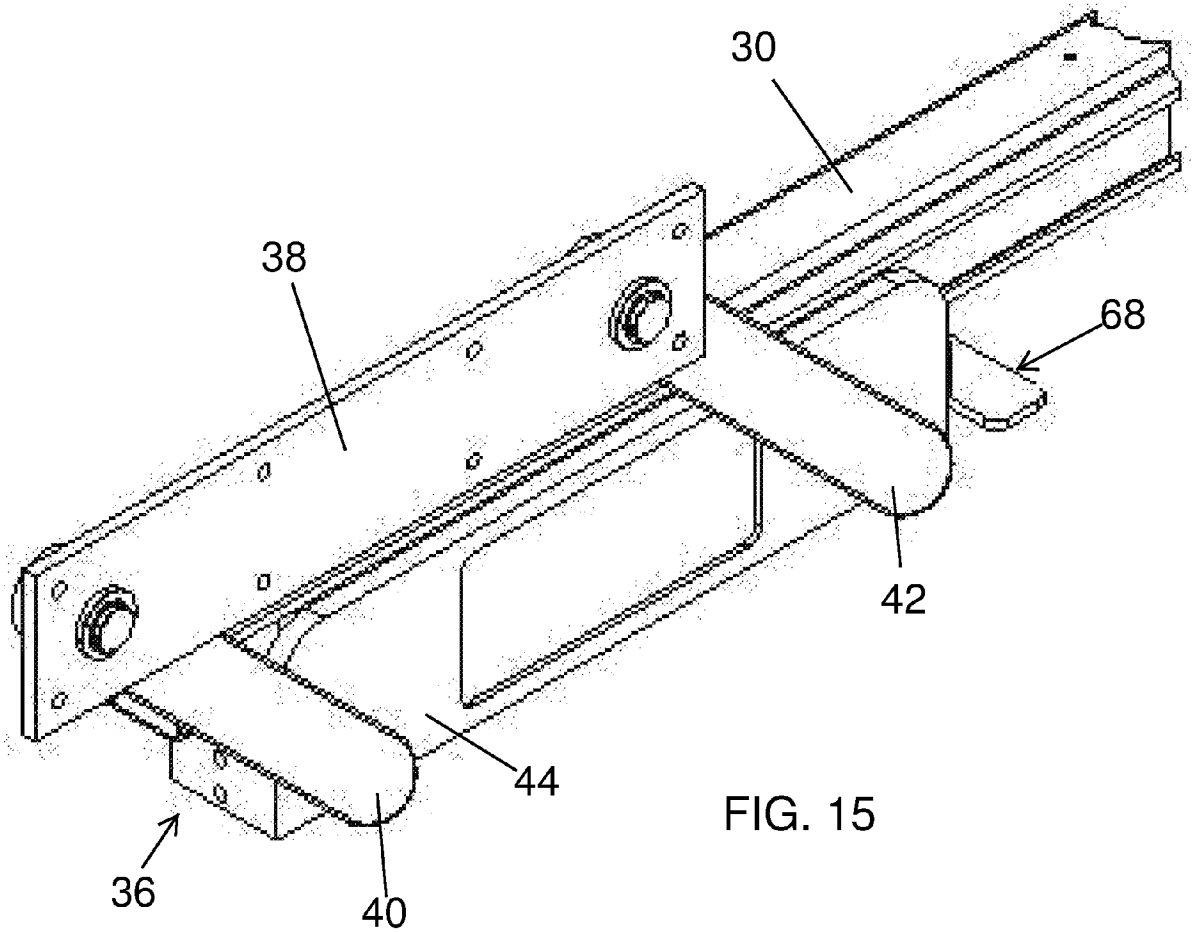
FIG. 15 is a similar view to FIG. 14 illustrating the mounting arms rotated to yet another position.
Figure 16:
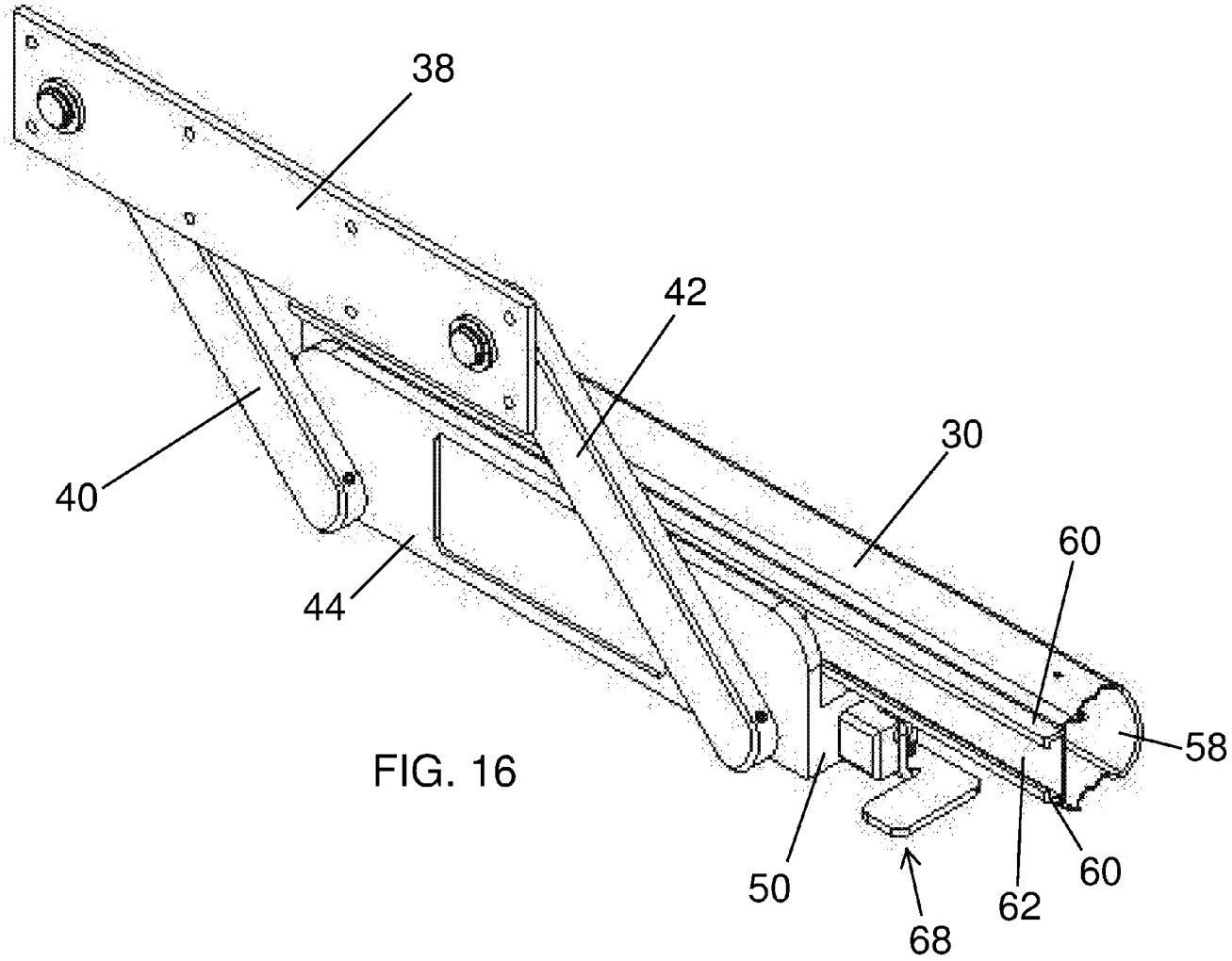
FIG. 16 is another perspective view of the side rail mounting arrangement of FIG. 15.

Referring to FIGS. 1 and 11, each side rail 22 and 24 includes a side rail body 22*a*, 24*a*, which is mounted to a respective mounting mechanism 36 (FIG. 11) by a pair of arms 40 and 42. Arms 40 and 42 are configured to allow the respective side rail bodies 22*a* and 24*a* to be moved between a raised position (e.g. FIG. 1) and a lowered position (e.g. FIG. 4). As best seen in FIG. 11, arms 40 and 42 may mount to the inwardly facing side of the side rail body (22*a* or 24*a*) by a plate 38, which is secured in the respective body 22*a*, 24*a* by fasteners, and optionally may be recessed in the inwardly facing side of the side rail body to provide a flush mounting arrangement. Arms 40 and 42 are arranged as a head-end arm (40) and a foot-end arm (42), which are generally parallel and are rotatably mounted at their respective ends to plate 38, for example, by shafts 40*a*, 40*b* and bearings, 42*a*, 42*b* and rotatably mounted at their opposed ends to a carriage 44 (see FIGS. 11A, 11B, and 14-23). Carriages 44 mount the respective arms to support rails 30 and provide for linear movement of the respective side rail bodies along the support rails 30. Further, carriages 44 may contribute to the ability of support 10 to lower to the "low-bed" height described above.

Figure 19:
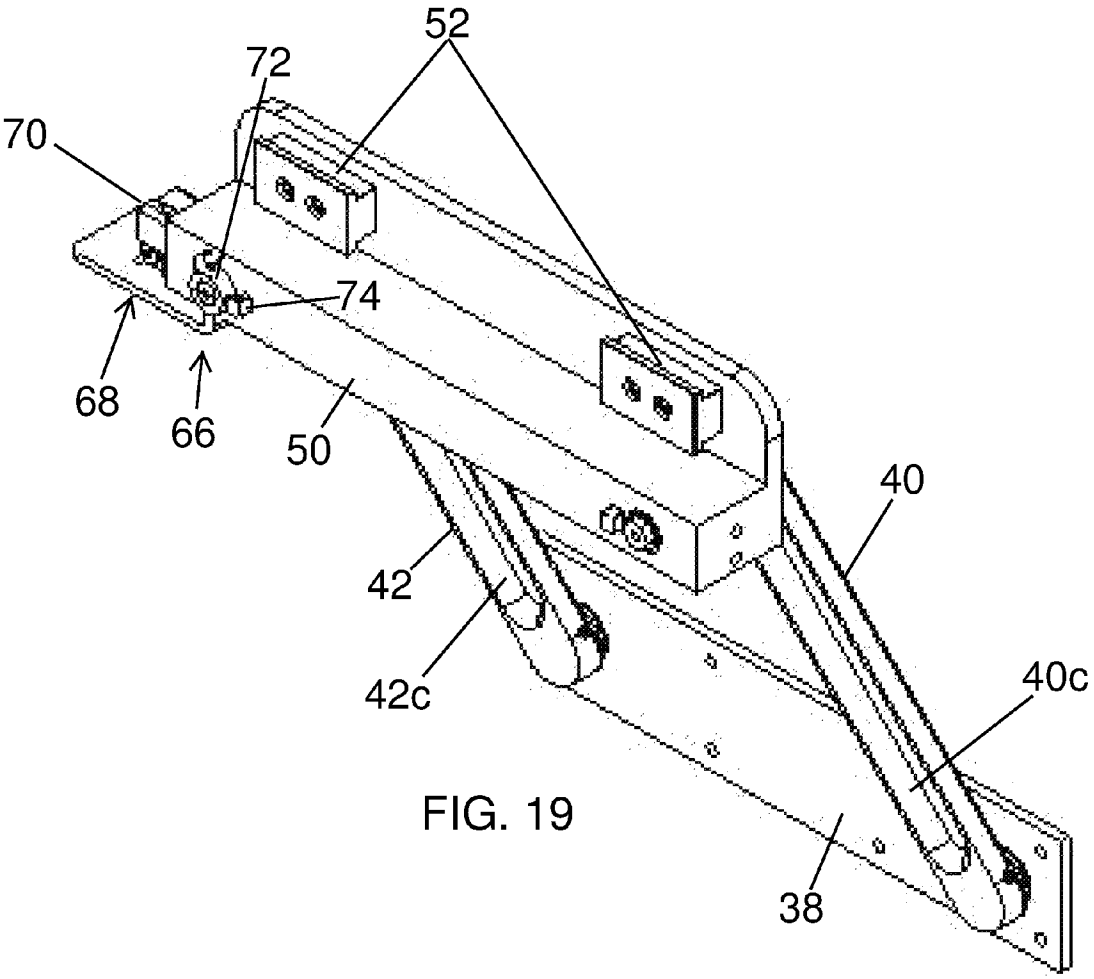
FIG. 19 is an enlarged perspective view of the carriage of the mounting mechanism of the side rail.

Arms 40 and 42 optionally move in unison and are optionally coupled together. For example, as best seen in FIG. 19, the lower end of each arm 40, 42 may be mounted to or formed with a shaft 46*a*, 46*b*, such as a cogged shaft, about which a timing belt 46 extends. In this manner, the rotational movement of the head-end arm is coupled to the foot-end arm by way of the timing belt, which is optionally housed in carriage 44. Carriage 44 includes a generally L-shaped housing 50 that may support not only the arms and belt and cog mechanisms, but also a linear bearing 52 (FIG. 20) for engaging the respective support rails 30.

Figure 17:
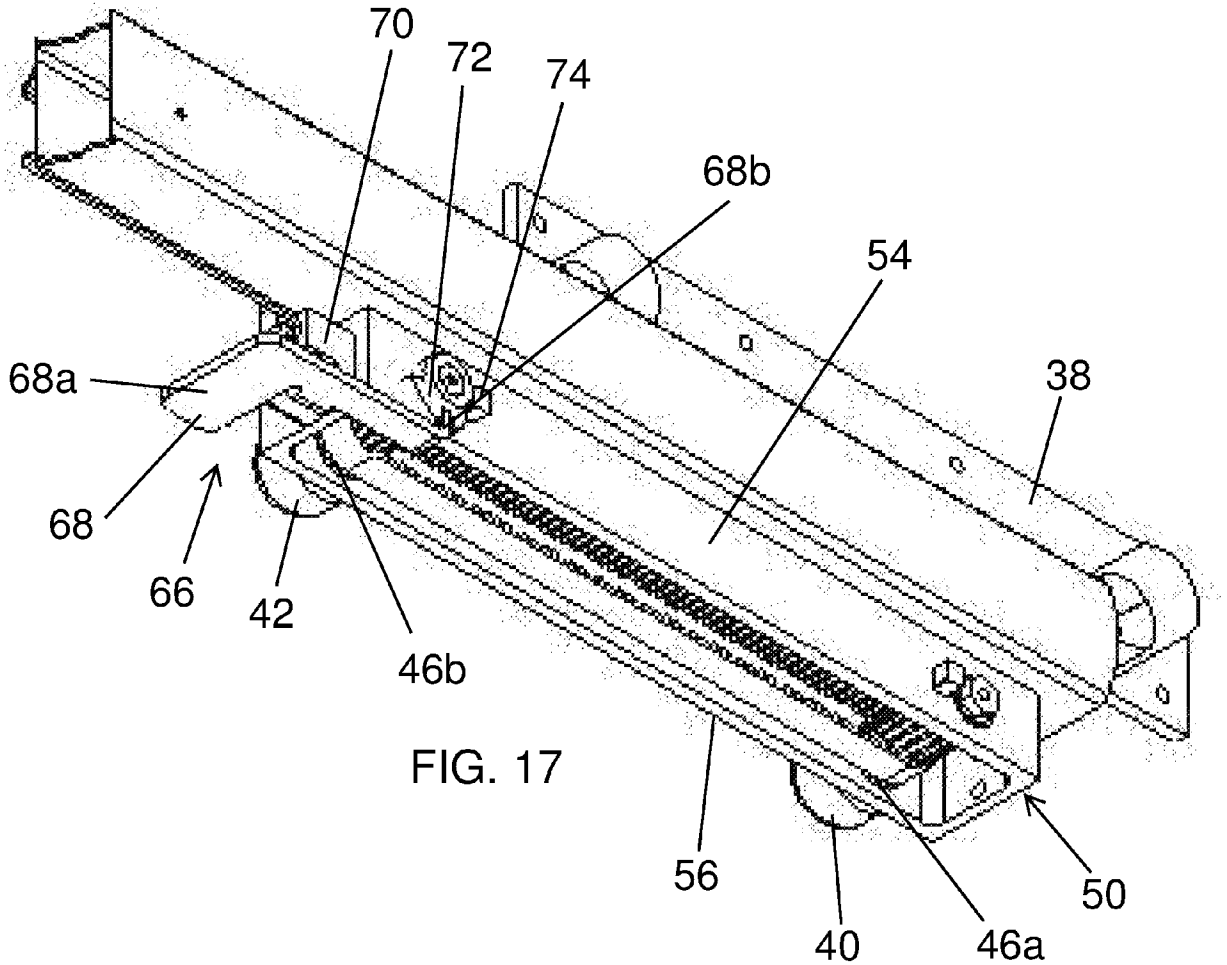
FIG. 17 is a bottom and rear perspective view of side rail mounting mechanism of FIG. 16.
Figure 18:
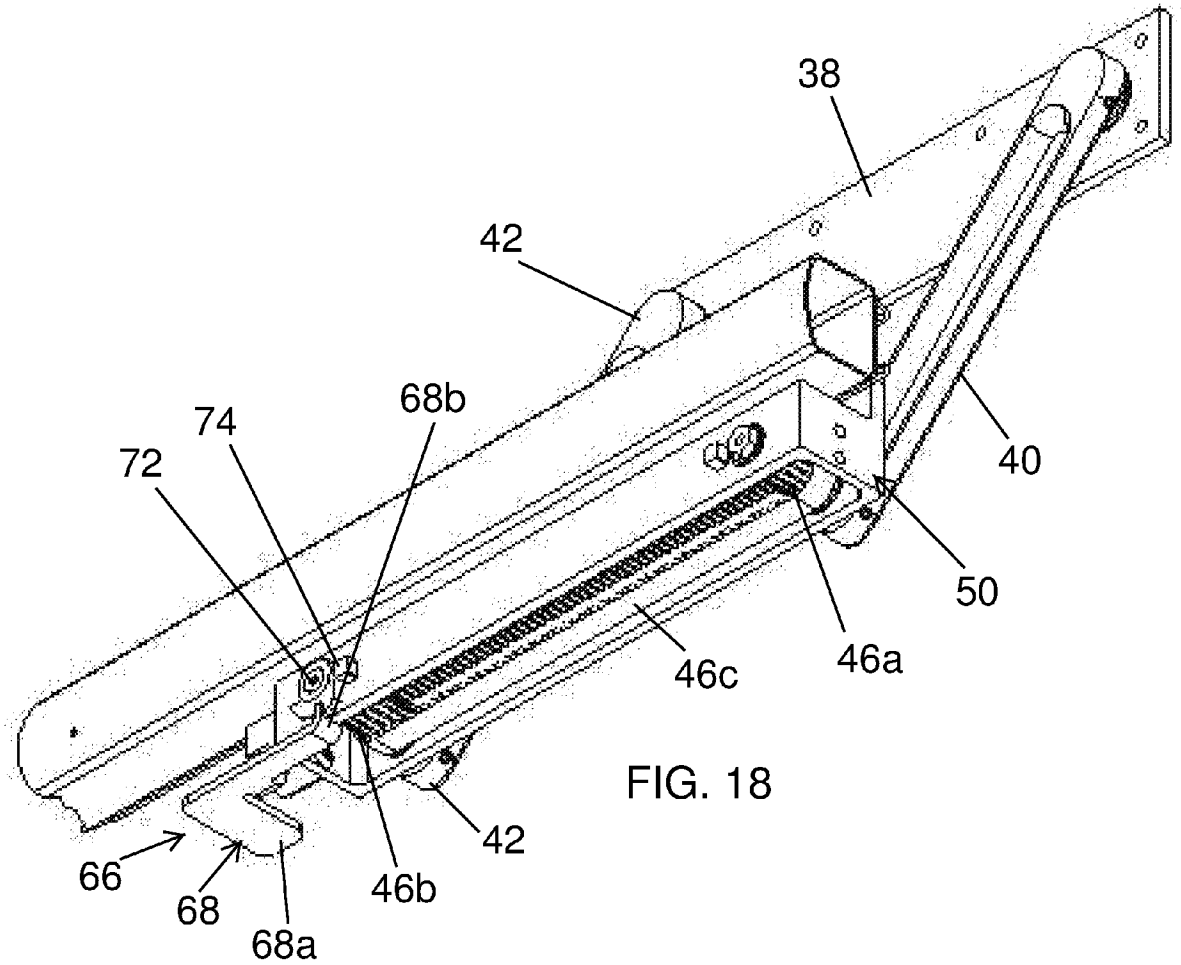
FIG. 18 is another perspective view of the side rail mounting mechanism of FIG. 17.

As best seen in FIG. 17, shafts 46*a*, 46*b* of arms 40 and 42 extend between and are rotatably supported in opposed walls 54 and 56 of housing 50 by bushings or bearings (not shown) supported in or on the inside of walls 54 and 56. In this manner, when the mounting mechanism brake (described below) is released and a side rail is pushed or pulled, arms 40, 42 will rotate in unison about carriage 44 to raise or lower the respective side rail bodies.

For example, as viewed in FIG. 3, when the brake mechanism is released and side rail body 24*a* is pulled toward the foot-end of the patient support, side rail body 24*a* will move from its raised position (as shown in FIG. 3) in a clockwise direction to its lowered position as shown in FIG. 4). In contrast, arms 40 and 42 of the head-end side rail 22 may be configured so that side rail body 22*a* rotates in a counter-clockwise direction when side rail body 22*a* is lowered to its lowered position. In this manner, when frame 12 and deck 14 are lowered to their fully lowered (lowermost) position (e.g. approximately 12 inches from the floor), should side rail bodies 22*a* and 24*a* be in their lowered position and make contact with the floor, any force impact to the side rail bodies will cause the arms to rotate and each side rail body to move upwardly. For example with the illustrated configurations, the foot-end side rail body will move in a counter-clockwise motion, and the head-end side rail body will move with a clockwise motion as viewed in FIG. 2.

Referring again to FIGS. 7, 7A, 8, 11A, and 11B, each support rail 30 may include a closed tubular member 38 and a channel with a pair of upper and lower outwardly projecting flanges 60. Flanges 60 are spaced vertically to form a track 62 along which bearings 52 of carriages 44 may be guided and, further, may be retained therein by the respective lips of flanges 60 to thereby linearly and movably mount side rail carriages 44 to frame 12. In this manner, as noted, side rails 22, 24 are mounted independently of deck 14 and are linearly movable along frame 12.

Figure 20:
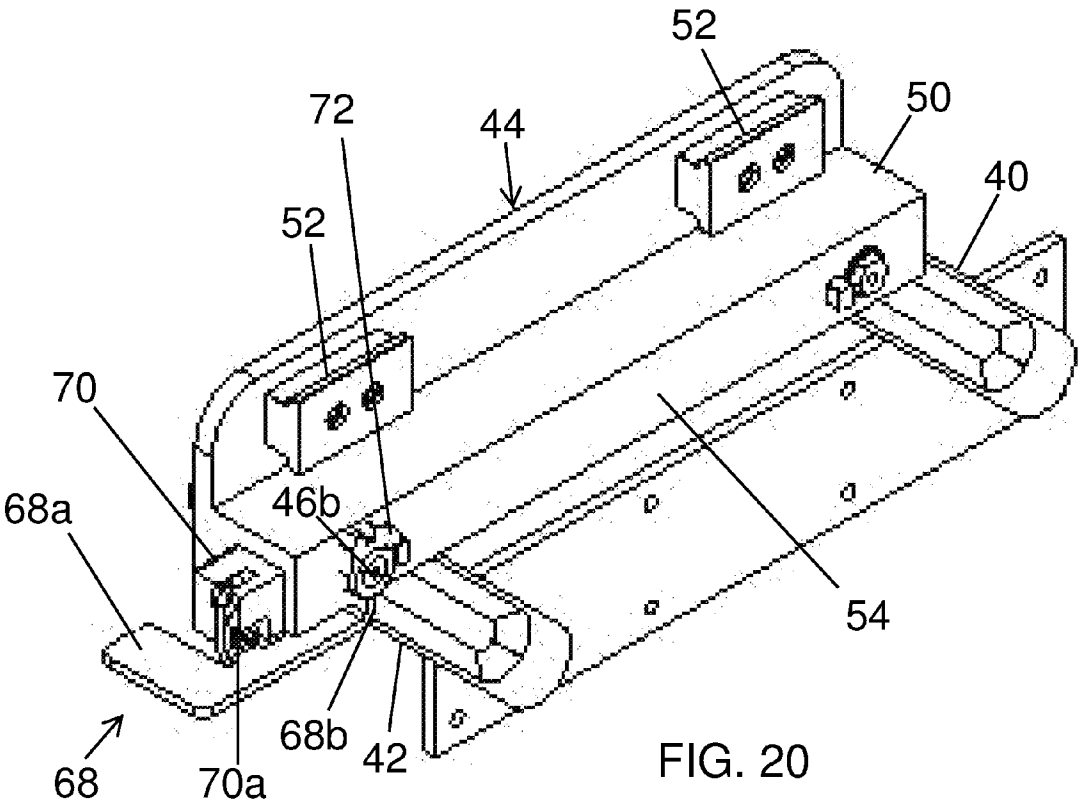
FIG. 20 is a similar view to FIG. 19 illustrating another orientation of the mounting carriage.
Figure 21:
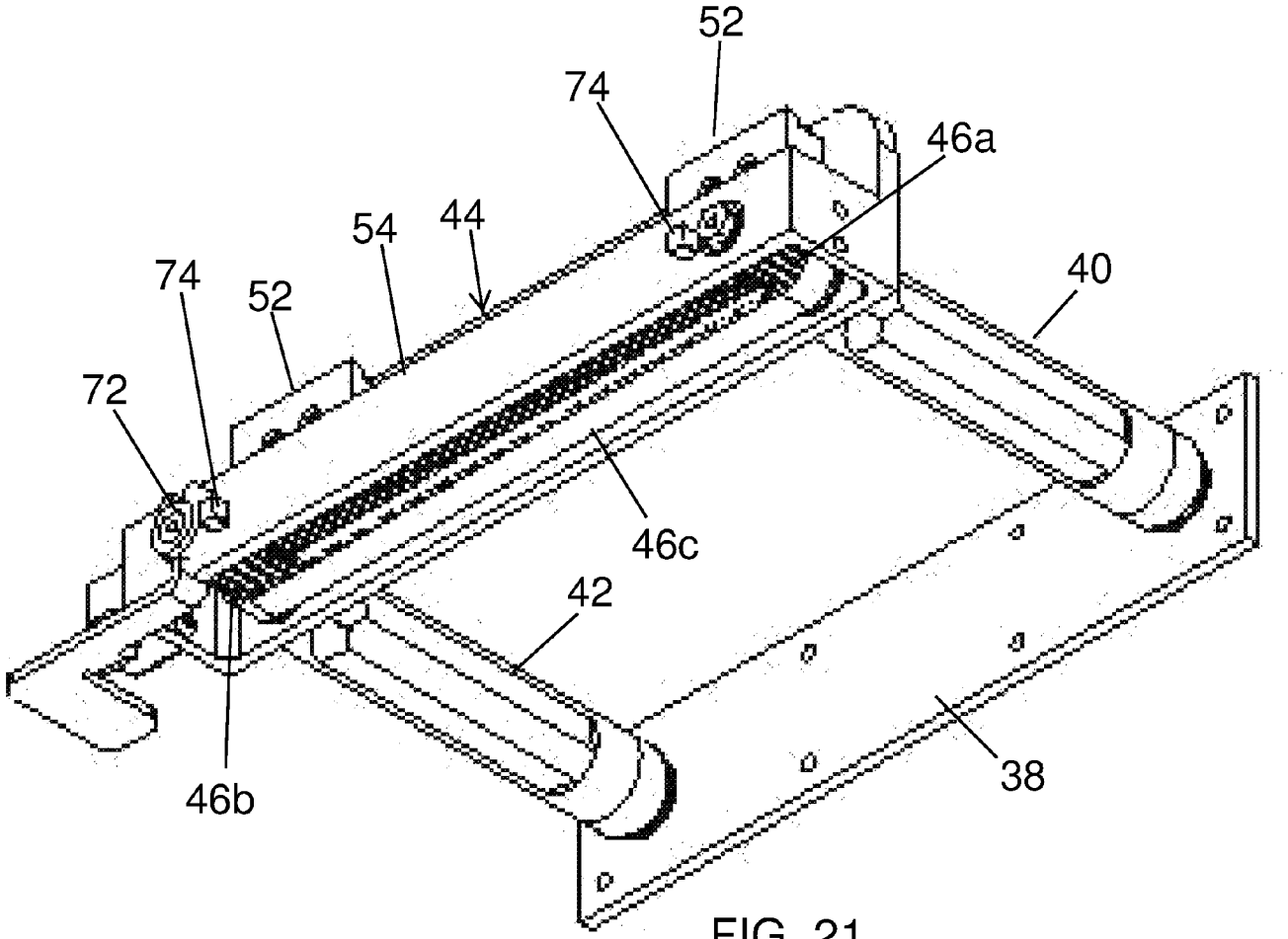
FIG. 21 is a bottom perspective view of the mounting carriage of the side rail mounting mechanism.
Figure 22:
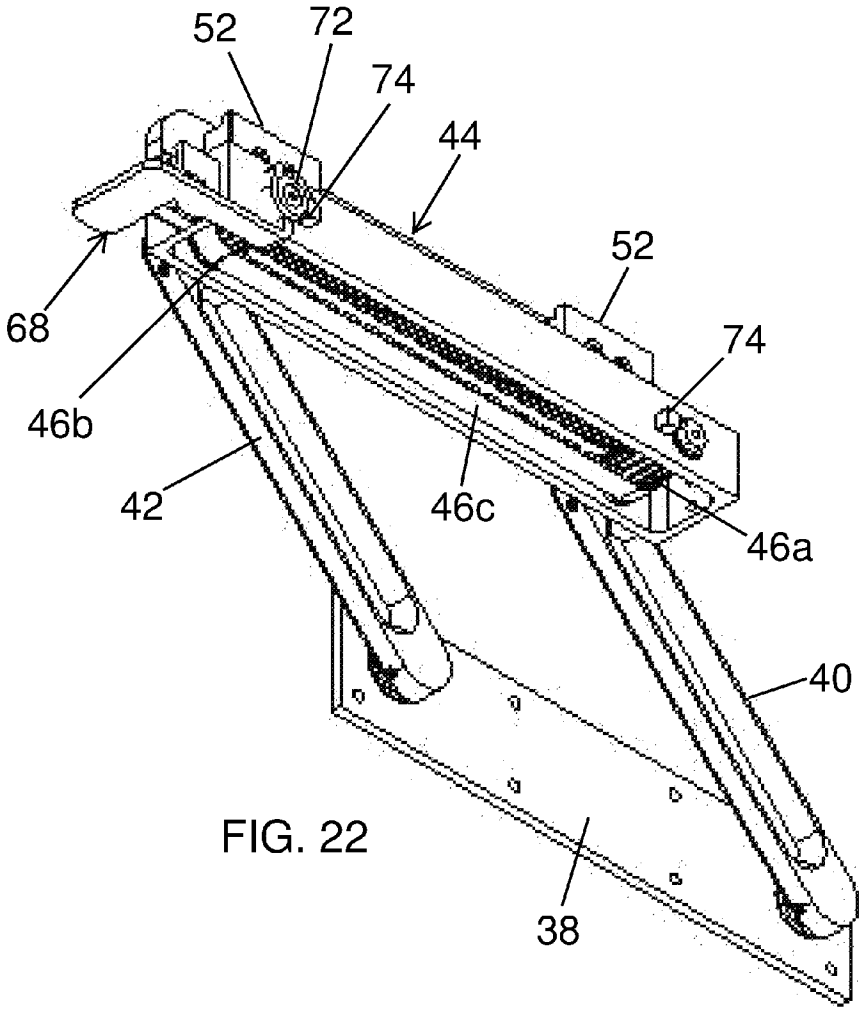
FIG. 22 is yet another bottom perspective view of the mounting carriage of the side rail mounting mechanism.

As noted above, each timing belt and cog assembly 46 includes a locking/release mechanism 66 to thereby lock the position of the respective side rail body in their raised and lowered positions. Locking/release mechanism 66 may comprise a manual locking/release mechanism that allows a caregiver to lock the rotation of the arms to lock the height of the side rail or to unlock or release the arms so that the side rail can be lowered or raised. In the illustrated embodiment, locking/release mechanism 66 includes a lever 68, such as a generally L-shaped lever, which is pivotally mounted to carriage 44 by a mounting block 70 that provides a pivot connection 70*a*. Levers 68 may form a release handle 68*a* on one end and an engagement structure, such as a tang 68*b*, for engaging shaft 46*b*. For example, lever 68 may engage a cam 72 mounted to the cogged shaft (46*b*) of one of the arms (in this case arm 42). Cogged shaft 46*b* is extended through wall 54 of housing 50 so that it can be engaged by lever 68 to thereby limit rotation of cogged shaft 46*b* and in turn cogged shaft 46*a*. Housing wall 54 may also support a stop 74, which engages cam 72 to define the upper raised position of the arms, such as shown in FIGS. 20 and 21. As will be appreciated from FIG. 21, the same carriage 44 can be used for both side rails but reconfigured for a counter-clockwise or clockwise rotation by simply moving cam 72 from one cogged shaft to the other cogged shaft. Thus, side rails 22 and 24 may have no intermediate position but still provide an egress/ingress space. Further, with the present configuration, support 10 may be positioned up against a wall, and the side rails can still be lowered without making contact with or hitting the wall.

As best seen in FIGS. 17 and 19, stops 74 may be provided and located such that when arms 40 and 42 are in their defined raised position or defined lowered position, arms 40 and 42 are angled to form an acute angle with respect to vertical. Further, arms 40, 42 of head-end side rail may be configured to rotate in a counter-clockwise direction through the acute angle when side rail body 22*a* is lowered, and arms 40, 42 of side rail 24 may be configured to rotate in a counter-clockwise direction through the acute angle when side rail 24*a* is lowered (as viewed in FIG. 1). In this manner, arms 40, 42 are configured in a more stable configuration when the side rail bodies are in their fixed raised or lowered positions but provide a greater range of motion that is dictated by their length rather than the distance between the fixed raised or lowered positions.

Optionally, to limit or reduce play that may exist in the various components forming the mounting mechanism, one or both arms optionally support a projecting member (not visible but provided at 344*b* in FIGS. 32, 35), such as a raised ridge or pin, that extends into a corresponding groove or guide (344*a*, shown in FIGS. 32 and 35) formed on their carriage so that the carriage provides lateral support to the arms as they pass by the carriage but then decouple from the carriage once the arms are moved above or below the carriage where the arms together with plate 38 and carriage 44 form a four sided frame that can be more stable.

As noted above, the size, such as the width and/or length, of patient support 10 may be adjusted to suit a patient but may be readjusted as needed to accommodate the passageway through the facility where it is being used. Referring to FIGS. 6 and 6A-6H, support rails 30 are each movably mounted to a respective deck support member 28 so that they can be spaced further away from the deck support members or moved closer to the deck support members. In the illustrated embodiment, rails 30 are mounted to deck support members 28 on a transverse tube 78*a* that is supported by and extends between deck support members 28 and on cantilevered tubes 78*b*, which are mounted to the outwardly facing sides of members 28. Rails 30 are mounted to transverse tube 78*a* and cantilevered tubes 78*b* by sleeves 30*b*, which allow rails 30 to translate along the respective tubes and, therefore, move relative to members 28. Tubes 78*a* and 78*b* therefore provide guides upon which support rails 30 are moved to expand or contract the width of the patient support frame. As will be more fully described below, transverse tube 78*a* may also provide a mount for lift mechanism 20.

Each support rail 30 may be moved along the respective tubes 78*a* and 78*b* by linkage assemblies 80. Linkage assemblies 80 may be configured to move support rails 30 laterally outward or inward relative to deck supports 28 in response to input from one or more drivers 80*a*, described more fully below. As best seen in FIG. 6C, linkage assemblies 80 each include a pair of links 82 (upper and lower), which are pinned on one end to the respective sleeve 30*b* (FIGS. 6C and 6D). Each sleeve 30*b* in turn is mounted to a respective support rail 30 by a mounting plate 84, which is fastened, such as by bolts or rivets or the like, to the support rail. The opposed end of each link 82 is pinned to a generally U-shaped bracket 86 (FIGS. 6A and 6F), which is movably mounted to the outwardly facing side of deck support member 28. Bracket 86 is guided along deck support member 28 by a pair of opposed tracks 88, formed for example by channel-shaped members, which may be respectively mounted to the outwardly facing side of the deck support member 28. Bracket 86 may then be coupled to driver 80*a*, which linearly moves bracket 86 along deck support member 28 to thereby cause link 82 to pull or push on support rail 30 and thereby move rail in or out relative to deck support member 28.

Drivers 80*a* may comprise mechanical drivers, electric drivers, and/or pneumatic drivers. In the illustrated embodiment, each driver 80*a* comprises a mechanical driver and may include a threaded rod, which is coupled to respective bracket 86 by an internally threaded collar 86*a*. Additionally, in the illustrated embodiment, the rods may be supported and mounted to the inwardly facing sides of deck support members 28 adjacent slotted openings 28*a* and 28*b* (FIG. 7), through which collars 86*a* are extended to couple brackets 86 to the drivers 80*a* (rods). In this manner, when the threaded rods are rotated, their rotation is translated by collars 86*a* into linear motion of brackets 86, which in turn push or pull on the respective sleeves 30*b* to thereby move support rails 30 towards or away from deck support members 28.

Rotation of the threaded rods may be achieved mechanically or may be powered. In the illustrated embodiment, a manual mechanical crank assembly 90 is provided at the foot-end of the bed. Referring to FIGS. 6A, 6G-6I, crank assembly 90 may include a rotary member 92 with a crank arm or handle 94 (FIG. 6E), which is optionally pivotally mounted to rotary member 92 so that it can be moved between an operative position (such as shown in FIG. 6E) and a stowed position. Rotary member 92, which is mounted in a central panel or wall 96 of footboard 98, includes a drive shaft 100 that drives a driven gear 102, which is mounted in the base portion 98*a* of footboard 98, by way of a belt (such as a cogged belt, timing belt) or chain 104. Gear 102 in turn includes a drive shaft 106 that supports a driver gear 108 for driving the respective rods 80*a* by way of a closed loop belt or chain 108*a* that extends around gears 110 mounted to the foot-ends of the rod. An optional belt or chain tensioner 112 (FIG. 6G) may also be provided to allow for adjustment to the tension on the belt or chain 108*a*. Thus, when handle 94 is unfolded and rotated, the rods can be driven, which in turn moves rails 30 toward or away from deck support members 28.

The threaded rods are supported at least at their ends by brackets 114 (FIG. 6G) mounted to deck support member 28, which also mounts foot-end plate 116 (FIGS. 6E and 6G) to deck support members 28, which protects a caregiver's hands from the gearing and also protects the gearing from intrusion from, for example, a mattress sheet or other articles that may be used or placed near the foot-end of support 10.

Figure 7:
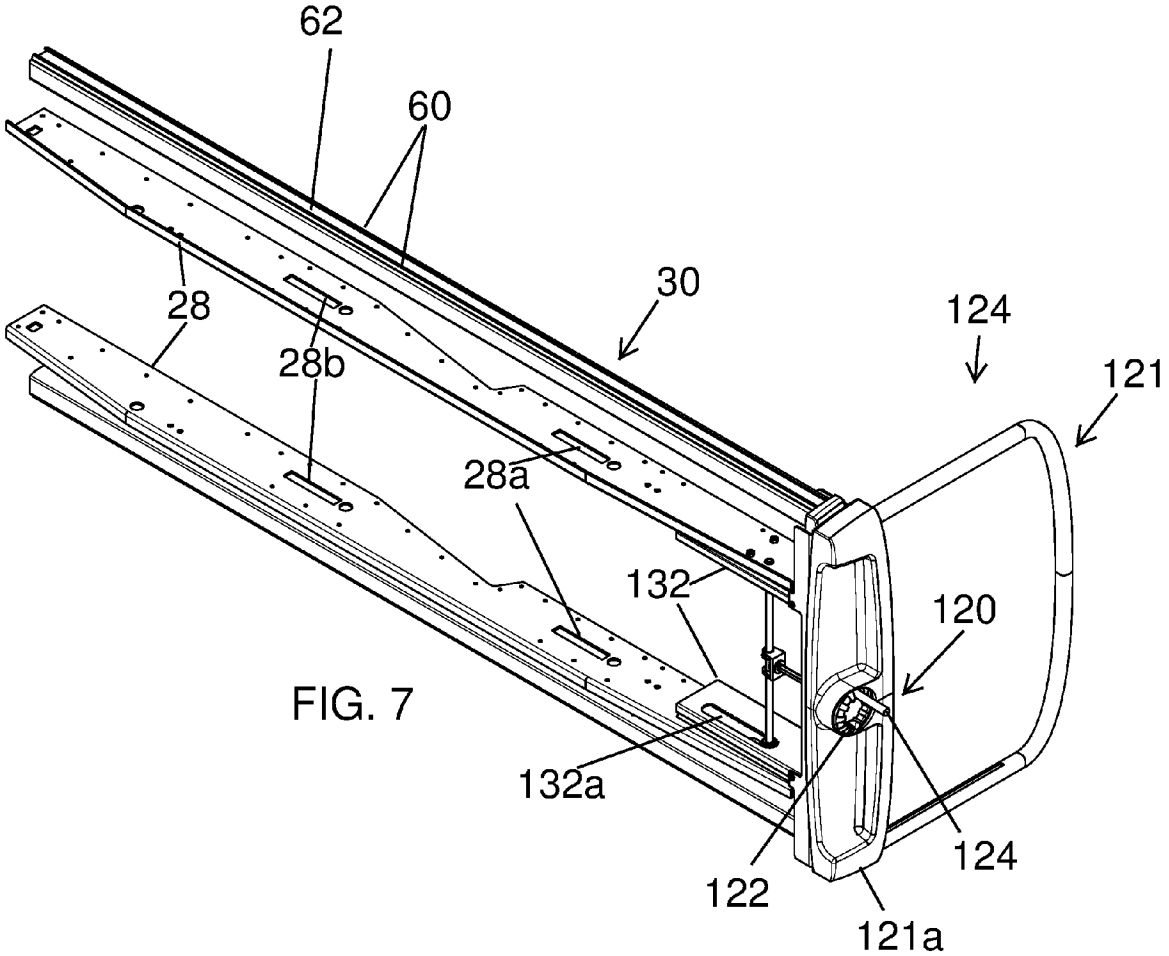
FIG. 7 is a bottom perspective view of the frame of FIG. 6 from the head-end of the patient support with the footboard removed for clarity.
Figure 7A:
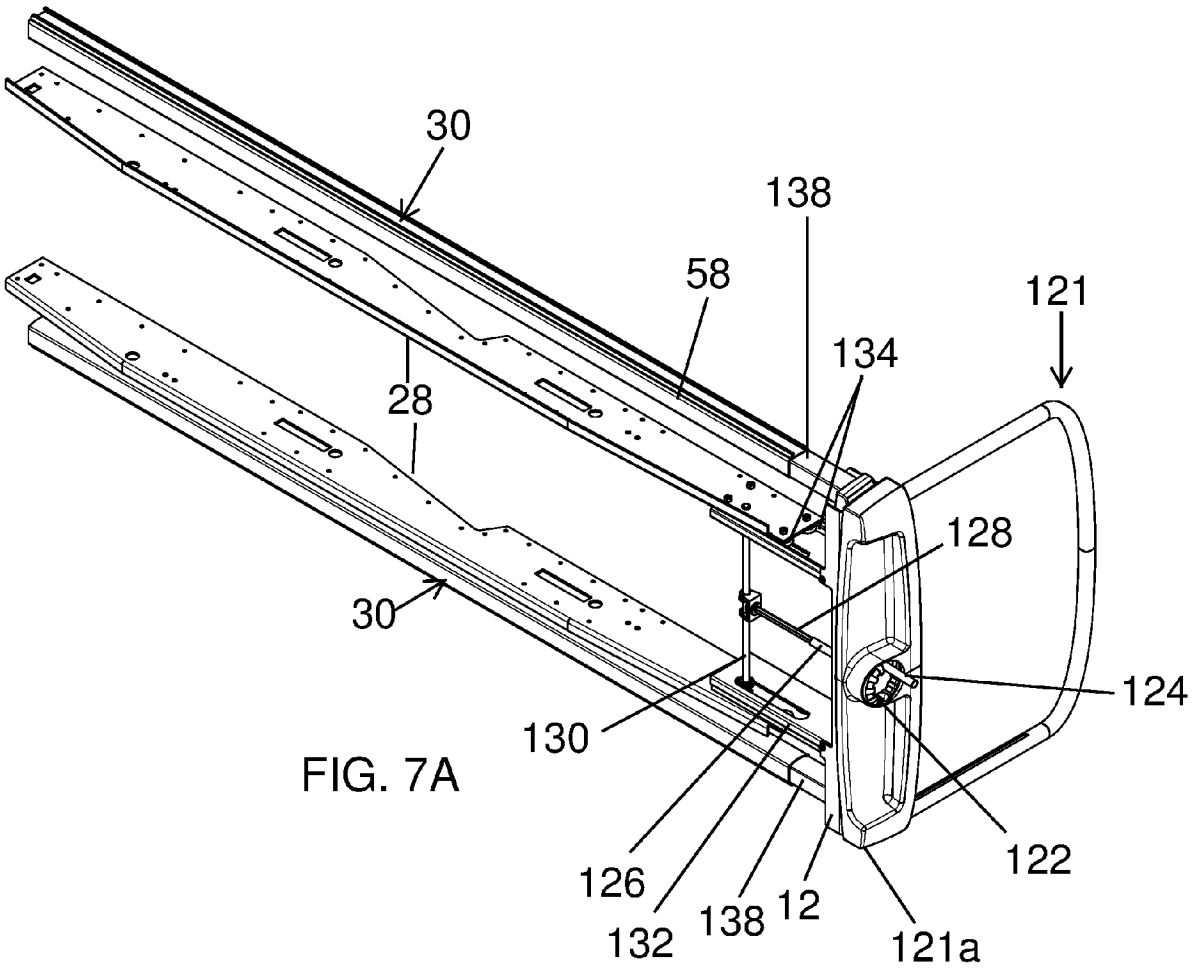
FIG. 7A is a similar view to FIG. 7 illustrating the frame in an extended configuration.
Figure 8:
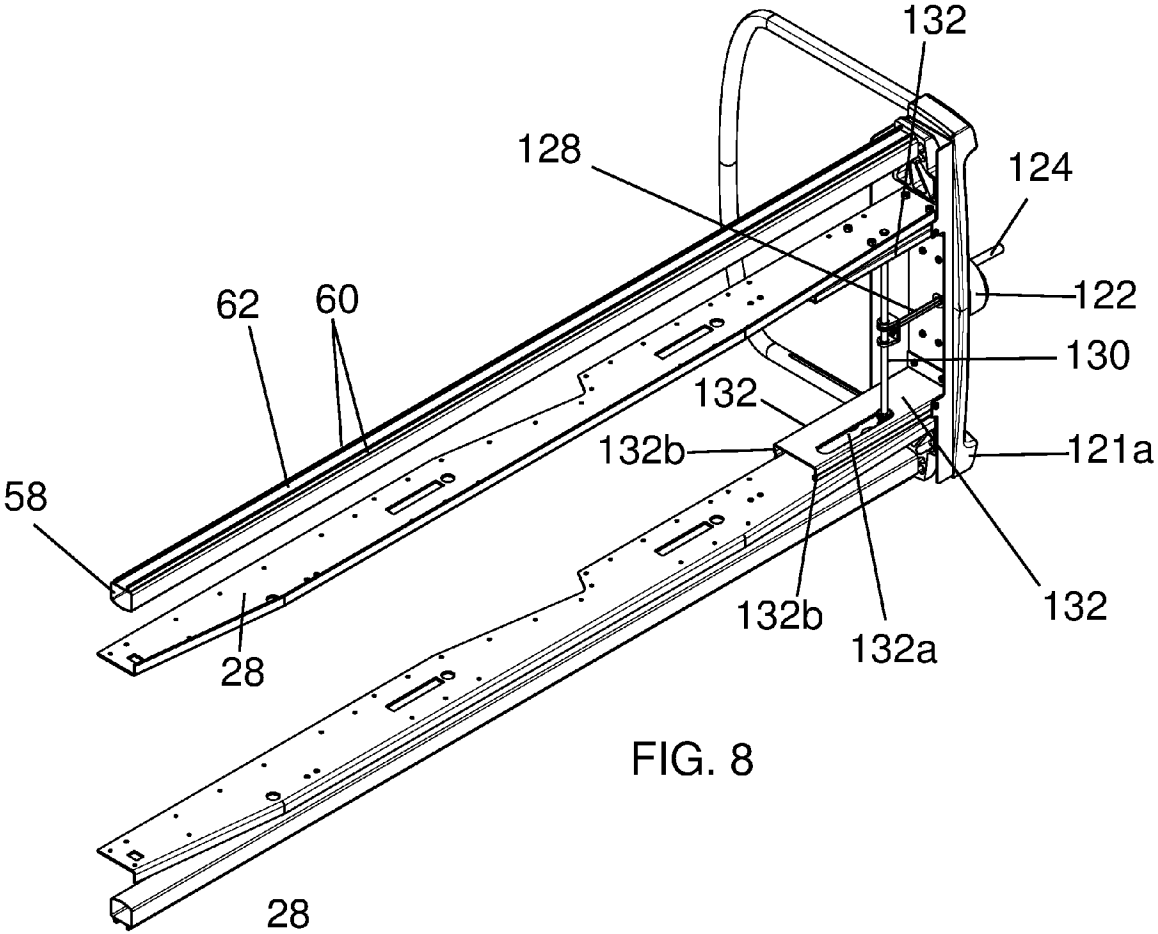
FIG. 8 is another perspective view of the bottom of the patient support frame viewed from the foot-end of the frame.
Figure 9:
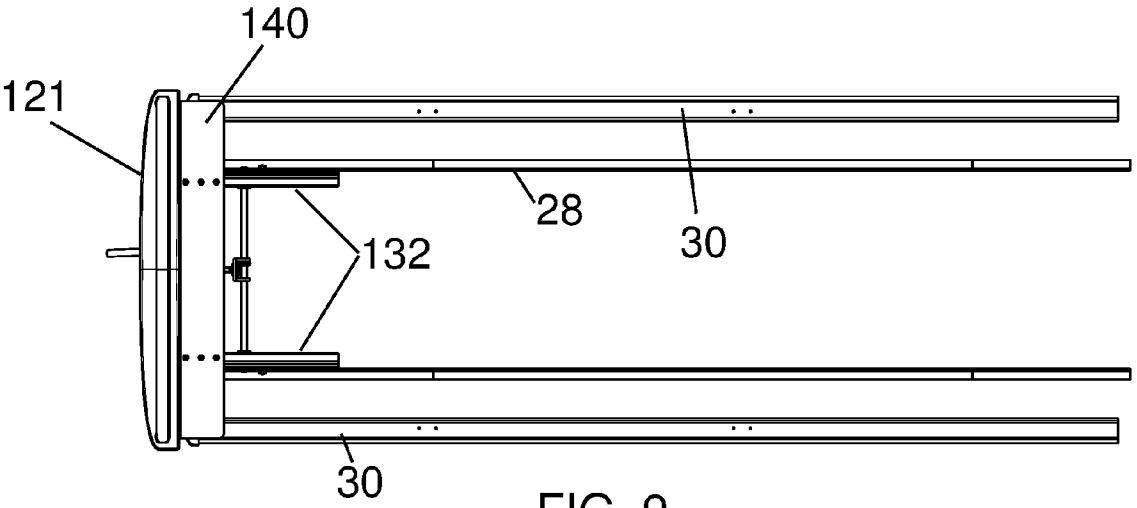
FIG. 9 is a top plan view of the frame of FIG. 8.
Figure 10:
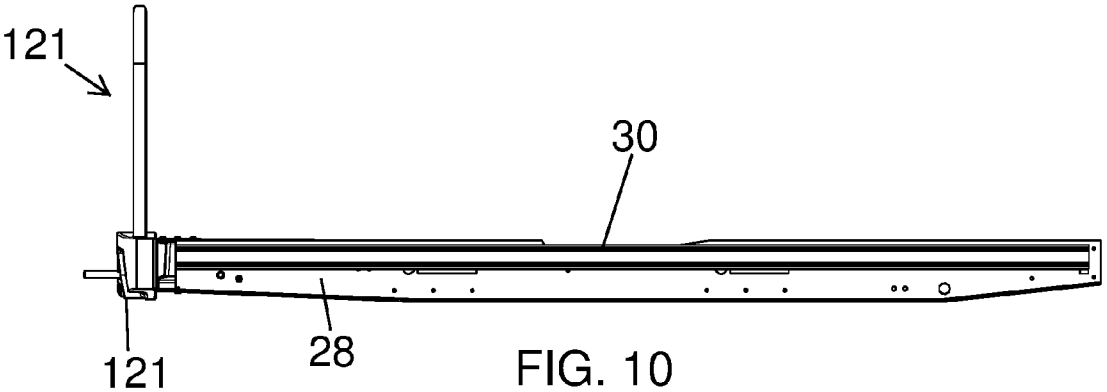
FIG. 10 is a side elevation view of the frame of FIG. 9.

As noted above, the length of support 10 may also be adjusted, for example by increasing or decreasing the length of frame 12. Referring to FIG. 7, a drive mechanism in the form of a manual crank assembly 120 may be mounted at the head-end of the bed, for example, in the base 121*a* of headboard 121. Crank assembly 120, similar to crank assembly 90, includes a rotating member 122 with a crank arm or handle 124, optionally pivotally mounted to the rotating member. Rotating member 122 includes an internally threaded shaft 126 (FIG. 7A) that extends into the support 10 between deck support members 28 to receive a threaded rod 128. Threaded rod 128 is mounted to a transverse rod 130 that is mounted to deck support members 28. Alternatively, parts 126 and 128 may be formed by a splined shaft or other slip joint, with shaft 128 then driving a set of meter gears attached to shaft 130, which optionally has a pinion affixed to each of its ends. The pinions then engage each part 132, which cause the head end to move in or out. With this method, each slide moves by applying a force very near to and in line with each sliding member, which could reduce or minimize jamming or misalignment.

Rod 130 guides deck support members 28 relative to a pair of brackets 132, such as channel-shaped brackets, which are mounted to base 121*a* of headboard 121. Each bracket 132 includes a slotted opening 132*a* through which rod 130 passes to mount to deck support members 28 and further along which rod 130 is guided when moved by crank assembly 120. To further assist in guiding deck support members 28 along brackets 132, deck support members 28 may each include one or more bearings 134 (FIGS. 6 and 6A), such as wheels, rollers, or the like, to engage the respective flanges 132*b* (FIG. 8) of brackets 132. Rails 30 may also lengthen or contract along with deck support members and are mounted to headboard over tubular members 138, which are secured to headboard base 121*a* to form a telescoping arrangement with rails 30. In this manner, when crank arm 124 is rotated, rod 130 is pushed or pulled to thereby move frame 12 away or toward the headboard to lengthen or shorten patient support 10.

Brackets 132 similarly provide a mounting surface for a head-end plate 140 (FIG. 9), which again protects a caregiver from the drive mechanism, and protect the drive mechanism from intrusion from or entanglement from the mattress sheet or other components used or mounted at the head-end of support 10.

Referring to FIGS. 1, 2, 3, and 23-26, base 18 of support 10 may include a plurality of casters 142, to facilitate movement of the patient support, and lift mechanism 20. Lift mechanism 20 supports frame 12 on base 18 and further includes a driver, more fully described below, to selectively raise or lower frame 12 relative to base 18. As best seen in FIG. 2, lift mechanism 20 may include a folding frame formed by a pair of X-frames 144, which are optionally mounted together by a transverse rod 146 (FIG. 25), to which each leg of the X-frame is pivotally mounted so that the X-frames (144) can fold downwardly to lower frame 12 or fold upwardly to raise frame 12.

Figure 25:
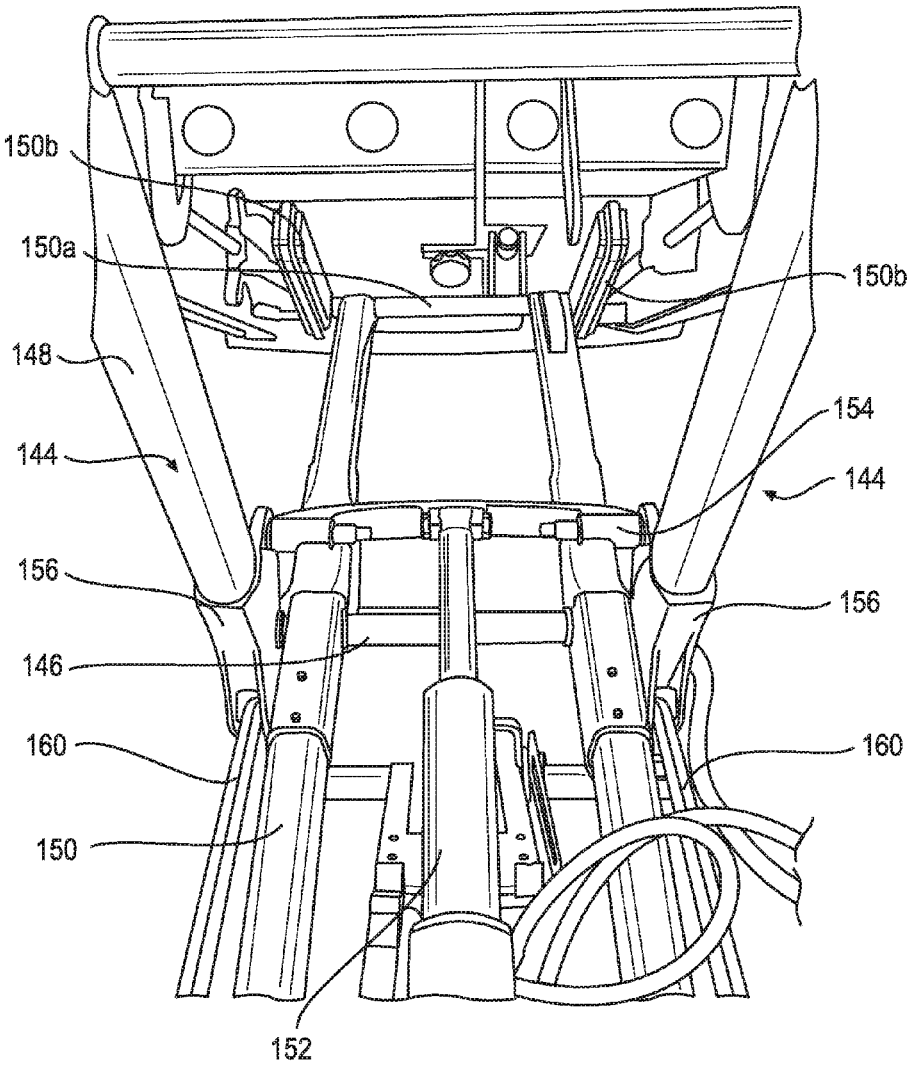
FIG. 25 is an elevation view of the lifting mechanism from the head-end of the patient support.
Figure 26:
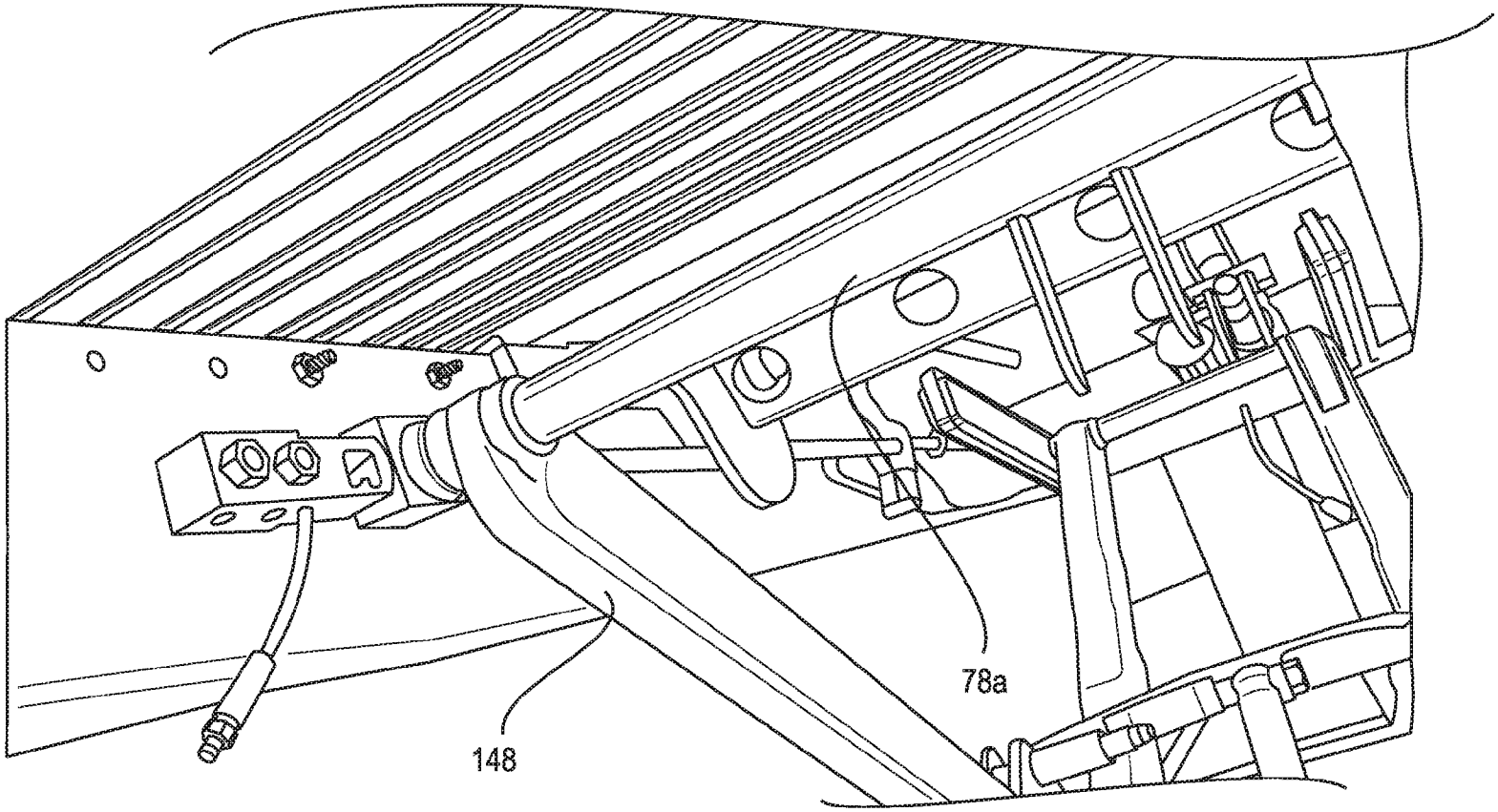
FIG. 26 is an enlarged perspective view illustrating the mounting arrangement of the lift mechanism to the patient support frame.

Each X-frame 144 may be formed from two telescoping, extendable legs 148 and 150. The upper ends of legs 148 may be pivotally mounted to transverse tube 78*a*, with their lower ends mounted to base 18. For example, as shown in FIG. 26, the upper ends of legs 148 may each have a bore through which tube 78*a* extends. Upper ends of legs 150 may be joined by a transverse bar 150*a* (FIG. 25), which extends on both its free ends into a pair of guides or tracks 150*b*, which allows the upper ends of legs 150 to pivot and translate, for example when X-frames 144 are being folded. In this manner, when X-frames 144 are pivoted, X-frames 144 can extend and lengthen when pivoted in one direction about transverse rod 146 and contract and shorten when pivoted in the opposed direction about transverse rod 146, which allows lifting mechanism 20 to assume a compact arrangement beneath frame 12. With this compact arrangement and the reduced thickness of mattress 16 (as more fully described below), support 10 can be lowered where the upper surface of mattress 16 is less than 18 inches and as low as about 12 inches above the floor.

To affect raising or lowering of frame 12, support 10 may incorporate X-frames 144 which are coupled to one or more actuators 152, such as a hydraulic cylinder or an electric actuator (or mechanical actuators) to thereby raise or lower frame 12 relative to base 18. As best understood from FIG. 2, actuator 152 is pinned on one end to base 18 and pinned on its opposed end to a transverse bar 154 (FIG. 25) that extends between the upper telescoping member 148*a* of the respective legs 148. As best seen in FIG. 25, bar 154 is mounted to upper telescoping members 148*a* by brackets 156, which offset bar 154 from transverse rod 146 so that extension or contraction of actuator 152 will impart rotation of legs 148 and 150 about transverse rod 146. While only a single actuator is shown, it should be understood that two or more actuators may be used, for example, in parallel.

Figure 23:
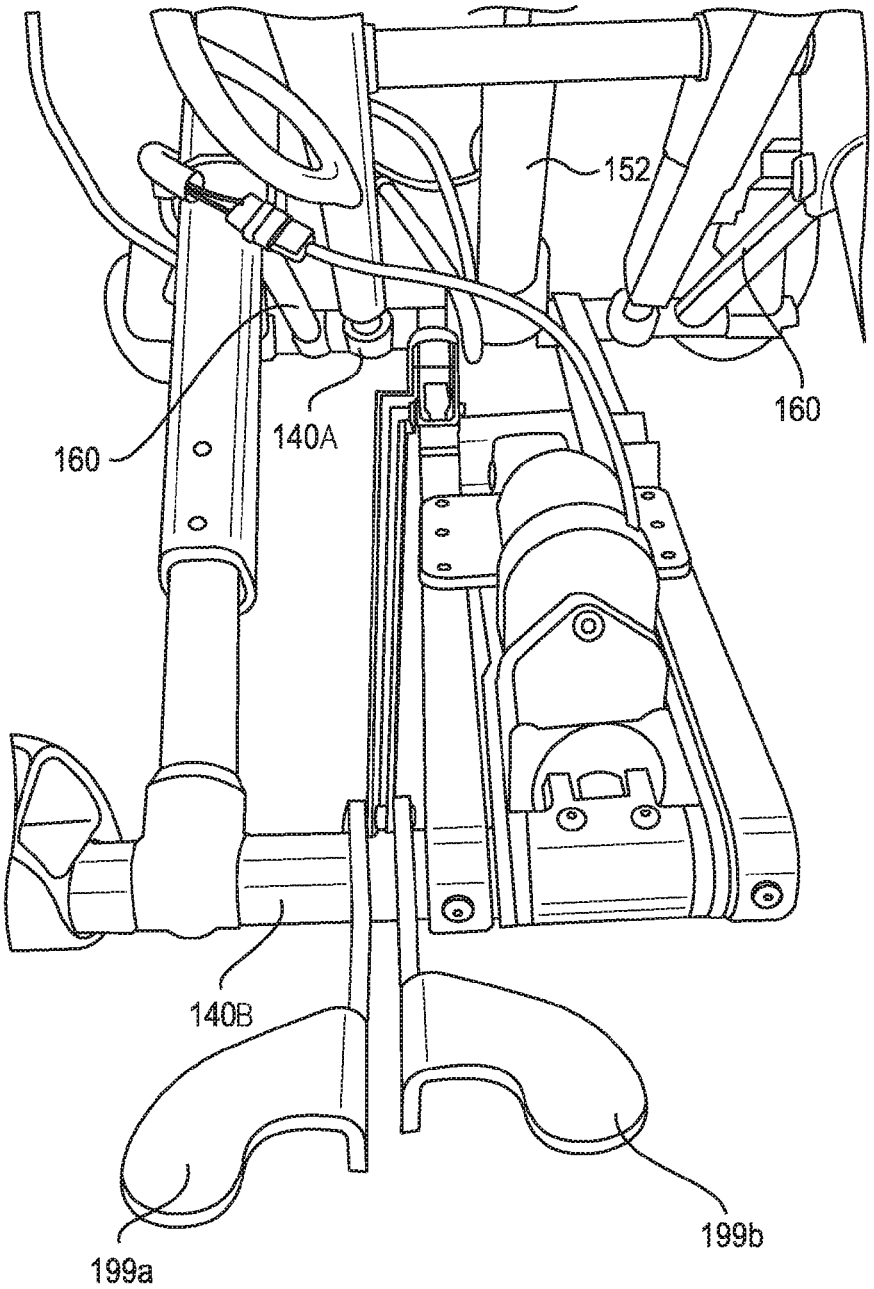
FIG. 23 is a foot-end perspective view of the base of the patient support illustrating the foot pedals and the fifth wheel driving mechanism.

Optionally, as shown in FIGS. 23 and 25, lift mechanism 20 may also include a pair of linkages 160, which are also pinned at one end to brackets 156 (e.g. offset from bar 154 and rod 146) and pinned at their opposed ends to base 18. For example, base 18 may be formed from a tubular member frame with round tubular members 140*a*, 140*b* at the respective head and foot ends, with each of the pinned ends of the actuator 152 and linkages 160 having a bore through which a respective tubular member 140*a* or 140*b* of base 18 extends to facilitate the pivotal connection of the actuator(s) and the linkages to the base. For further optional details of the X-frame, actuators and linkages, reference is made to U.S. Pat. No. 7,398,571, which is commonly owned by Stryker Corporation, and which is incorporated by reference in its entirety herein.

Figure 29:
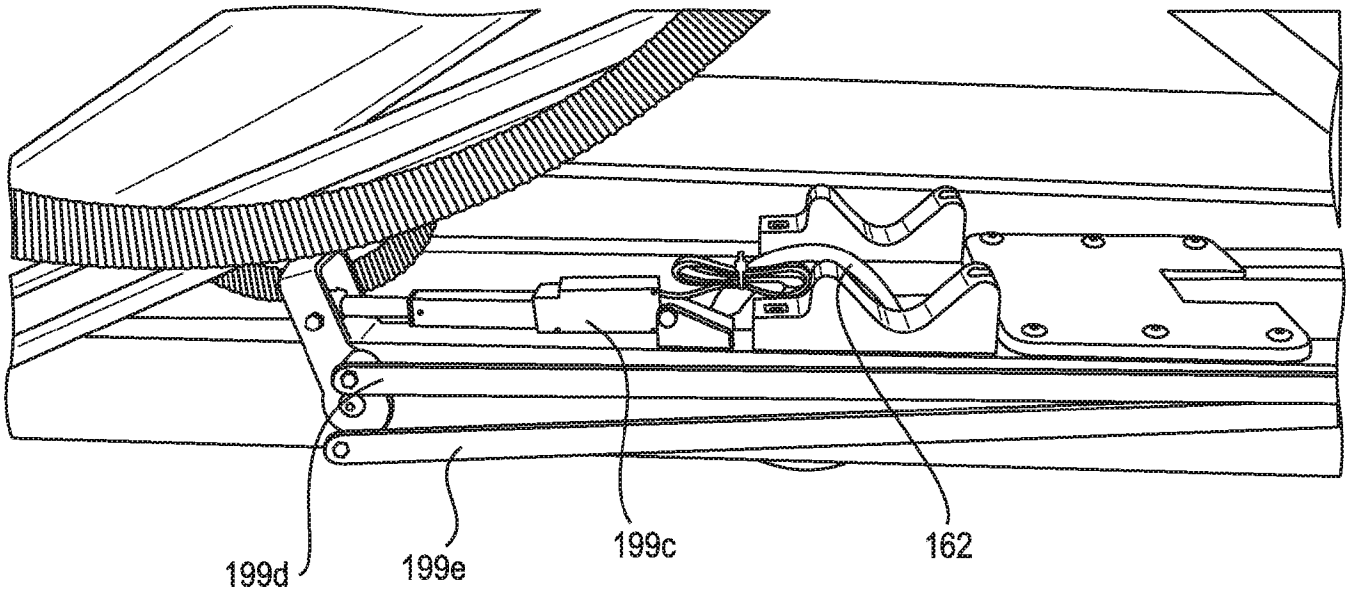
FIG. 29 is another perspective view of the base of the patient support illustrating the bumper/stop mechanism and brake actuator mechanism.

Base 18 also optionally supports a drive wheel 162 (FIG. 29). Drive wheel 162 may be movably supported on base 18 so that the wheel can move between a raised position and lowered, floor engaging position for driving support 10 across a floor. For example wheel 162 may be mounted to base 18 on a pair of bars. Wheel 162 is moved between its raised and lowered positions by a wedge or ramp, which may be mechanically or electromechanically driven by an actuator, such as a mechanical or electromechanical actuator. In the illustrated embodiment, wheel 162 is then driven by a motor 164 (FIG. 24) for selectively moving patient support 10.

Referring again to FIGS. 3, 4, 27, and 28, as noted above, deck 14 of patient support 10 may be formed from a flexible deck section or a plurality of deck sections, including head-end deck section 14*a*, seat deck section 14*b*, and foot-end deck section 14*c*. In addition, the deck may have a flexible "skin" or support surface. In the illustrated embodiment, each of the deck sections 14*a*, 14*b* and 14*c* includes a frame 170, such as a tubular member frame formed from welded tubular members, which support a flexible and stretchy "skin" or surface. In the illustrated embodiment, frame 170 supports one or more transverse elastic strands or chords 172 that form the "skin" or support surface of each deck section. As such the deck skin is radiolucent and can accommodate mobile X-ray machines.

Figure 27:
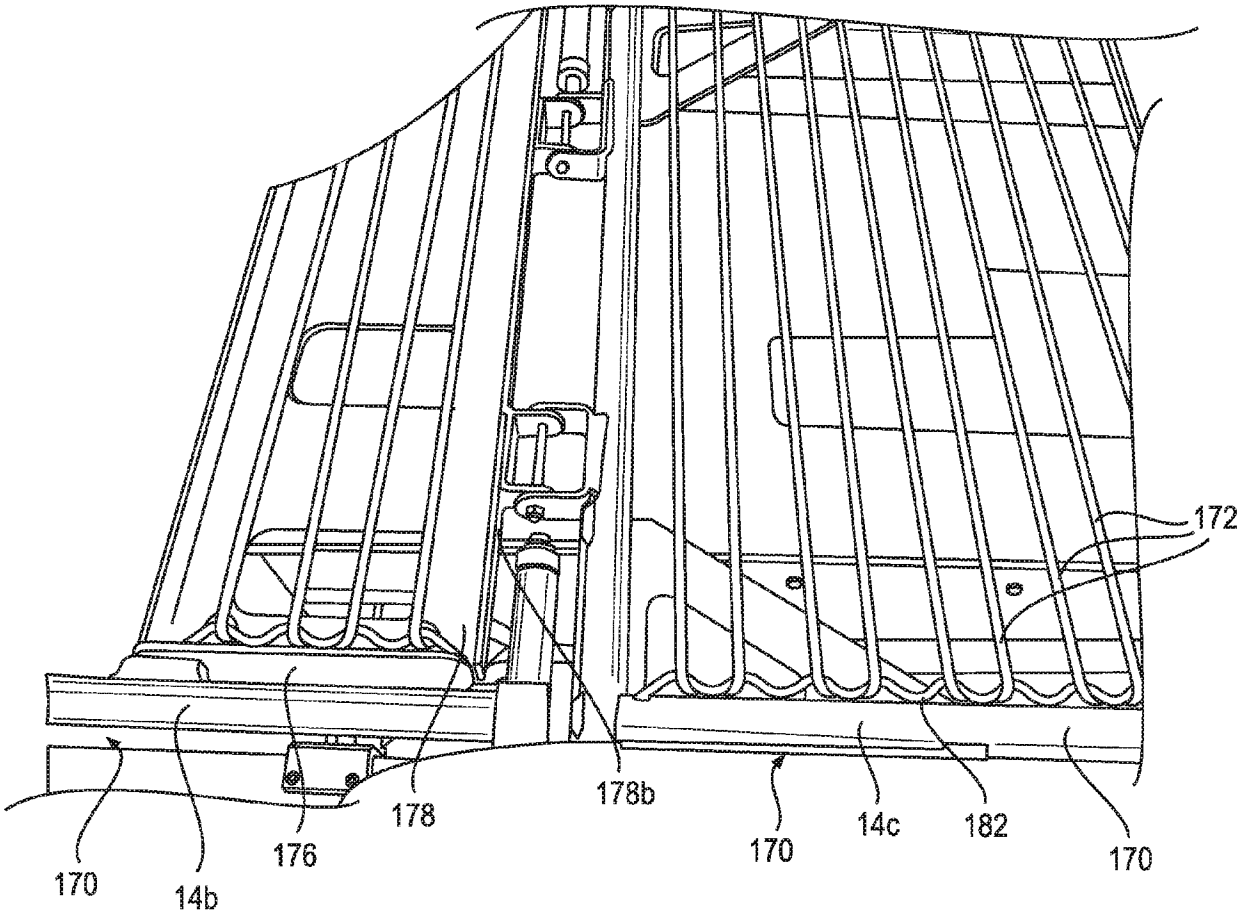
FIG. 27 is a perspective view of the deck section illustrating the elastic tethers that form the deck skin.
Figure 28:
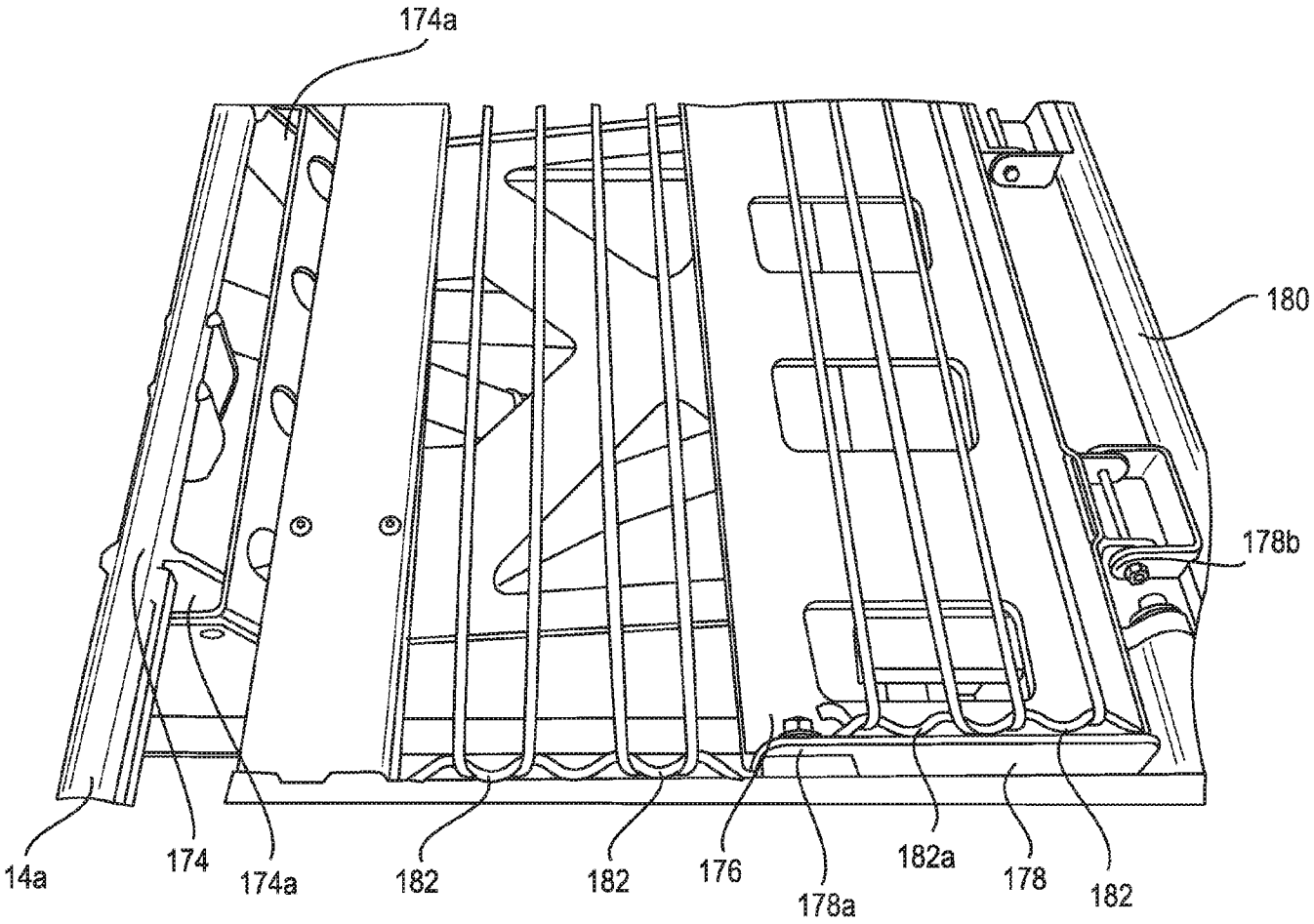
FIG. 28 is another perspective view of the section deck section.

As best seen in FIG. 28, the head deck section frame may include a transverse frame member 174 that pivotally mounts to frame 12 so the head section of the deck can be raised or lowered, for example manually or by an actuator. Supported on the transverse frame member (174) are optional eccentrically mounted brackets 174*a* that provide connection for the respective actuator or actuators. Referring to FIGS. 27 and 28, the seat section may also include an inner frame 176 formed form an inverted channel shaped member 178, which may also support some of the elastic chords for the seat section, but which is pivotal mounted to the main seat section frame on one end 178*a* so that it can be raised independently from the main seat frame. Member 178 may also be pivotally joined with the transverse frame member 180 of the foot section at it opposed end 178*b*, so that when foot section 14*c* is pivoted to a lowered position, manually or by an actuator, inner frame 176 will lift upwardly relative to the main seat section frame to form a seat trough, such as shown in FIG. 4.

Elastic cords 172 may be mounted to the respective frames (170) by one or more brackets 182. Elastic cords 172 may be provided by individual elastic chords or by a chord that is laced back and forth between the brackets, In the illustrated embodiment, elastic cords 172 are formed by one or more chords that are laced back and forth between undulating sections 182*a* of brackets 182, which extend along the longitudinal sides and length of each section of the deck (i.e. the head section, the two independently movable seat sections, and the foot section). By providing an elastic layer or skin, the overall height of mattress 16 may be reduced while still retaining the cushioning effect and immersion of the patient into the mattress 16. For example, a suitable mattress height may be reduced to a range of 3.5" to 4.5" and optionally to about 4".

With a reduced height mattress, a lower bed height is facilitated, especially when combined with the folding lifting mechanisms described above.

As described above, patient support 10 includes a frame that may be adjustable in its size (e.g. width and/or length) to accommodate larger patients. Similarly, mattress 16 may be adapted to selectively increase or decrease its size (e.g. its width and/or length and optionally thickness) to accommodate larger patients and readjust to a more compact arrangement as needed to accommodate space restrictions in a facility. For example, mattress 16 may comprise an expandable mattress described in copending U.S. application Ser. No. 13/296,656, filed Nov. 15, 2011, entitled PATIENT SUPPORT WITH WIRELESS DATA AND/OR ENERGY TRANSFER, commonly assigned to Stryker Corporation and which is incorporated by reference herein in its entirety. Alternately or in addition, mattress 16 may incorporate one or more expanding bladders along both longitudinal sides and/or the ends of the mattress to increase the effective width and/or length of the mattress (or its underside or top side to increase its height). The bladders may automatically inflate or be selectively inflated by a control system. For example, the bladders may incorporate a foam insert and be configured with a series of valves, such as a check valve and a pressure relief valve, which allow the bladders to automatically inflate when no longer confined between the opposed side rails under the spring force of the foam, which causes the check valve to allow air to be drawn into the bladder(s) and compress when pressure is applied causing the relief valves to exhaust the air from the bladders, such as described in reference to the self-adjusting bladders in copending U.S. application Ser. No. 12/640,770, filed Dec. 17, 2009 entitled PATIENT SUPPORT, and Ser. No. 12/640,643, filed Dec. 17, 2009, entitled PATIENT SUPPORT, which are incorporated by reference in their entireties herein and which are commonly owned by Stryker Corporation of Kalamazoo, Mich. Alternately, the patient support may incorporate a user interface that can be activated by a caregiver to control a pump or blower that directs air to the bladders so that the bladders are selectively inflated to increase the width or length of the mattress when the frame of the mattress is increased in size.

Figure 24:
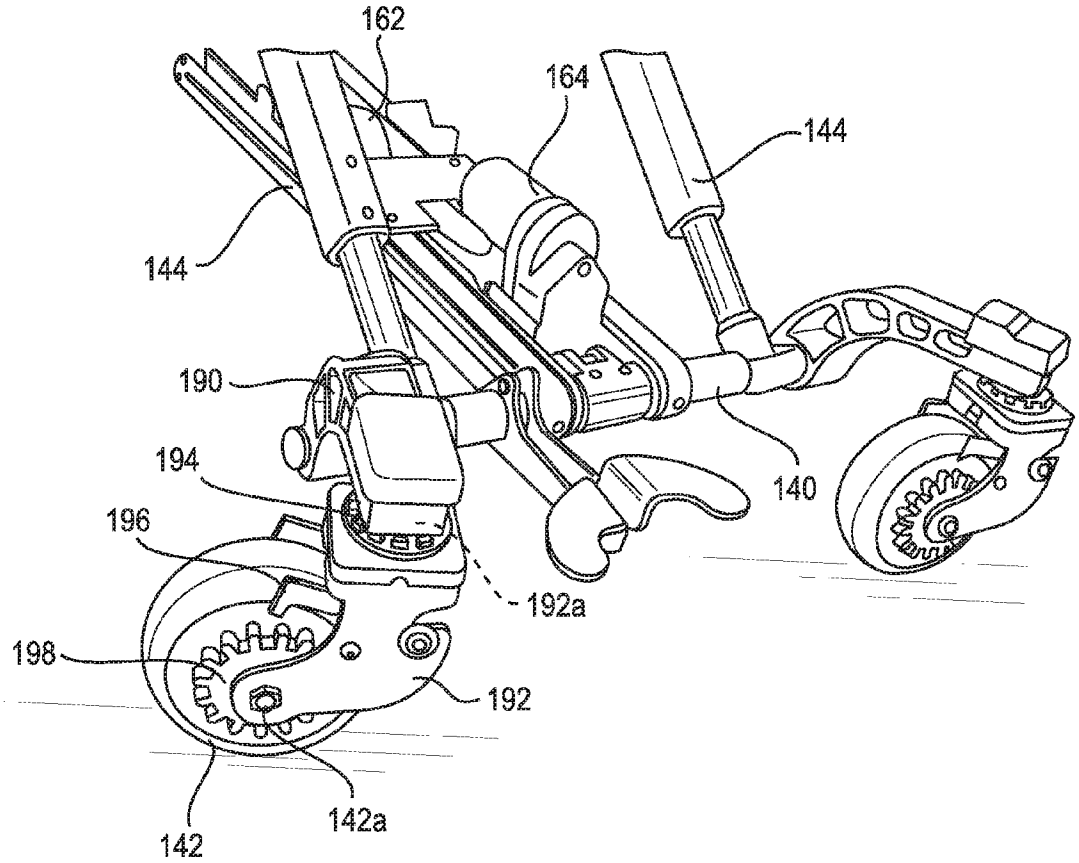
FIG. 24 is a perspective view of the foot-end of the base illustrating the castor wheels and castor wheel locking mechanism.

In addition, base 18 may also be configured to provide a suspension system that reduces impact shock to a patient transported on support 10 and optionally to increase its foot print. Referring to FIG. 24, one or more casters 142 is optionally mounted to base 18 by an arm 190 and mounting bracket 192. Optionally, mounting bracket 192 may be rotatably pivotally mounted to each arm 190 so that casters 142 can be rotated over a 180° range of motion from a fully retracted position (where the caster's axis of rotation is beneath its respective arm and inward of the arms distal end, such as shown in FIG. 2 relative to the foot-end caster), and a fully extended position (where the caster's rotational axis is extended beyond the distal end of its mounting arm such as shown in FIG. 2 relative to the head-end caster). In this manner, the foot print of base 12 can be adjusted by simply pivoting the caster mounting bracket about its mounting stem 192*a* to its respective mounting arm. Further, frame member 140*a* and 14*b* may include an outer rigid tubular member with a central torsional shaft, for example a shaft made of a rubber or other elastic material, to which each arm 190 may be directly mounted so that the torsional shaft provides a spring for the arms and thereby forms a suspension system for support 10. While all four casters are shown mounted by way of a spring mounting arrangement it should be understood that one, two or three casters may be mounted with a spring mounting arrangement.

Further, each caster may include an annular locking ring 194 with a plurality of upwardly projecting stops that are engageable by a locking bar, which is supported by mounting arm 190 to selectively lock the caster about its swivel axis through the mounting stem. An additional locking bar or arm 196 may be pivotally mounted to mounting bracket 192 to selectively lock the rotation of caster 142 about its rotational axis and thereby brake the caster. In the illustrated embodiment, caster 142 includes an annular stop ring 198 about its rotational shaft 142*a*, which includes a plurality of projecting stops, which are selectively engaged by the hooked end of locking bar 196 to thereby stop the rotation of caster 142. For example, the locking bars or arms may be actuated by cables that are coupled to a pair of pedals 199*a* and 199*b* (FIG. 23). Optionally, an actuator 199*c*, such as an electrical operated actuator, may be provided to electrically control the pedals through a set of linkages 199*d*, 199*e* (FIG. 29), which may be controlled by the patient support based controller or the computer described below. For example, the computer described below may incorporate an icon to actuate the electrical operated actuator (199*c*), such as described in U.S. Pat. No. 7,962,981, entitled HOSPITAL BED, which is incorporated by reference in its entirety herein and which is commonly owned by Stryker Corporation of Kalamazoo, Mich.

Figure 31:
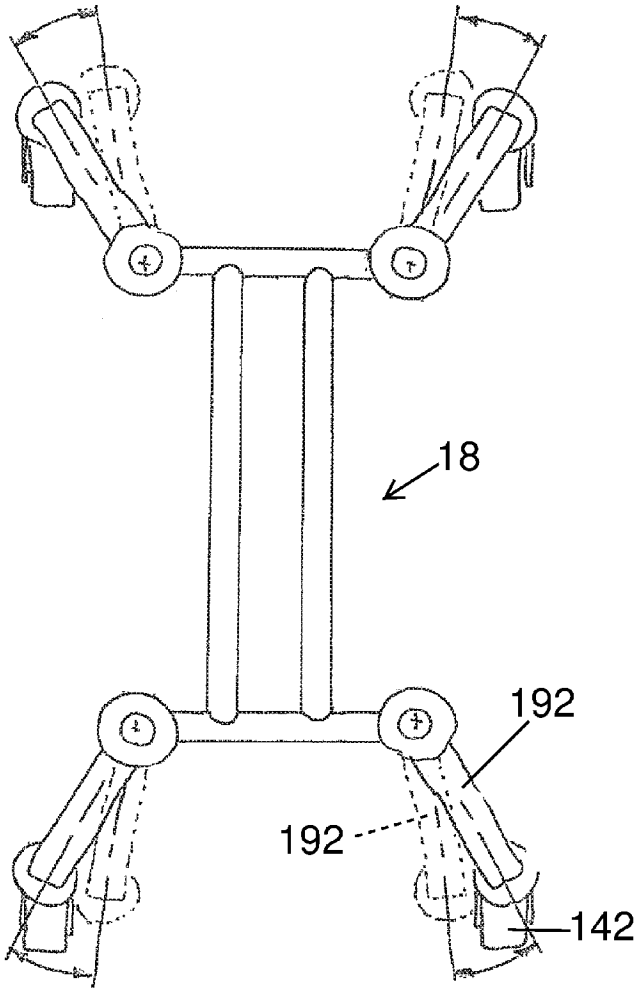
FIG. 31 is a schematic plan view of another embodiment of the base of the patient support illustrating the arms of the castor wheel assemblies rotated to an expanded position.
Figure 30:
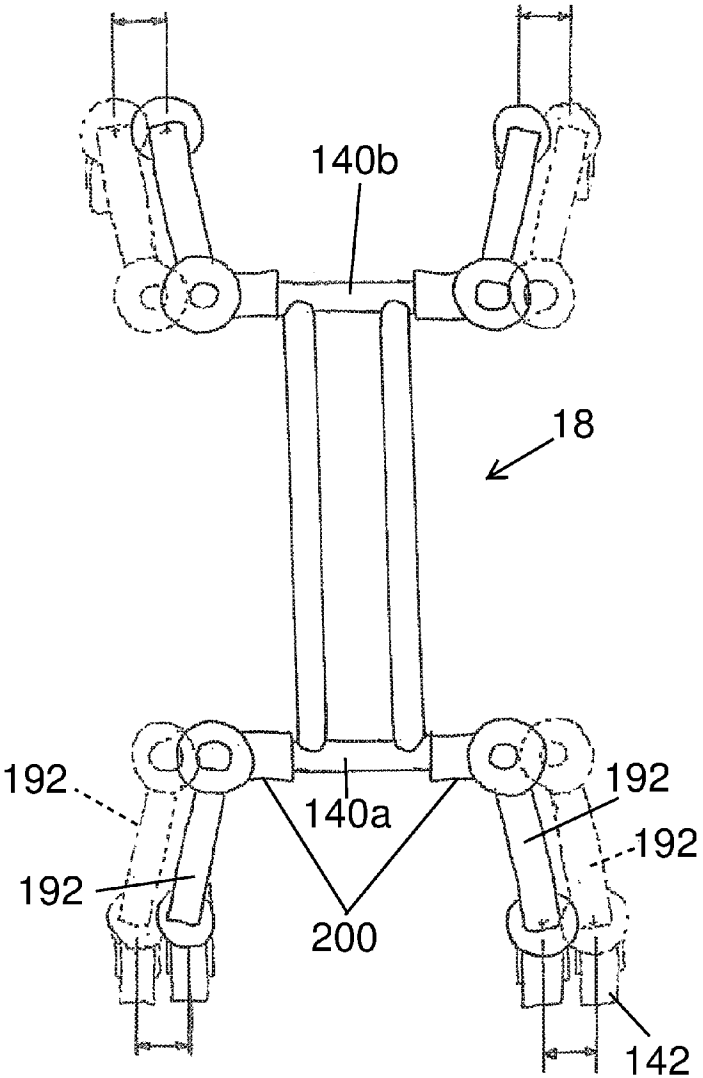
FIG. 30 is a schematic plan view of the base of the patient support illustrating the castor arms moved linearly to an expanded position.

Referring to FIGS. 30 and 31, mounting arms 192 may be configured to move (e.g. laterally or radially outward) to alter the footprint of the base. For example, referring to FIG. 30, arms 192 may be mounted to an extendible portion of base. As best understood from FIG. 30, base 18 optionally includes telescoping frame members 200 mounted to transverse frame members 140*a* and 140*b*, which support and mount arms 192 to base 18. Telescoping frame members 200 may be manually adjusted and locked in place by detent mechanisms or the like or may be powered, for example by actuators controlled by a user actuatable device, such as a button, touch screen or the like, which is in communication with the patient support based control system, for example. Alternately, arms 192 may be pivotally mounted to base 18 (FIG. 31) so that the foot print of base 18 may be increased by rotating arms 192. Similarly, arms 192 may be manually moved or moved by an actuator. Suitable actuators include electrically powered or hydraulic based actuators, such as electrically powered screw drive or hydraulic cylinders or the like. In this manner, base 18 may be reconfigured to provide greater stabilizing to patient support 10, for example, when the size of the patient support surface or lying surface is increased.

Optionally, support 10 may be adapted to generate electricity when the support is in motion. For example, one or more casters may incorporate a stator (or a coil) mounted to the rotating caster wheel and then a coil (or stator) mounted to the mounting bracket to generate electricity when patent support 10 is in motion. For example, the electricity may be used to charge the patient support based battery or as a back-up when the patient support is not plugged into to an external power supply, such as a wall power supply, such as described in U.S. copending provisional applications entitled MEDICAL EQUIPMENT WITH ANTIMICROBIAL COMPONENTS AND/OR SYSTEM, Ser. No. 61/559,407, filed Nov. 14, 2011 and Ser. No. 61/576,075, filed Dec. 15, 2011, entitled MEDICAL EQUIPMENT WITH ANTIMICROBIAL COMPONENTS AND/OR SYSTEM, which are incorporated by reference in their entireties herein and which are commonly owned by Stryker Corporation of Kalamazoo, Mich. Alternately or in addition, as described in the referenced applications, one or more casters may incorporate a UV light that could be powered by the caster stator/coil combination or by the patient support control system to provide infection control.

Referring again to FIGS. 1-5, patient support 10 is optionally adapted to allow a patient lying on a mattress, for example in a supine position, to see through the barrier and outside the patient support but still provide a barrier around the mattress to protect the patient from falling from the support. Optionally, at least head-end side rail 22 may include a transparent body portion 22*b* that extends upwardly from lower body portion 22*a* to form a continuous barrier between lower body portion 22*a* and the upper edge 22*c* of transparent portion 22*b* but because of its transparency allows a patient to see through the side rail. For example, transparent portion 22*b* may be formed from one or more panels of transparent material, such as a polymer, including plastic, which is supported in the respective side rail. For example, the transparent panel portion 22*b* may be anchored at its lower end or edge in lower body portion 22*a* and supported at its head-end edge 22*d* and its foot-end edge by a frame 22*f*, such as an inverted generally U-shaped frame, which extends upwardly from lower body portion 22*a* and which may be configured to form hand holds. For example, frame 22*f* may be formed from a tubular member that is formed, such as by molding, with lower body portion 22*b*, which may be formed from a plastic.

Figure 6:
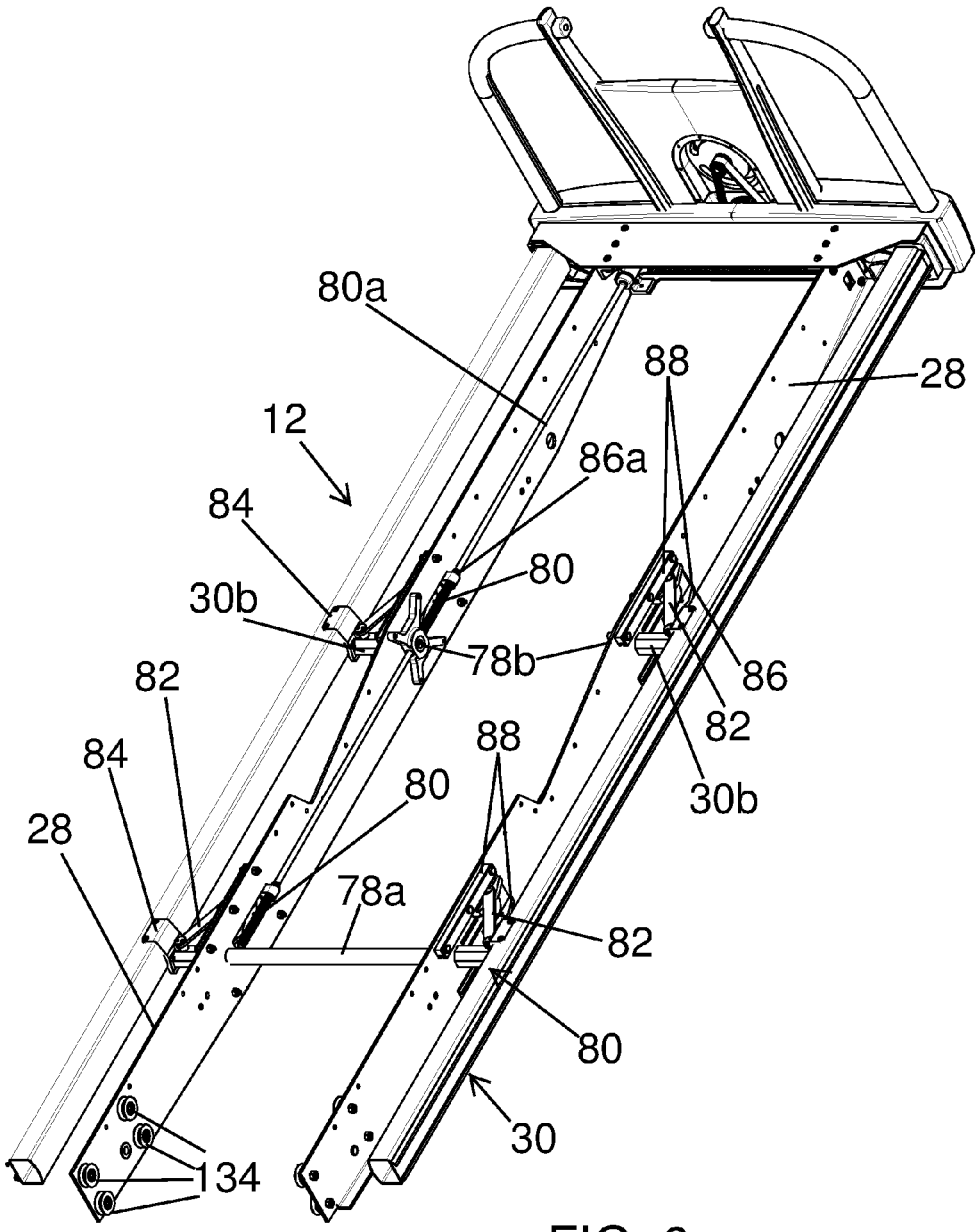
FIG. 6 is a top perspective view of the frame of the bed of FIG. 1 with the side rails, lifting mechanism and headboard removed for clarity.
Figure 6A:
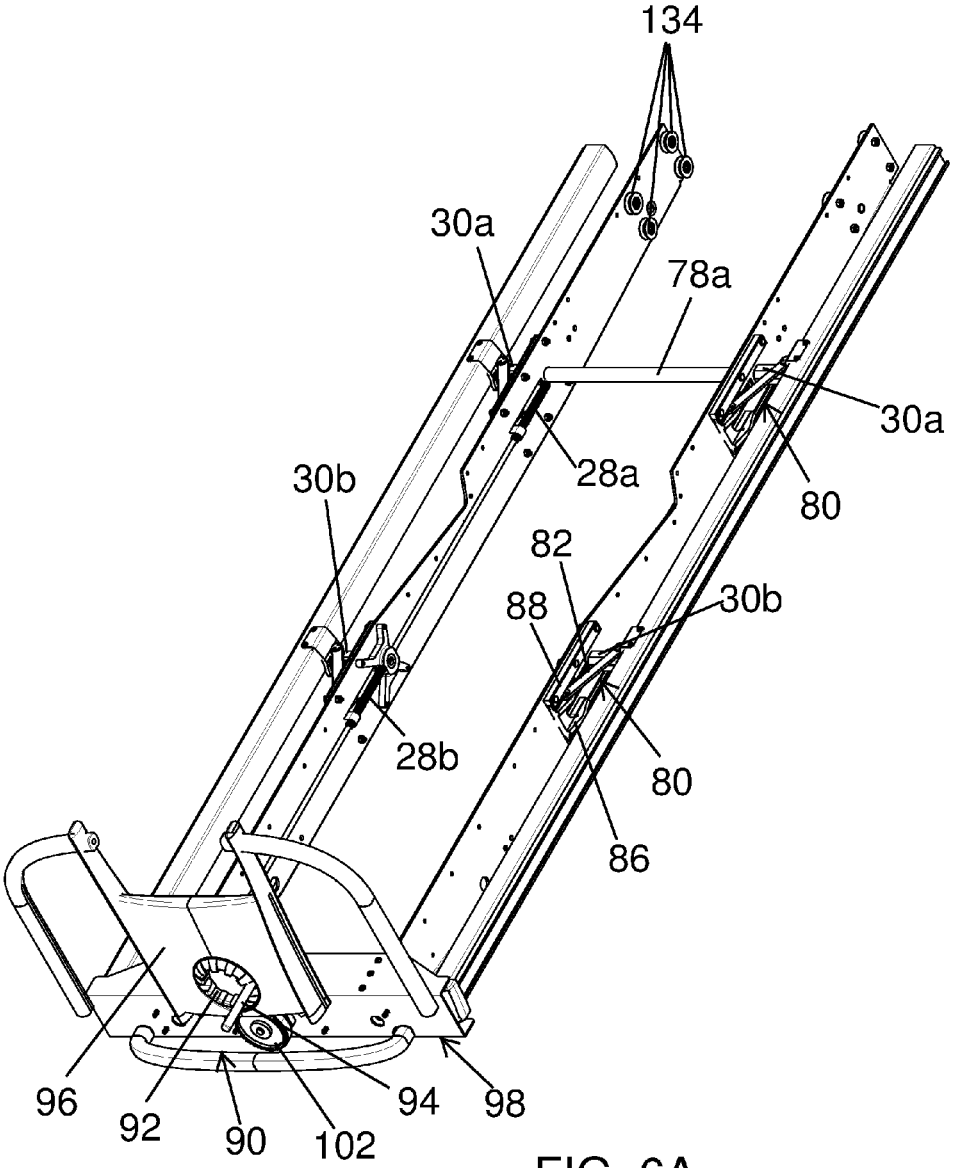
FIG. 6A is another perspective view of the frame of FIG. 6 from the foot-end of the patient support.
Figure 6B:
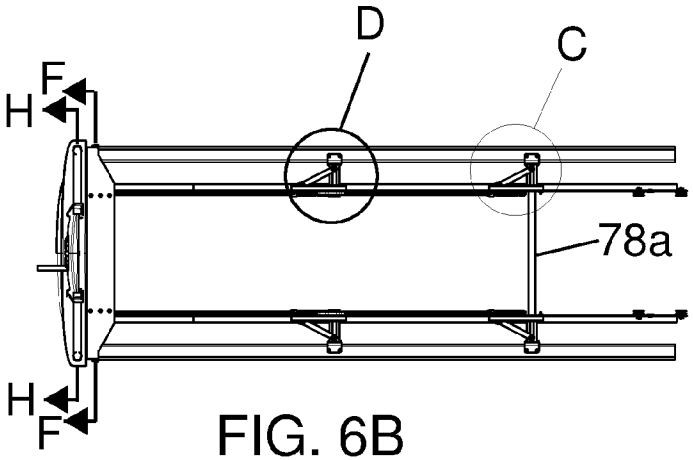
FIG. 6B is a plan view of the frame of FIG. 6 illustrating the frame in a compact configuration.
Figure 6C:
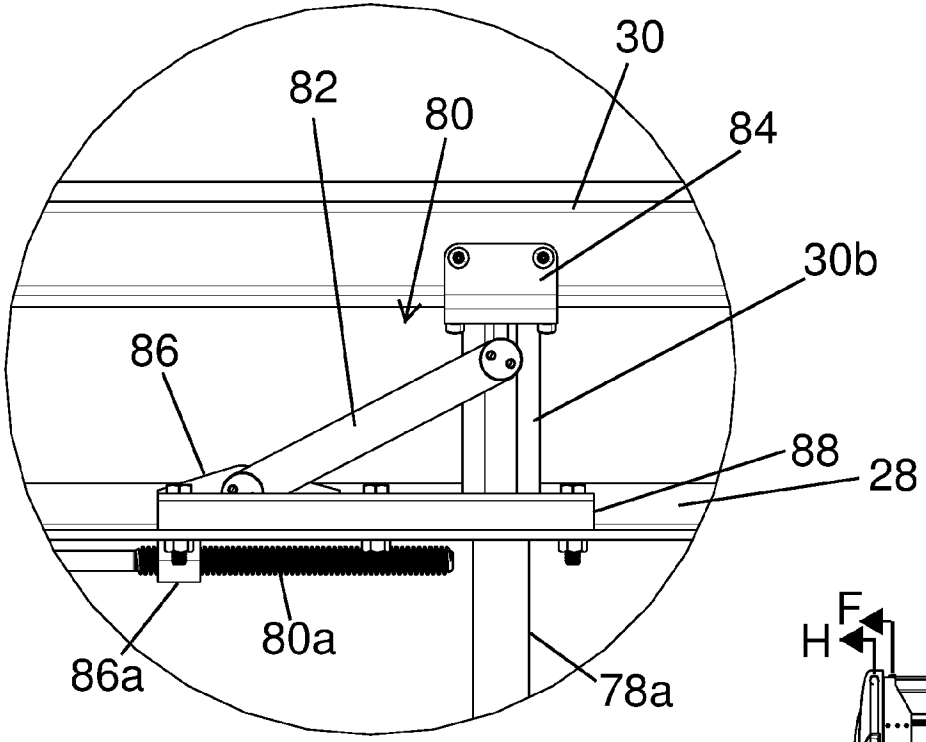
FIG. 6C is an enlarged view of detail C of FIG. 6B.
Figure 6D:
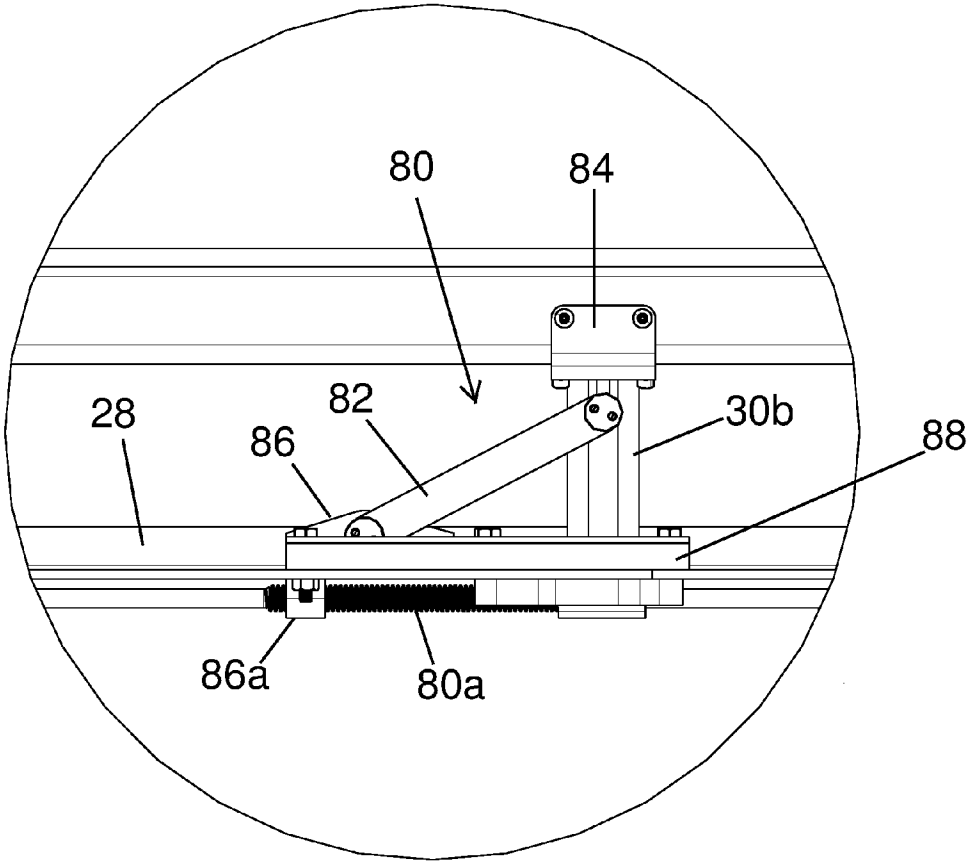
FIG. 6D is an enlarged view of detail D of FIG. 6B.
Figure 6E:
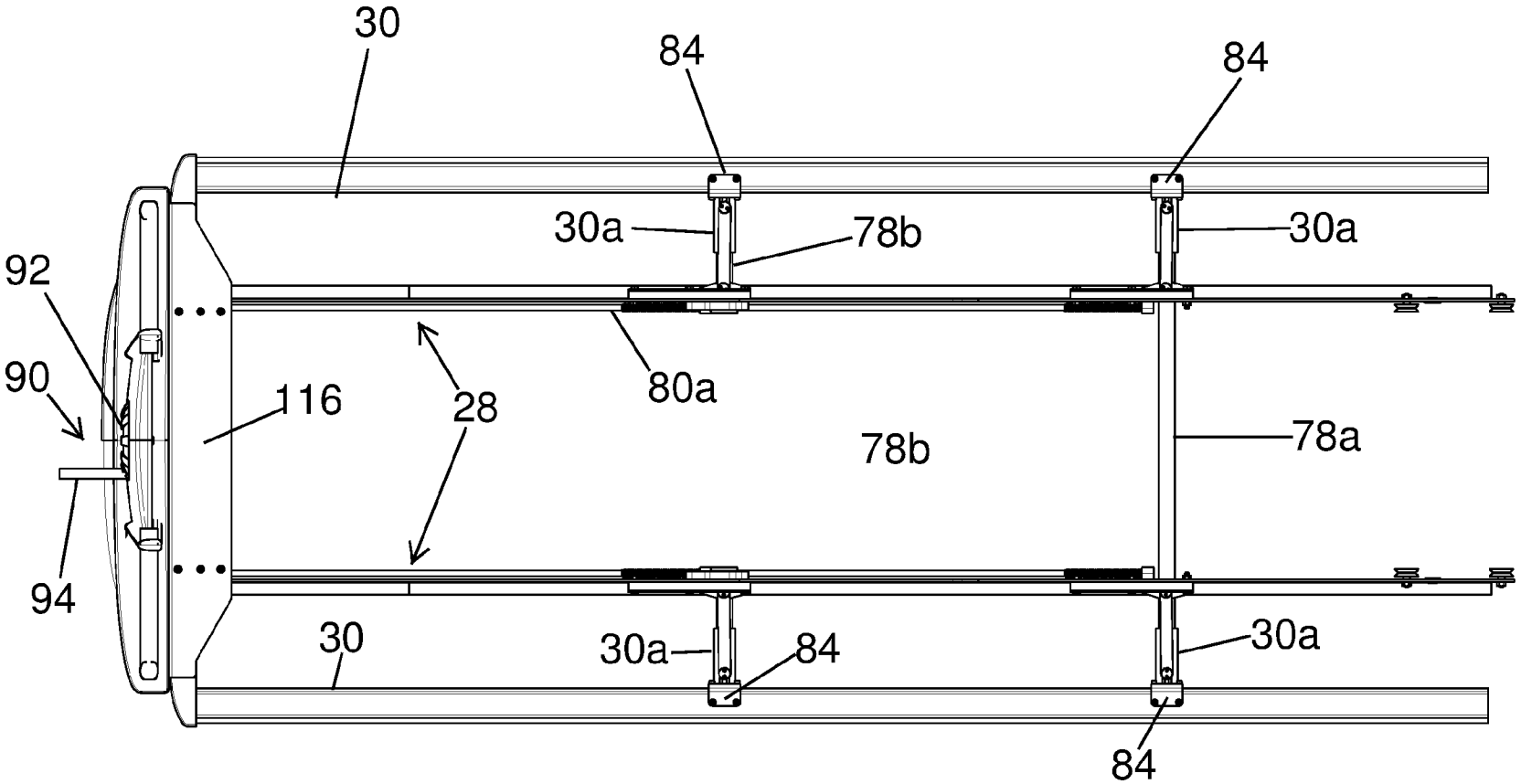
FIG. 6E is a similar view to FIG. 6B illustrating the frame in an expanded configuration.
Figure 6F:
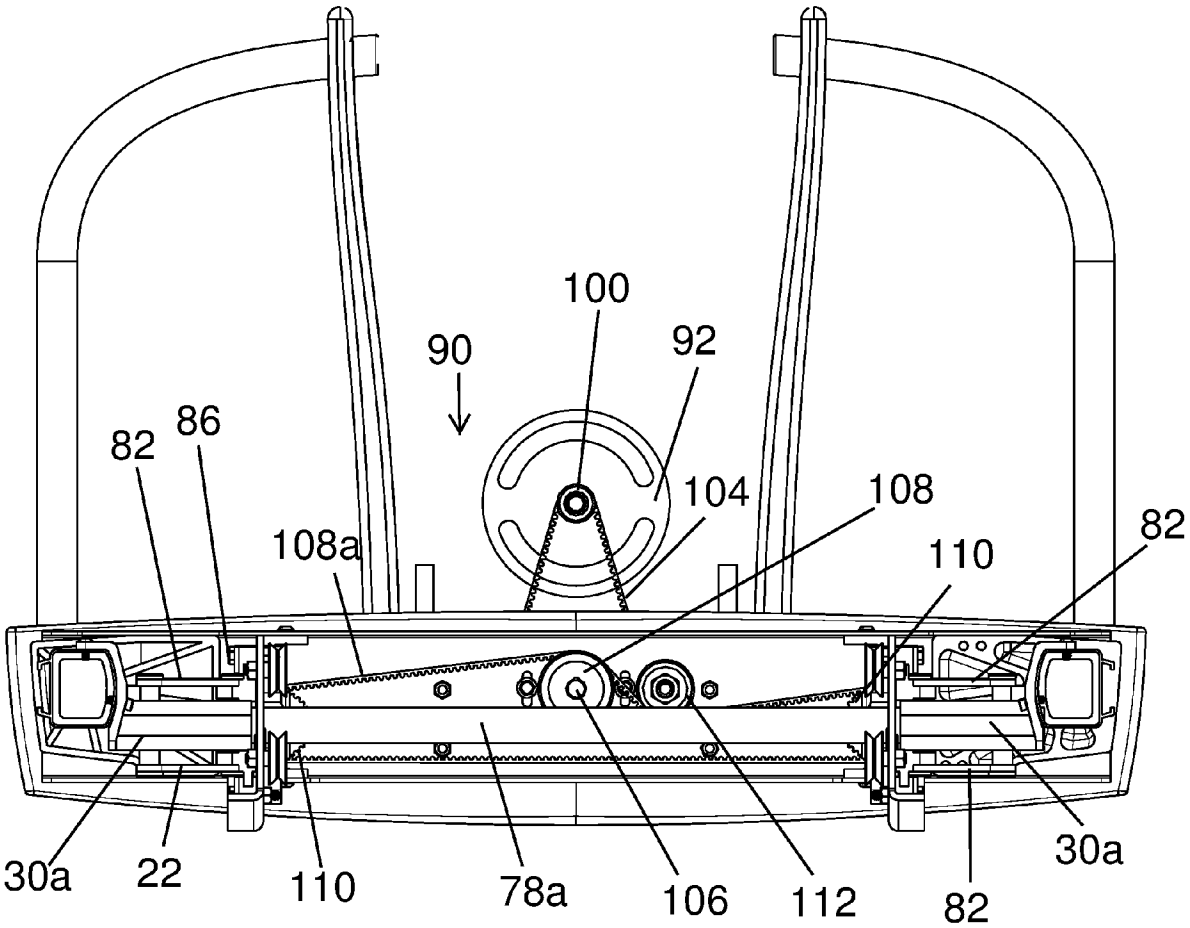
FIG. 6F is a cross-section view taken along line F-F of FIG. 6B.
Figure 6G:
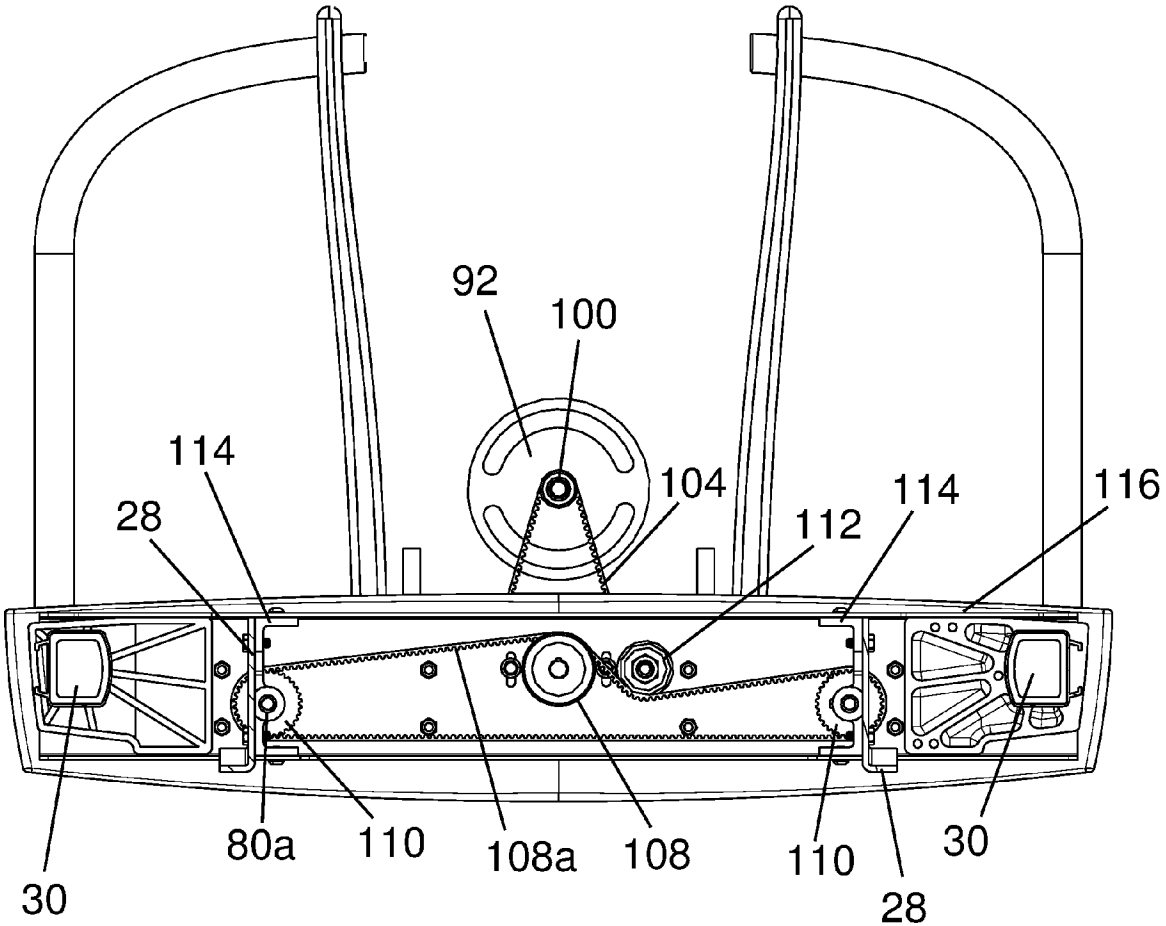
FIG. 6G is a partial fragmentary elevation view of the footboard and foot-end of the frame.
Figure 6H:
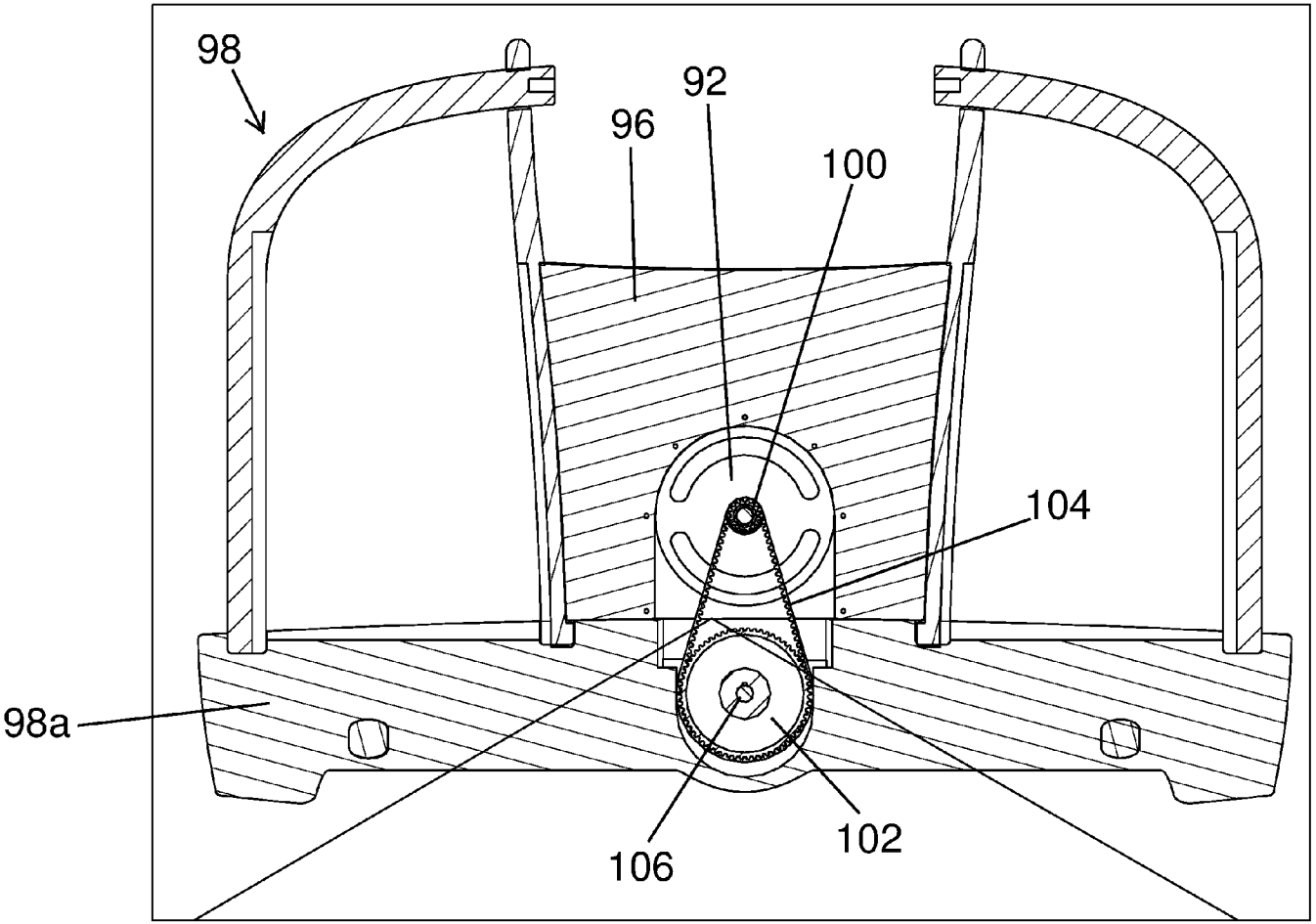
FIG. 6H is a cross-section view taken along line H-H of FIG. 6B.
Figure 6I:
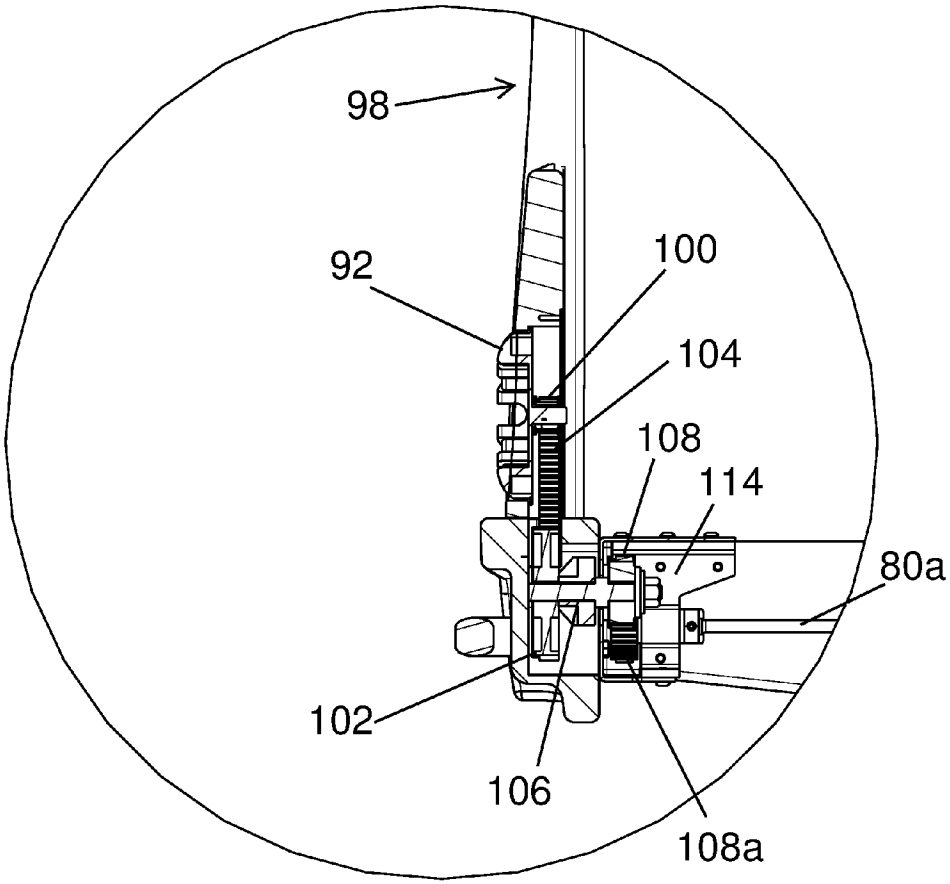
FIG. 6I is an enlarged cross-section taken along line I-I of FIG. 6B.

Referring to FIG. 6H, each vertical section 22*g* of frame 22*f* may be formed or provided with a recessed groove into which the edges of the transparent panel may be inserted and then retained therein either by fasteners or may be molded therein during the side rail forming process or post molded or post attached. Alternately, the panel may have a friction fit or loose fit so that the panel may be removed for replacement or repair. It should be understood that while not detailed herein, side rail 24 may be formed with a similar construction and arrangement but may have different dimensions and shapes than side rail 22, as would be understood from the drawings.

Optionally, the panels may be formed with an optical filter or a color additive to form colored or tinted panels. In this manner, as light passes through the panels, the mattress and patient support thereon will be washed with colored light, which color can be selected based on the patient's preference or simply preselected. For example, some colors are known to create a calming or soothing effect. To enhance this effect, all the side rails and the headboard and footboard may also incorporate colored or tinted, transparent panels.

In addition to allowing the patient to see out of the patient support when lying down in a supine position (even when all the side rails are raised), the transparent portions of the side rails allow a caregiver to see the patient without having to be adjacent the patient support. This may be particularly helpful in an infection situation when the patient has a contagious disease.

Also by incorporating polymer panels into the side rails (and headboard and/or footboard), each of the side rails and footboards and headboards may incorporate a light source, such as a UV light or HINS (high intensity natural spectrum) source, to direct light into the edge of panel to kill bacteria on the surface of the panel, such as described in U.S. copending provisional applications entitled MEDICAL EQUIPMENT WITH ANTIMICROBIAL COMPONENTS AND/OR SYSTEM, Ser. No. 61/559,407, filed Nov. 14, 2011, and Ser. No. 61/576,075, filed Dec. 15, 2011, entitled MEDICAL EQUIPMENT WITH ANTIMICROBIAL COMPONENTS AND/OR SYSTEM, which are incorporated by reference in their entireties herein and which are commonly owned by Stryker Corporation of Kalamazoo, Mich. For example, a light source may be housed in the lower body portions (e.g. 22*a*) and positioned adjacent the lower edge of the panel to direct the light into the panel. As explained in the referenced application, the material of the panel can be selected so that it has total internal reflection such that the light stays inside the panel and does not impinge on the patient.

In other aspects, a light source may be used to direct light into the panel to selectively change the color of the panel or opacity of the panel. For example, "tunable" LED's may be provided which emit different frequencies of light based on the current flow or voltage applied to power the LED to vary the color of the light or to produce UV light. The UV light may be used to activate photochromic substances, such as silver chloride or silver halide, embedded in or applied to the panels to cause the panel to darken or appear more opaque, as noted below, to selectively provide some privacy and/or as noted above to clean the panel.

Alternately, the panels may optionally incorporate an electrochromic system, for example, sandwiched between two clear polymer panels that darkens when an electrical current is passed through the electrochromic system (typically formed from two conductive layers (such as conducting oxide layer), which straddle a sandwich of an electrochromic layer (such as tungsten oxide), an ion conductor, and an ion storage layer) to transform the panel from a transparent panel to a translucent or opaque panel. When energized (for example, by the bed based control system), the electrochromic system can provide privacy to the patient or provide a surface onto which images may be projected, such as images for entertainment or for viewing a caregiver or doctor or family member remote from the patient support, which can be projected onto the panel by a projector mounted in the opposed side rail or headboard or footboard.

The color or state (e.g. flashing or blinking) of the light may be used to provide a signal, so that the side rail body acts a signaling device. In one form, a color may indicate that the bed is in a safe configuration or an unsafe configuration (such as described in copending U.S. application Ser. No. 11/557,349, filed on Nov. 7, 2006, entitled PATIENT HANDLING DEVICE INCLUDING LOCAL STATUS INDICATION, ONE-TOUCH FOWLER ANGLE ADJUSTMENT, AND POWER-ON ALARM CONFIGURATION, which is incorporated by reference in its entirety and which is commonly owned by Stryker Corporation of Kalamazoo, Mich.). And, a second color may indicate that the bed is in an unsafe configuration or a safe configuration. In this manner, a caregiver can immediately confirm whether there is or is not an alert condition at the bed by simply looking into the room where the bed is located.

The intensity of the light may vary. For example, when the room's lights are on, the intensity of the light may be increased (for example, by the bed based control system) to make the light more visible, and when the room lights are off, the intensity may be reduced so as not to disturb the patient. Similarly, the color of the light may simply be tied to a specific condition at the patient support or condition of the patient. For example, the light may indicate that the vital signs of a patient drop below a value, such as a preset value or selected value, that the bed exit alarm has been triggered, that the head of bed angle is too low, that the side rails are lowered when they should be raised. In any of these instances, the light may comprise a flashing red light to stress the urgency where appropriate.

Additionally, the light may be used to remind a caregiver to attend to a treatment protocol for the patient or simply to check on the patient. For example, the light may be selected as the alarm notification for a reminder alert system, such as described in U.S. Pat. No. 7,690,059, issued Apr. 6, 2010 entitled HOSPITAL BED; U.S. Pat. No. 7,805,784, issued Oct. 5, 2010, entitled HOSPITAL BED; U.S. Pat. No. 7,962,981, issued Jun. 21, 2011, entitled HOSPITAL BED; U.S. Pat. No. 7,861,334, issued Jan. 4, 2011, entitled HOSPITAL BED; and in copending U.S. application Ser. No. 13/034,303, filed Feb. 24, 2011, entitled, PATIENT SUPPORT WITH IMPROVED CONTROL, which are incorporated by reference in their entireties herein and are commonly owned by Stryker Corporation of Kalamazoo, Mich.

Optionally, support 10 may also incorporate cameras, such as described in copending U.S. patent application Ser. No. 13/242,022, filed Sep. 23, 2011, entitled VIDEO MONITORING SYSTEM or may incorporate a sensing and control system for detecting and analyzing gestures by a caregiver to control functions at the support, such as described in copending U.S. provisional patent application Ser. No. 61/599,099, filed Feb. 15, 2012, entitled PATIENT SUPPORT APPARATUS AND CONTROLS THEREFOR, which are incorporated by reference in their entireties herein and which are commonly owned by Stryker Corporation of Kalamazoo, Mich.

As noted above, patient support 10 may incorporate a patient support-based control system. For example, patient support-based control system may be configured to control devices at the support, including blowers or pump to control air flow to bladders in the mattress, for sensing conditions of the patient support or at the patient support, such as occupancy detection, wetness, pressure at the patient interface with the mattress for ulcer management, patient movement etc. The patient control system may be located, for example, in the foot end of frame 12 and/or in base 18 and include a network, a micro-based controller, actuators for moving or driving the various components at the support, an air supply system, including one or more pumps or blowers and an air supply reservoir, sensors, including load cells, and a power supply such as a battery and/or a capacitor based power supply (optionally supported in base 18 to lower the CG of support 10). For further examples of conditions or settings that can be monitored at the patient support reference is made to U.S. patent application Ser. No. 11/557,349, filed Nov. 7, 2006, entitled PATIENT HANDLING DEVICE INCLUDING LOCAL STATUS INDICATION, ONE-TOUCH FOWLER ANGLE ADJUSTMENT, AND POWER-ON ALARM CONFIGURATION and U.S. patent application Ser. No. 11/941,338, filed Nov. 16, 2007, entitled PATIENT SUPPORT WITH IMPROVED CONTROL, which are incorporated by reference in their entireties herein and which are commonly owned by Stryker Corporation of Kalamazoo, Mich.

To communicate with the patient control system or to function as the control system, a portable computer 210 may be provided that is removably mounted to patient support 10 at footboard 98. For example, computer 210 may be mounted to an articulatable surface provided at the footboard. Computer 210 may comprise a computer tablet, such as an iPad® available from Apple or other portable computing or communication devices. Computer 210 may be configured to communicate with the various devices and/or sensors on the patient support to control the device and/or sensor settings and to receive signals from sensors or devices at the patient support, or may be configured to communicate with the patient support based control system or both, with one being a slave or secondary controller, and the other being a master or principal controller. Optionally, therefore, computer 210 may be used by a caregiver to control support 10 and/or alternatively may be used to access EMRs, update patient charts etc.

Figure 5:
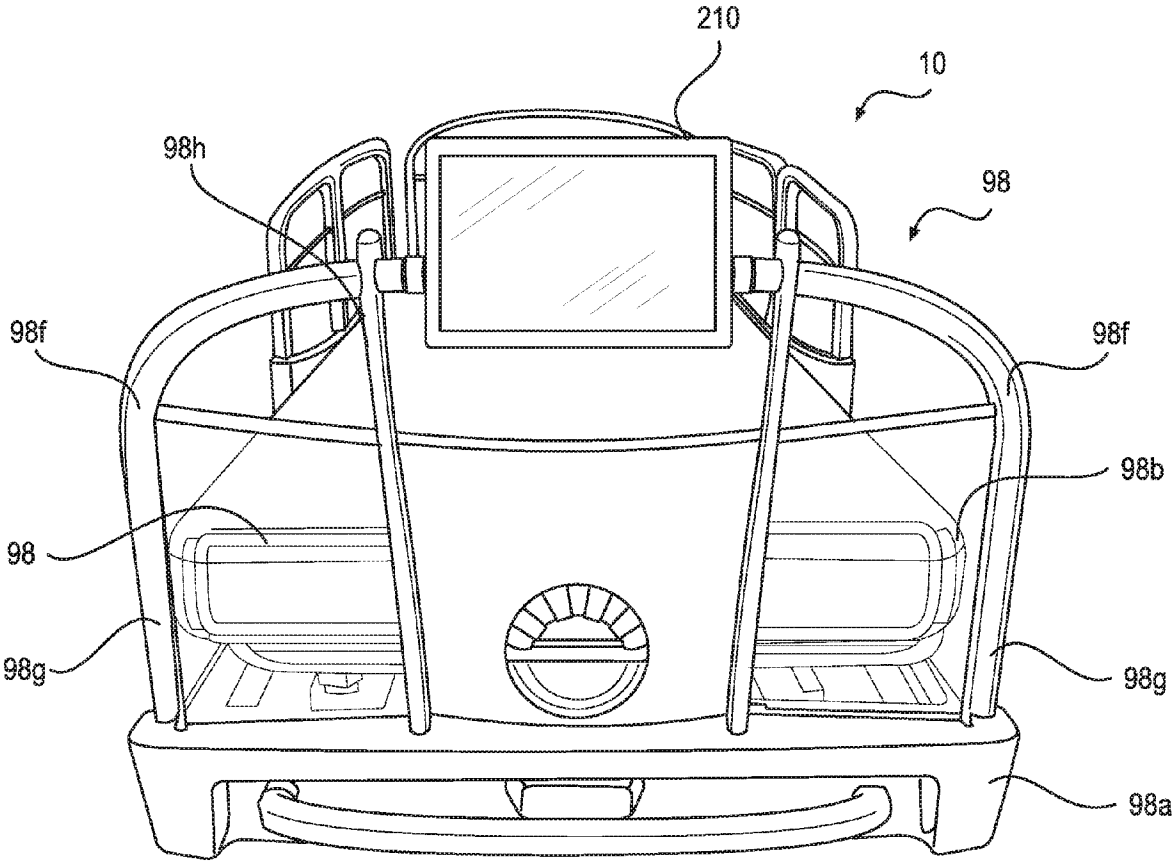
FIG. 5 is a foot-end view of the patient support of FIG. 1.

Referring to FIGS. 5 and 6, footboard 98 may include a lower body portion 98*a* and optional transparent panels 98*b*, 98*c* that extend upwardly from lower body portion 98. Panels 98*b* and 98*c* are supported by body portion 98*a* and frames 98*f*. Frames 98*f* each have an inverted general L-shaped configuration, which is supported at their lower ends in lower body portion 98*a*. The upper distal ends of frames 98*f* are supported by bars 98*h*, which are also anchored in lower body portion 98*a*. Panels 98*b*, 98*c* extend between and are mounted between the vertical portion of frames 98*f* and bars 98*h*, in corresponding recesses formed in frames 98*f* and bars 98.

As best seen in FIG. 5, computer 210 may be mounted between the distal upper ends of frame 98*f* and further pivotally mounted so that the displaying surface or screen of computer 210 may be rotated about its mounting axis from a few degrees up to 360° (and optionally for infinite rotations) so that a patient supported on support 10 or a caregiver adjacent the patient may view the screen or a caregiver at the foot-end of the support may view the display screen of computer 210. For example, a rotatable platform may be mounted between frame 98*f*, which mounts computer 210 to footboard or the computer housing may incorporate the pivotally mounting structure. Further, because computer 210 may communicate with the devices on the support wirelessly or with the support-based control system wirelessly, the mounting connections may be wireless and simply provide a mechanical coupling of the computer to the footboard. Though it should be understood that wiring for data or power signal communications may also be provided, for example, to recharge the battery on the computer. Alternately, the mounting mechanism may incorporate a non-contact based power system, such as an inductive based system, an infrared system, a Bluetooth® system, or a ZigBee® system (IEEE 802.15.4), to recharge the computer's battery and/or optionally transfer data between the support based computer system and computer 210 or directly between computer 210 and devices at the support to control and/or receive signals from the devices. Alternately, computer 210 may communicate with the support based control system directly via an RF wireless system or through a module, such as a wall mounted module, in the room or a remote central system, such as a nurse call system or through the hospital network. Therefore, computer 210 may act as the communication device for the support (such as the communication module described in U.S. Pat. No. 7,598,853, which is incorporated by reference in its entirety herein and commonly owned by Stryker Corporation of Kalamazoo, Mich.) or the patient support may act as the communication device for computer 210.

Referring to FIGS. 32-37, the numeral 310 generally designates another embodiment of the patient support of the present invention. Patient support 310 may have a similar construction to patient support 10 and includes a frame 312, a deck 314, which supports a mattress (not shown), and a base (also not shown in FIGS. 32-37 but shown in reference to the previous embodiments). For details of the frame, deck, mattress and base etc. reference is made to the previous embodiment.

Figure 32:
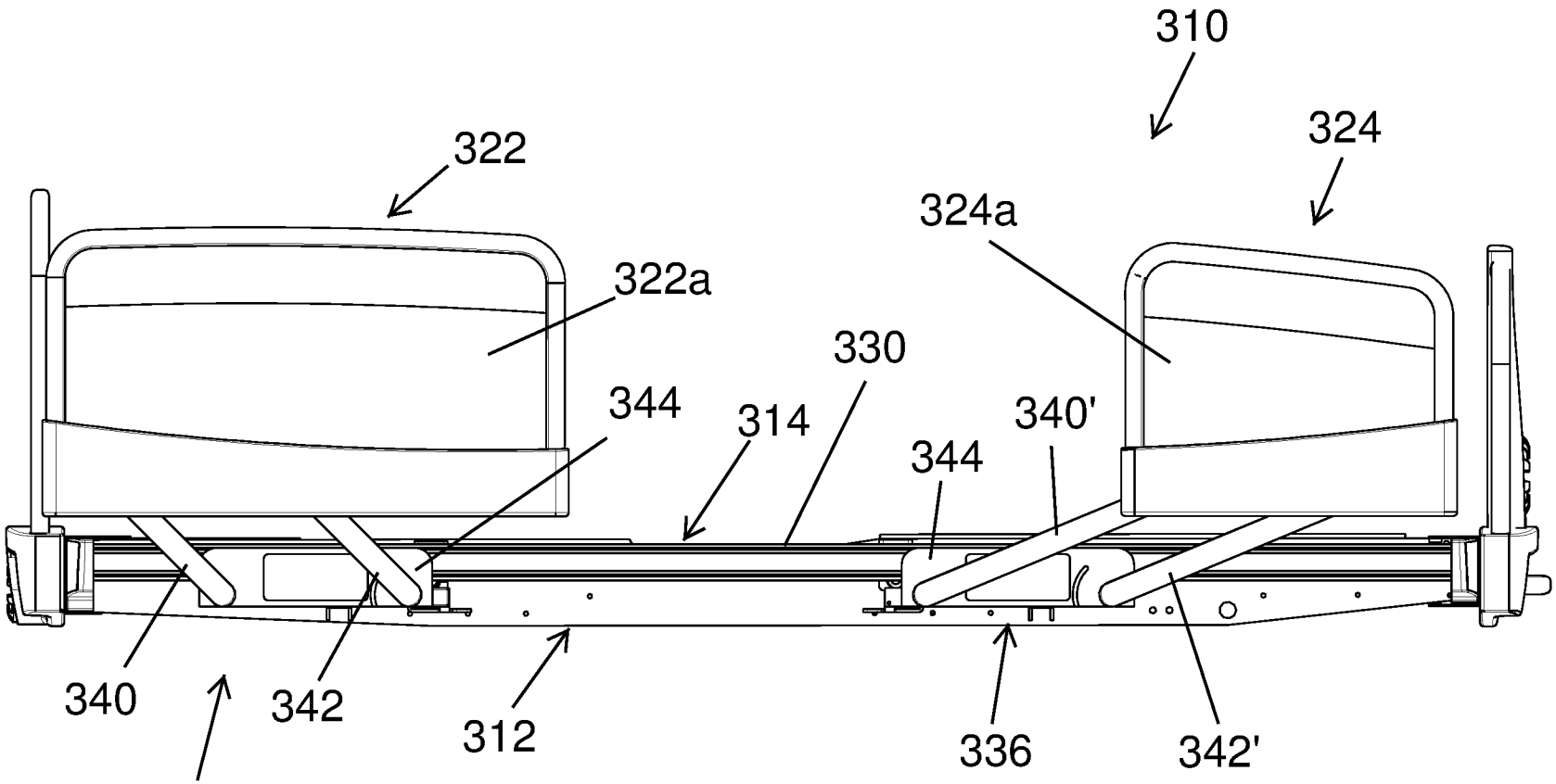
FIG. 32 is a side elevation view of a patient support another embodiment of a side rail mounting arrangement.
Figure 33:
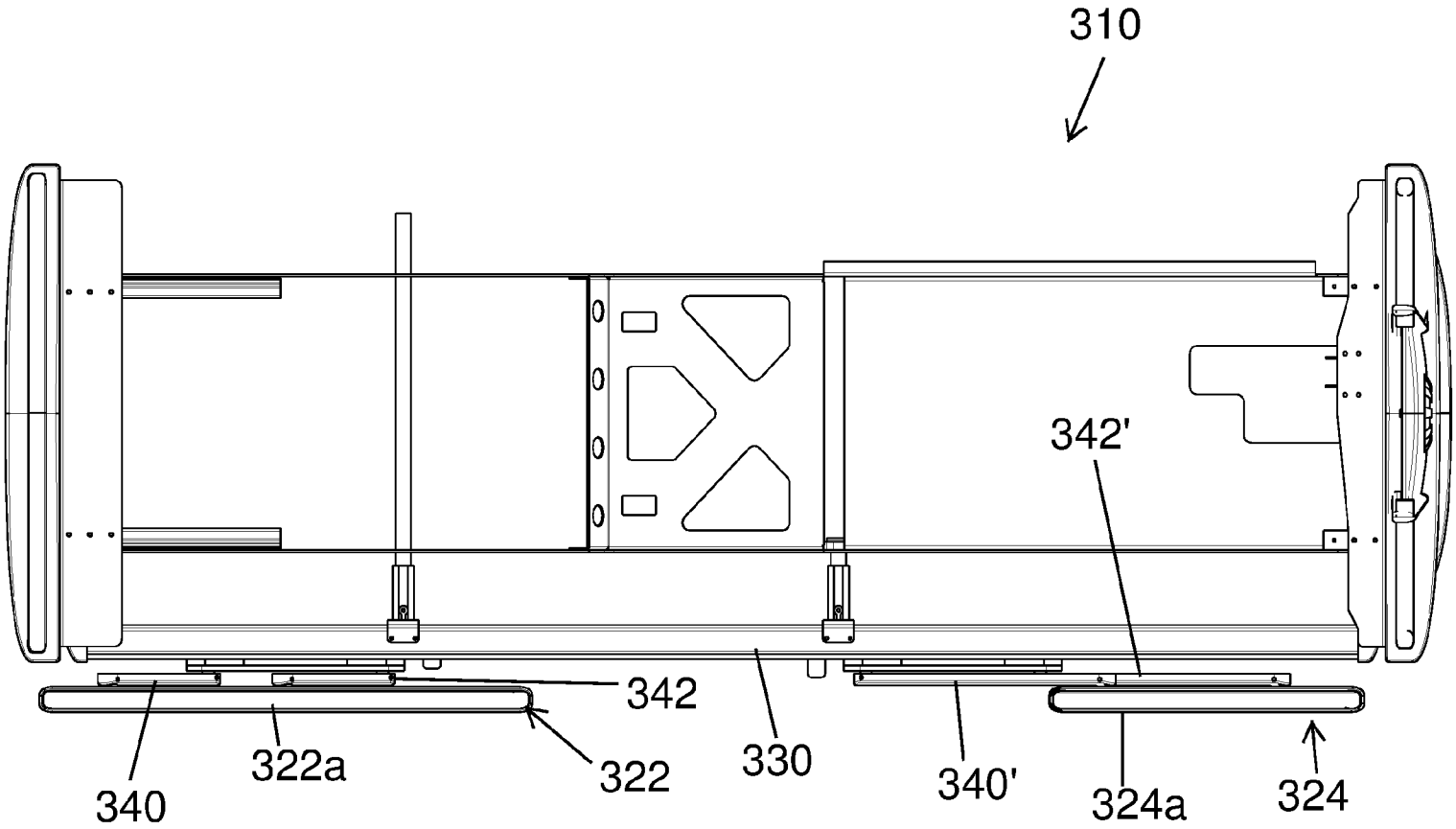
FIG. 33 is a plan view of the patient support of FIG. 32.
Figure 34:
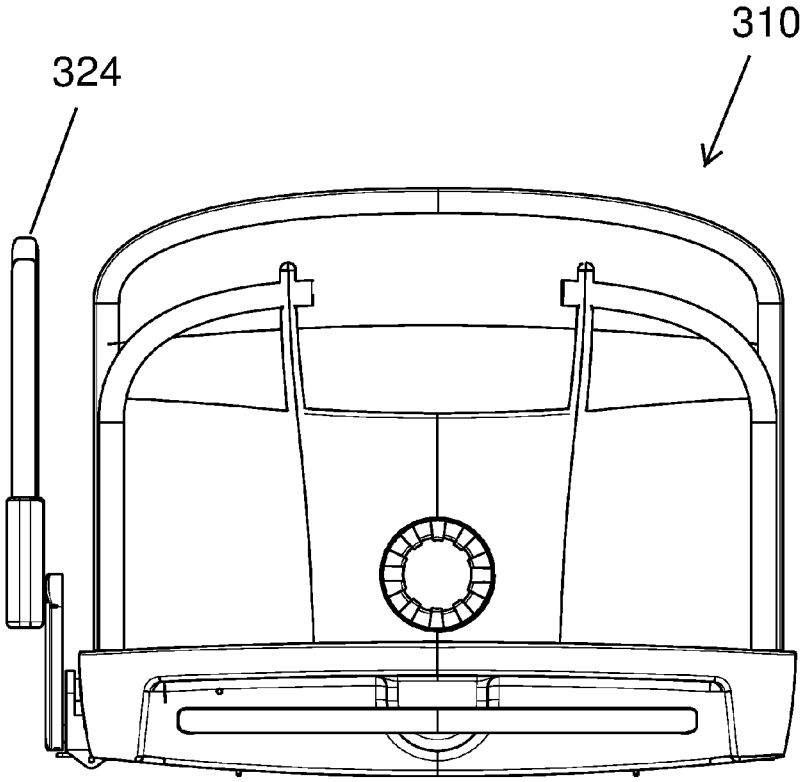
FIG. 34 is an end elevation view of the patient support of FIG. 32.
Figure 35:
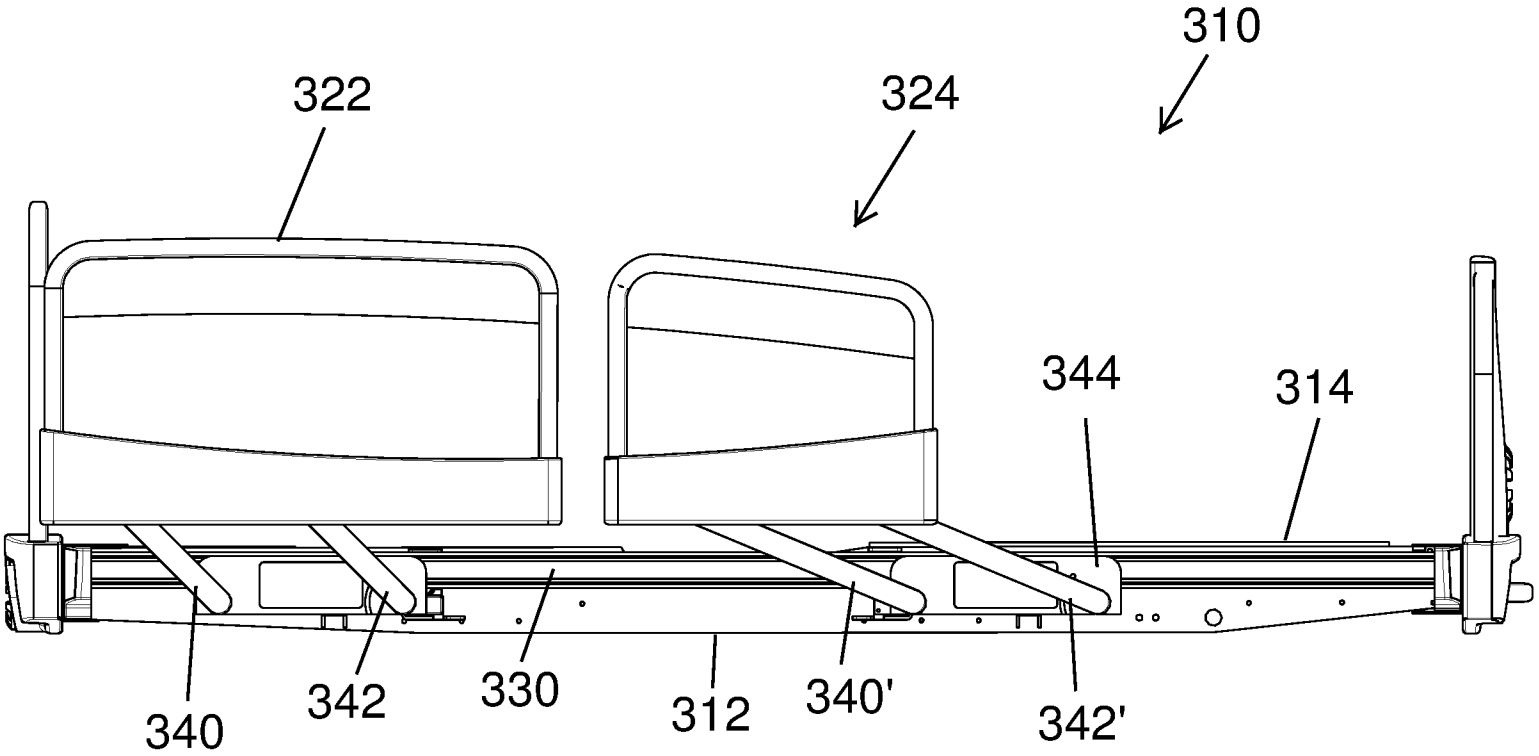
FIG. 35 is a side elevation view similar to FIG. 32 with the foot end side rail moved to the foot end of the patient support.
Figure 36:
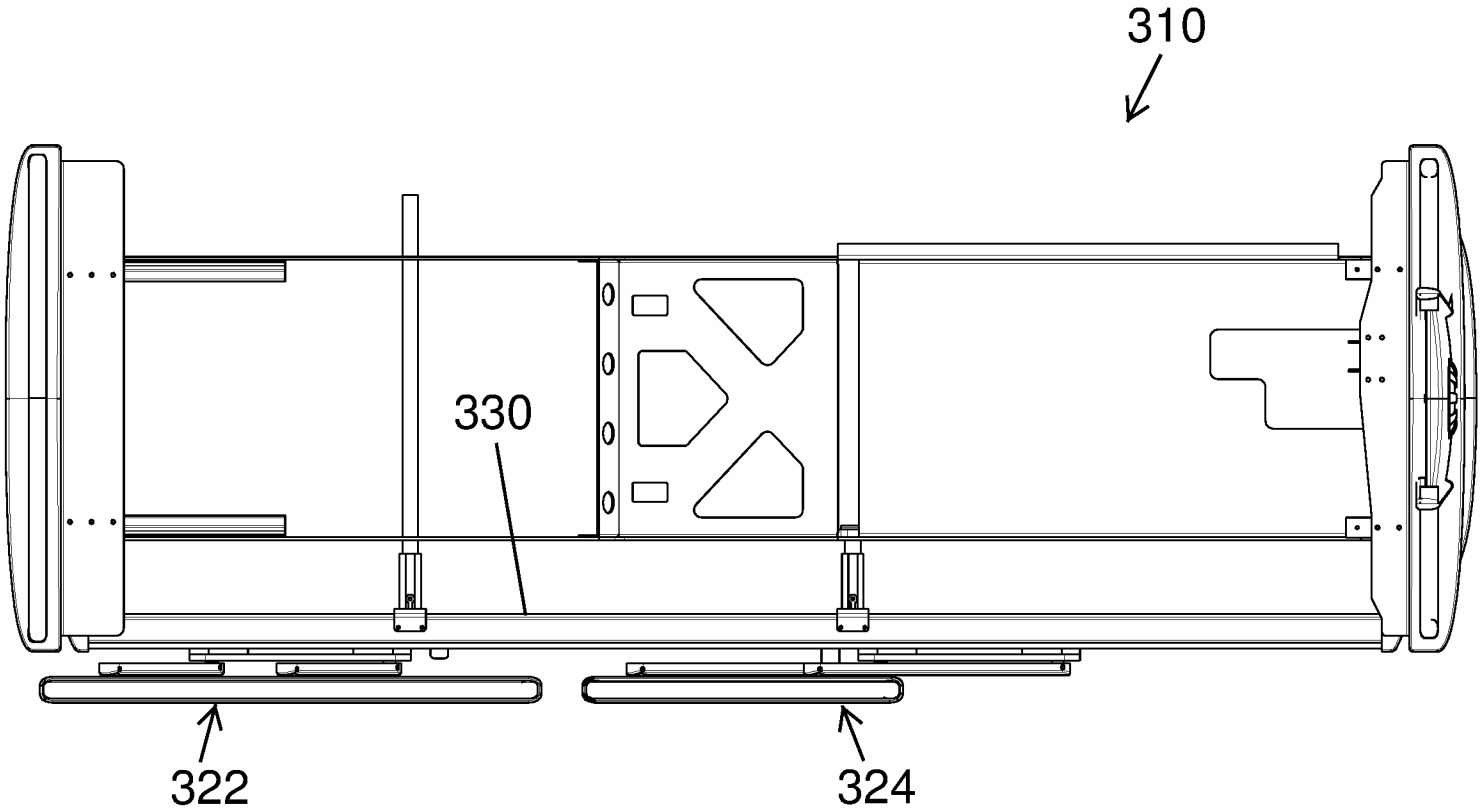
FIG. 36 is a plan view of the patient support of FIG. 35.
Figure 37:
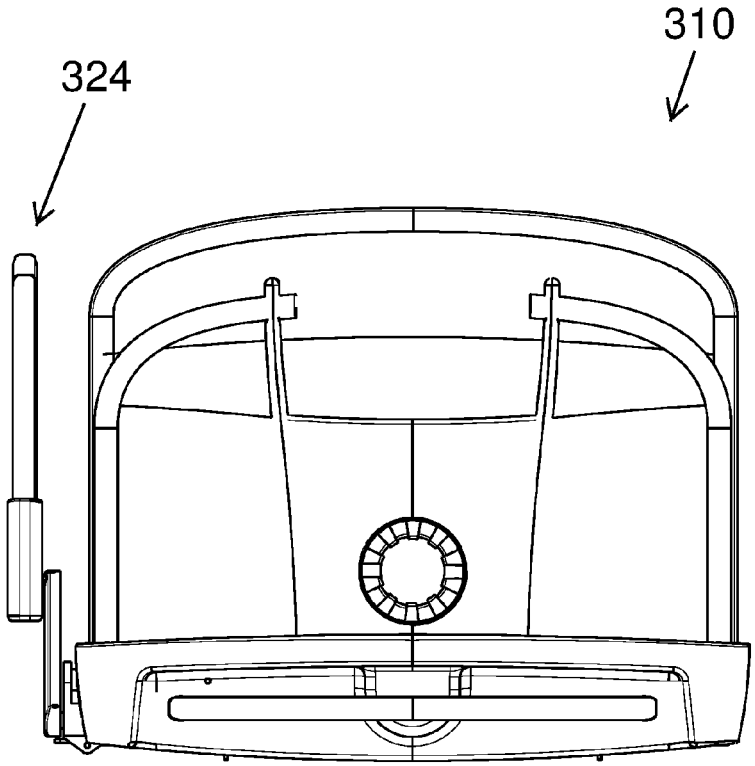
FIG. 37 is an end elevation view of the patient support of FIG. 35.

Mounted to frame 312 are head-end side rails 322 and foot-end side rails 324, similar to the patient support 10. Optionally, one or more of the mounting members 336, which mount the respective side rail bodies to the frame, are fixed relative to the frame. Referring to FIGS. 32 and 35, side rails 322 and 324 are configured to move to an egress/ingress configuration, where at least one of head-end side rails 322 is moved to the head-end, and at least one of the foot-end side rails 324 is moved adjacent the foot-end of frame 312 so that they define an egress or ingress space there between to facilitate a patient entering or leaving patient support 310. Further, head-end side rails 322 are optionally configured so that when the head section of deck 314 is raised, head-end side rails 322 may be moved manually or optionally automatically moved toward the foot-end of frame 312 so that they generally align with the seat section of deck 314 so as to provide a barrier that better aligns with the center of gravity of a patient supported on the mattress. For example, a link may be provided between the head-end deck section and each side rail 322 to impart the automatic movement of the side rail. Further, the head-end side rails may move linearly or may rotate when moved adjacent the seat section. For example, the side rail 322 may move linearly with respect to the frame along with its carriage (described below), or the side rail body may rotate about the carriage to align with the seat section. In this latter case, the link that drives the side rail body movement may be between the side rail body and the head end deck section.

Referring again to FIGS. 32 and 35, frame 312 includes a pair of longitudinal extending support rails 330 that extend generally parallel to and spaced from the deck support members (see deck support members 28 described above). Further, as described in reference to patient support 10, support rails 330 may be laterally moveable relative to deck support members to widen patient support 310.

As best understood from FIGS. 32 and 35, support rails 330 provide a mounting surface for side rails 322 and 324. Thus, side rails 322 and 324 are decoupled from deck 14 and are instead mounted to frame 312 by mounting mechanisms 336. In the illustrated embodiment, mounting members 336 of side rails 322 move linearly along frame 312, and provide a mount about which the side rails' bodies move when being raised or lowered, as described above in reference to mounting members 36. In contrast, the mounting members 336 of side rails 324 may be fixed relative to frame 312 but include elongated mounting arms 340' and 342' as compared to the mounting arms 40 and 42 of side rail 24 to provide the same or similar range of motion. However, in this embodiment, the arms of side rail 324 move from a generally ten o'clock position relative to the carriage when at its head-end position (this is just used as a relative term and is not meant to imply that the side rail is at the head-end and instead just means the position where it is closest to the head-end) to a generally two o'clock position when at its foot-end position (again when it is in its closest to the foot-end).

For further details of the mounting mechanisms 336, including arms 340, 342, carriages 344 and the carriage mechanisms that enable movement of the side rails and arms, reference is made to mounting mechanism 36, carriage 44, arms 40, 42, and their associates timing belt and cog assemblies, shafts and etc. of patient support 10.

Thus in a similar manner to patient support 10, when frame 312 and deck 314 are lowered to their fully lowered position (e.g. approximately 12 inches from the floor), should side rail bodies 322*a* and 324*a* be in their lowered position and make contact with the floor, any force impact to the side rail bodies will cause the arms to rotate and each side rail body to move upwardly. With the illustrated configuration, the foot-end side rail body (when in its foot-end position) will move in a counter-clockwise motion, and the head-end side rail body will move with a clockwise motion as viewed in FIG. 32. However, when the foot-end side rail body is in its head-end position when lowered, it would cause its arms to move with a clockwise motion.

From the foregoing, it can be appreciated that the present invention provides a support that can change its configuration as needed to provide a low height bed or to accommodate a facility with space restrictions. Further, the support may incorporate side rails that offer easy egress from or ingress to the patient support, and which also may improve the safety, care, and environment for a patient supported by the patient support.

While several forms of the invention have been shown and described, other changes and modifications will be appreciated by those skilled in the relevant art. For example, an air supply system with one or more ports for delivering air to power devices at the patient support may also be incorporated, such as described in U.S. Pat. No. 8,011,039, entitled PATIENT SUPPORT WITH UNIVERSAL ENERGY SUPPLY SYSTEM and in U.S. copending application Ser. No. 13/220,106, filed Aug. 29, 2011, entitled PATIENT SUPPORT WITH UNIVERSAL ENERGY SUPPLY SYSTEM, which are incorporated by reference in their entireties herein.

It should be understood that directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert but which can be used independently and/or combined with other features. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular.

Therefore, it will be understood that the embodiments shown in the drawings and described above are merely for illustrative purposes, and are not intended to limit the scope of the invention which is defined by the claims which follow as interpreted under the principles of patent law including the doctrine of equivalents.

The embodiments of the invention in which we claim an exclusive property right or privilege are defined as follows:

1. A patient support comprising:

a frame having a head-end and a foot-end;

an articulatable deck being supported by said frame and having a head section and a seat section, said head section being movable between a generally horizontal orientation and a raised position; and a pair of head-end side rails mounted to said frame adjacent but independent from said deck, each of said head-end side rails including a side rail body having a fixed length and configured to move between a defined raised position and a defined lowered position relative to said frame, and each of said head-end side rails configured for independent linear movement along said frame from a first position adjacent said head-end of said frame when said movable head section of said deck is in said generally horizontal orientation to form a barrier adjacent said head section of said deck to a second position away from said head-end when said head section is moved to its raised position to form a barrier adjacent said seat section.

2. The patient support according to claim 1, wherein the frame is adapted to increase in size to accommodate larger patients.

3. The patient support according to claim 2, further comprising a patient support surface supported on the deck, wherein the patient support surface increases in size in response to said support frame increasing in size.

4. The patient support according to claim 1, further comprising a base for supporting said frame, the base being adapted to increase in dimension to provide a larger footprint for said frame.

5. The patient support according to claim 4, wherein the base includes a base frame and a plurality of casters, at least one of the casters being spring mounted to the base frame to provide suspension.

6. The patient support according to claim 5, wherein at least two casters of the casters are mounted to the base frame by a torsional shaft, the torsional shaft providing suspension for each of said two casters.

7. The patient support according to claim 5, wherein the support frame is adapted to increase in size to accommodate larger patients.

8. The patient support according to claim 1, further comprising a lift mechanism for raising or lowering said frame relative to a floor, the lift mechanism configured to lower the frame to a lowermost position wherein the frame is in a range of about 12 inches to 18 inches relative to the floor.

9. The patient support according to claim 8, wherein each of the side rail bodies is mounted to the frame for movement between their defined raised and lowered positions by a mounting mechanism, the mounting mechanisms maintaining said side rail bodies in generally vertical orientations when the side rails are moved between said defined raised positions and said defined lowered positions even when the lift mechanism lowers said frame to its lowermost position.

10. The patient support according to claim 9, wherein when in the defined lower positions, the side rail bodies are lowered beneath the frame and the mounting mechanisms are adapted to allow the side rails to raise up in response to making contact with the floor when the frame is moved to its lowermost position.

11. The patient support according to claim 1, further comprising a foot-end side rail, the foot-end rail having a side rail body being mounted for movement between defined raised and lowered positions by a mounting mechanism, each mounting mechanism of the head-end side rails and foot-end side rail including a carriage and a pair of arms rotatably mounted at one end to a respective side rail body and rotatably mounted at an opposed end to a respective carriage, and the carriages mounted for linear movement along the frame.

12. The patient support according to claim 11, wherein the pair of arms of one of the mounting mechanisms rotates in a counterclockwise direction when raising the side rail body of one of the side rails, and the pair of arms of another mounting mechanism rotates in a clockwise direction when raising the side rail body of another side rail.

13. The patient support according to claim 11, wherein each of the mounting mechanism defines the defined raised position and the defined lowered position of each side rail body, each of said pair of arms forming an acute angle with respect to the frame when in their defined raised and lowered positions wherein the arms have a range of motion greater than the distance between the raised position and the lowered position of the respective side rail body.

14. The patient support according to claim 13, wherein at least one pair of arms laterally couples to the carriage over a first range of motion and laterally decouples from the carriage over a second range of motion wherein the carriage provides lateral support to the pair arms over the first range of motion.

* * * * *